US005480768A

United States Patent [19]

Ishida et al.

[11] Patent Number: 5,480,768

[45] Date of Patent: Jan. 2, 1996

[54] METHOD FOR PROCESSING EXPOSED SILVER HALIDE PHOTOGRAPHIC LIGHT-SENSITIVE MATERIAL USING A SOLID PROCESSING COMPOSITION REPLENISHER

[75] Inventors: Kenji Ishida; Shigeharu Koboshi, both of Hino, Japan

[73] Assignee: Konica Corporation, Tokyo, Japan

[21] Appl. No.: 195,336

[22] Filed: Feb. 14, 1994

[30] Foreign Application Priority Data

Feb. 17, 1993 [JP] Japan ..... 5-028099

[51] Int. Cl.[6] ..... G03C 3/00; G03C 5/18; G03C 5/26; G03C 5/38

[52] U.S. Cl. ..... 430/399; 430/398; 430/400; 430/450; 430/458; 430/465; 430/486; 430/933

[58] Field of Search ..... 430/398, 399, 430/400, 450, 458, 465, 933, 486

[56] References Cited

U.S. PATENT DOCUMENTS

| | | | |
|---|---|---|---|
| 2,074,200 | 3/1937 | Barth et al. | 430/458 |
| 2,179,242 | 11/1939 | Ham | 430/458 |
| 2,825,647 | 3/1958 | Fuller | 430/465 |
| 3,158,482 | 11/1964 | Lucas | 430/465 |
| 4,900,651 | 2/1990 | Ishikawa et al. | 430/486 |
| 4,923,786 | 5/1990 | Kühnert et al. | 430/450 |
| 5,053,321 | 10/1991 | Kühnert | 430/450 |
| 5,055,384 | 10/1991 | Kühnert | 430/450 |
| 5,135,840 | 8/1992 | Renrer | 430/450 |
| 5,204,230 | 4/1993 | Kayashi | 430/450 |
| 5,217,854 | 6/1993 | Abe | 430/450 |
| 5,240,822 | 8/1993 | Tanaka et al. | 430/450 |
| 5,316,898 | 5/1994 | Ueda et al. | 430/400 |
| 5,334,492 | 8/1994 | Wernicke et al. | 430/399 |
| 5,351,103 | 9/1994 | Komatsu et al. | 430/398 |
| 5,362,610 | 11/1994 | Yoshimore | 430/465 |

FOREIGN PATENT DOCUMENTS

| | | | |
|---|---|---|---|
| 0540296 | 5/1993 | European Pat. Off. . | |
| 5-100368 | 4/1993 | Japan | 430/450 |

*Primary Examiner*—Charles L. Bowers, Jr.
*Assistant Examiner*—J. Pasterczyk
*Attorney, Agent, or Firm*—Frishauf, Holtz, Goodman, Langer & Chick

[57] ABSTRACT

A method for processing an exposed silver halide photographic light-sensitive material is provided, comprising developing the photographic material with a developer, fixing the photographic material with a fixer, stabilizing the photographic material with a stabilizer, and replenishing at least one of the developer, the fixer and the stabilizer by supplying a processing composition, wherein the processing composition is a solid composition, meeting the following requirement, $$2 \leqq S/R \leqq 70$$

wherein S is a dissolving time (in minutes) of a unit by weight of the solid composition supplied and R is an amount (in $m^2$) of the photographic material processed per unit weight of the solid composition supplied.

8 Claims, 29 Drawing Sheets

FIG. 13 (A)
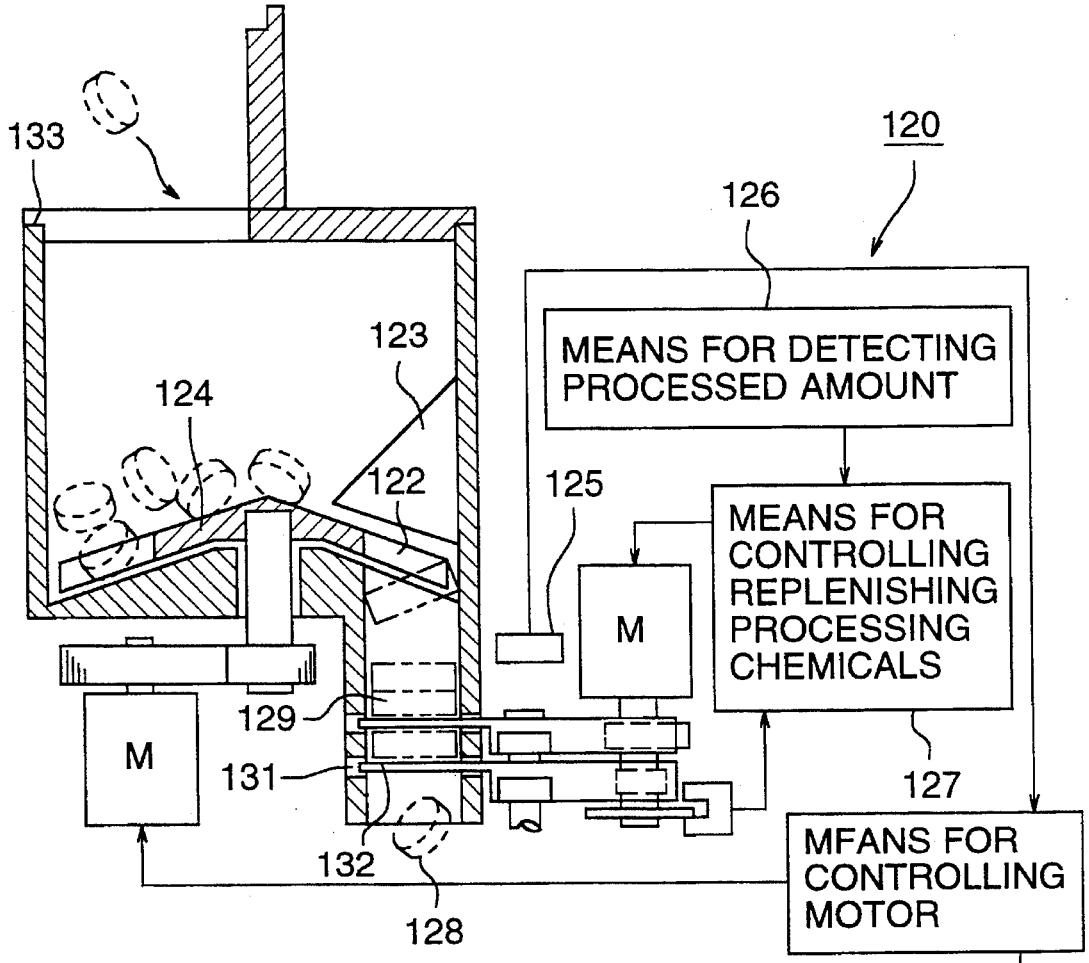
FIG. 13 (B)
FIG. 13 (C)
PACKED TABLETS OF PROCESSING CHEMICALS
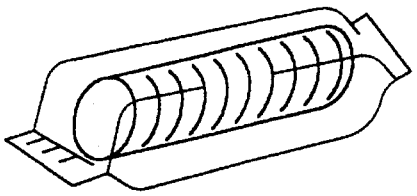
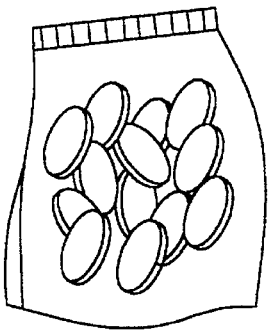

FIG. 20 ( A )
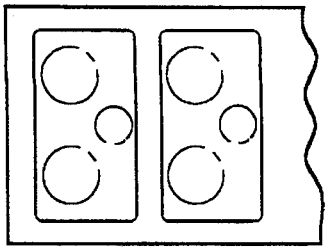
FIG. 20 ( B )
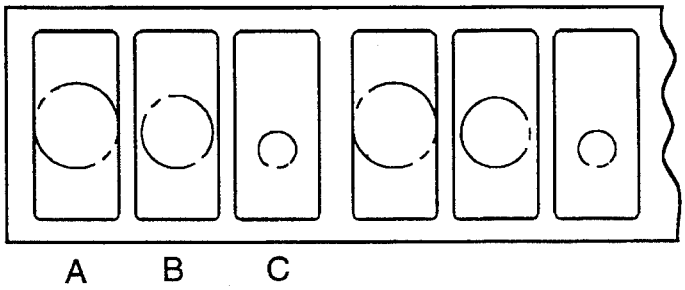
FIG. 20 ( C )
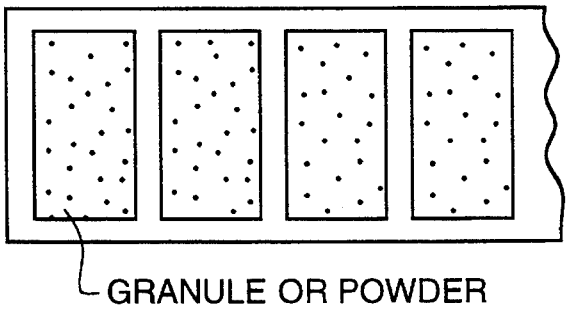
FIG. 20 ( D )
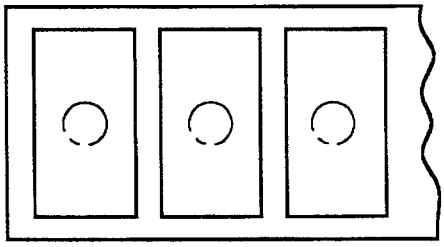
FIG. 20 ( E )
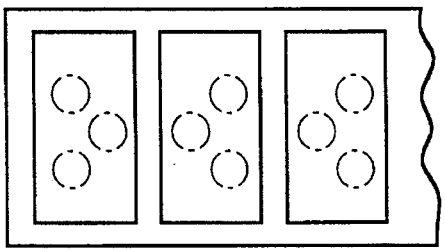

FIG. 25 ( A )
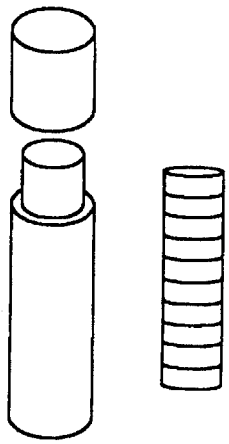
FIG. 25 ( B )
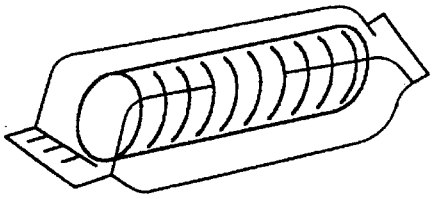
FIG. 25 ( C )
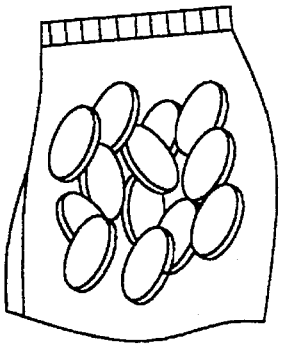

FIG. 29 ( A )
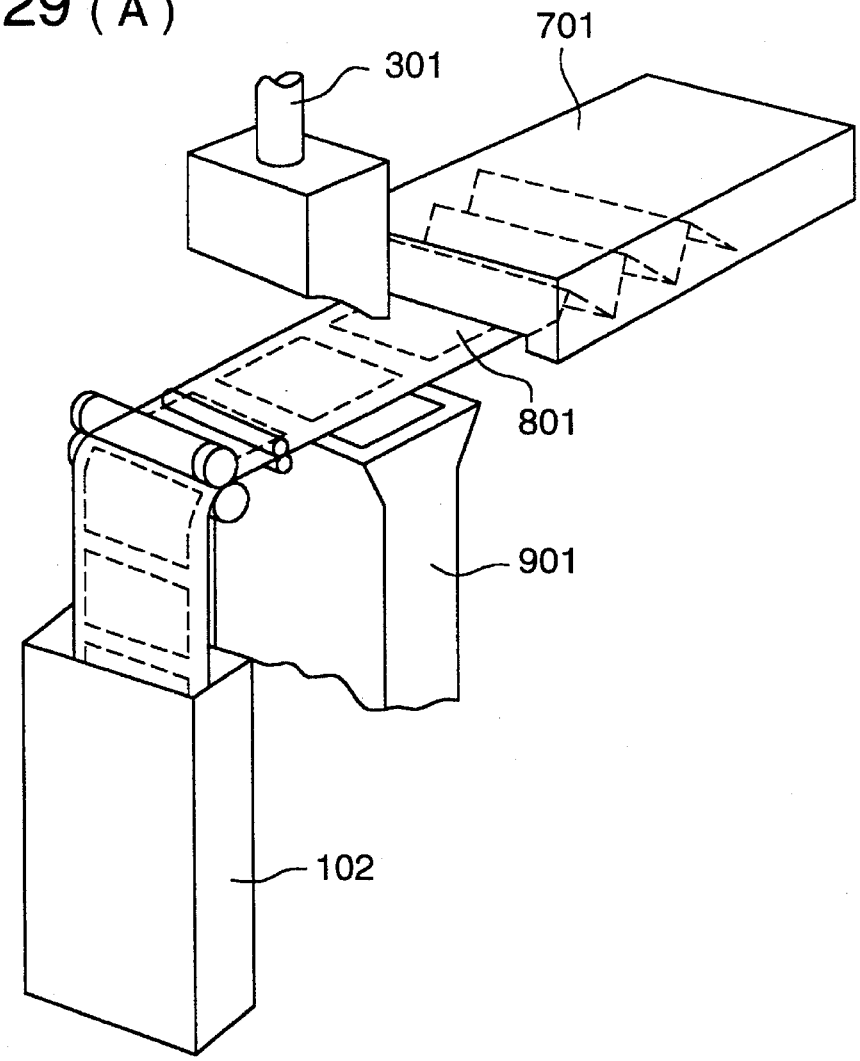
FIG. 29 ( B )
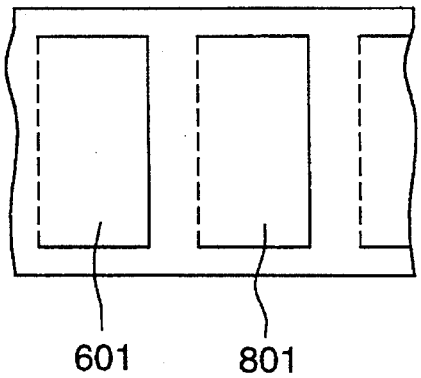

METHOD FOR PROCESSING EXPOSED SILVER HALIDE PHOTOGRAPHIC LIGHT-SENSITIVE MATERIAL USING A SOLID PROCESSING COMPOSITION REPLENISHER

FIELD OF THE INVENTION

This invention relates to a solid processing chemical for a silver halide photographic light-sensitive material use (hereinafter sometimes simply referred to as a solid processing chemical) and particularly to a solid processing chemical which can be supplied stably and precisely and can also be excellent in solubility, when the solid processing chemical is directly put into an automatic processor for processing a silver halide photographic light-sensitive material (hereinafter sometimes simply referred to as an automatic processor).

BACKGROUND OF THE INVENTION

A silver halide color photographic light-sensitive material (hereinafter sometimes referred to as a light-sensitive material or a photographic material), after exposed to light, is then processed in the steps such as a series of developing, desilvering, washing and stabilizing steps. And, a silver halide black-and-white photographic light-sensitive material, after exposed to light, is then processed in the series of developing and fixing steps. In these processes, a black-and-white developer or a color developer for carrying out a developing step, a bleacher or a bleach-fixer for a desilvering step, city water or deionized water for a washing step, a stabilizer for a non-water washing step, and a stabilizer for a dye-stabilizing step, respectively.

A liquid having a processing function for carrying out each of the above-mentioned processing steps is referred to as a processing solution. Each of the processing solutions is usually controlled to be a temperature within the range of 30° to 40° C., and a light-sensitive material is dipped in these processing solutions in order, so that it can be processed.

Such a process as mentioned above is commonly carried out by transporting a light-sensitive material, by making use of an automatic processor, through the respective processing tanks containing the above-mentioned processing solutions in order.

The term, "an automatic processor", stated herein generally means a processing machine having a developing unit, a fixing unit, a desilvering unit, a washing or stabilizing unit and a drying unit and also a means for automatically transporting a photographic light-sensitive material in order through each of the processing tank units.

When processing a light-sensitive material by making use of such an automatic processor as mentioned above, it has been popular to use a system for replenishing a processing chemical, for the purpose of keeping constant the activity of a processing solution contained in a processing tank.

As for the above-mentioned processing chemical replenishing systems, a system for making ready in advance a replenishing solution prepared by dissolving a processing chemical therein has widely been used.

To be more concrete, the processing operations have been carried out by timely supplying a replenishing solution prepared in advance from a replenishing solution tank to a processing tank.

In this case, a replenishing solution itself to be reserved in a replenishing tank is usually prepared at a separate place. In mini-labs and so forth, however, it has been common to prepare a specific amount of a replenishing solution at a time in a replenishing tank arranged closely to a processing machine. When preparing the replenishing solution, a dissolving work by hand or a dissolving-mixing work by a mixer has been carried out.

A processing chemical for silver halide photographic light-sensitive material use (hereinafter sometimes referred to as a photographic processing chemical) is available on the market in the powder or liquid form. When making use of the powder-formed, the solution thereof is prepared by dissolving it in a specific amount of water by hand. When making use of the liquid-formed, the solution thereof is prepared and then used upon lightly stirring and then diluting it with a specific amount of water, because the liquid was already concentrated.

There are some instances where a replenishing tank is arranged by the side of an automatic processor and, in this case, it is required to secure a considerably wide space. In the recently increasing minilabs, replenishing tanks are incorporated into the main body of an automatic processor. However, the replenishing tanks for 5- to 10-liter solutions are at least required, so that a space enough for these replenishing tanks is to be secured.

For displaying excellent and stable characteristics in a photographic process, a processing chemical for replenishment is separated into some parts. A color developing solution for color light-sensitive material is separated into 3 to 4 parts. The replenishing solution for a bleach-fixing for color light-sensitive material is separated into two parts, namely, a part of a ferric organic acid salt as an oxidizing agent and the other part of thiosulfuric acid as a reducing agent. When preparing the replenishing solution, a part of the above-mentioned ferric organic acid salt that was concentrated and the other part containing the thiosulfuric acid salt that was concentrated are mixed up together and a specific amount of water is then added thereto, so that the resulting replenishing solution may be used.

The resulting concentrated parts are available on the market in such a form that each part is put in a container such as those made of plastics and the containers are collectively put in an outer carton (such as a corrugated cardboard box) as a unit.

A processing chemical for replenishment comprising each kit of the above-mentioned parts is dissolved, diluted, mixed and then finished to be a specific amount, so that it may be used. However, these processing chemicals for replenishment have the following disadvantages.

The first disadvantage is as follows. Most of the conventional kits are in the form of a concentrated aqueous solution so concentrated as to improve the workability, that is seriously dangerous because the kits have a pH of not higher than 2.0 or not lower than 12.0. Accordingly, most of the kits are harmful to human body such as the adhesion thereof to human skin, and most of them are a strong oxidizing agent or reducing agent. Therefore, they have a seriously dangerous corrosive property particularly when they are transported by a boat or airplane. Also because they are in the form of an aqueous solution, the solubility thereof is limitative and they become heavier in weight and larger in volume than in the case of a solid form. Because such a concentrate as mentioned above is hazardous, it is required that the containers thereof will not be destroyed and the solution therein will not be spilt even when dropping them from a certain height. Therefore, the containers thereof are so made as to be more stronger, so that the disposal thereof has raised a problem.

The second disadvantage is as follows. Each part is put in an individual container and, when some processing chemical for replenishment is separately put in several part containers. In the case of a unit, the number of containers are considerably increased. Therefore, a wide space is required, especially when storing or transporting the units. For example, a color developer replenisher, CPK-2-20QA, that is a color paper processing solution is taken as a unit of 10 liters-, and it is separated into 3 parts, namely, a preservative-containing kit as Part A, a color developing agent-containing kit as Part B and an alkali as Part C, respectively. Parts A, B and C are each put in a 500 ml-capacity plastic container. Similarly, a bleach-fixer solution is taken as a unit of 8 liters, and the parts thereof are separately put in two bottles. These replenishers are put in variously sized outer cartons and are then stored or transported, respectively. However, a stabilizer is put in a relatively smaller outer carton having a size of about 17 cm×14 cm×16.5 cm and a bleach-fixer is put in a relatively larger outer carton having a size of about 18.5 cm×30.5 cm×22.5 cm. Therefore, only the same kind of a replenishers can be stored, transported or piled up in a shop and, resultingly, a large amount of space is required.

The third disadvantage is as follows. The disposal of an empty container is made problematic. Mainly in Europe and the U.S. in recent years, the protection of environment and the saving of resources have seriously been demanded. For the photographic industry, the disposal of a plastic container has particularly raised a problem. The plastic containers for photographic use are inexpensive in cost, convenient in storage and transportation and excellent in chemical resistance, however, they have almost no biodegradation property so that they may be piled up. When they are thrown into fire, a large amount of carbonic acid gas is produced to be a cause of warming the earth and falling acid rain. As for the problems for users, it is pointed out that a large number of plastic containers are piled up in a small working space and that the containers cannot be crushed out because they are hard, so that the space requirement may be made smaller.

The 4th disadvantage is that the chemicals used are extremely unstable.

The lifetime of a replenishing solution is usually two weeks even when a floating cover is used. Recently, however, the replenished amount of each processing solution has been reduced. For example, at a minilab receiving daily orders for average 30 rolls of color films and processing them, 10 liters of each replenishing solution is often used for not shorter than one month.

In such a case as mentioned above, each replenishing solution in replenishing tanks has much more opportunities to be exposed to the air than in the case of each processing solution in processing tanks, so that the replenishing solutions are deteriorated and, therefore, it has very often occurred to be quite non-sense even if any replenishments have been made. Accordingly, there have been devised to make a replenishing tank smaller to have a capacity of 5 liters or to make a replenishing kit smaller to have a reception capacity unit of 5 liters. In this case, a disadvantage is induced by that an additional packaging material is further required.

Besides the above, when taking an example of a replenishing solution for developing color paper, the replenishing solution for developing color paper is prepared in the following manner. After putting a given amount of water in a replenishing tank, a preservative-containing concentrated kit A is put therein and stirred up. Then, a color developing agent-containing concentrated kit B is put therein and stirred up. Finally, water is so added thereto as to make a given amount. In this case, some problems are liable to raise. For example, if a stirring is not satisfactory or if an initial water is forgotten to be added, the crystals of the color developing agent are liable to be deposited and a bellows pump is clogged with the resulting deposits thereof so as not to replenish the replenishing solution and, therefore, the photographic characteristics may be made sometimes unstable and the bellows pump may also be damaged. The concentrated kits are not always used immediately after preparing them, but they may be used one year or so after preparing them. In some case, the color developing agent and preservative may be oxidized so that the characteristics may become unstable.

It has been known that some additional problems are raised in a replenishing solution for color developing use contained in a replenishing tank. For example, when a replenishing solution is not used for a long time, some crystals may be made adhered to the walls of the replenishing tank and the replenishing solution may be liable to be oxidized and, further, tar and so forth may be produced. According to the preservation conditions, there raises such a problem that a component liable to be crystallized such as a color developing agent is deposited at a low temperature. It is, therefore, an actual situation that some manufacturers designate the specific preservation conditions for their replenishing solutions so that the users can control the conditions.

As described above, even when taking an example of a method in which a replenishing solution is prepared by making use of a commonly applicable concentrated kits or by making use of a powdered chemical, there is such a problem as mentioned above, and there also raises a similar problem in a bleach-fixing solution, a bleaching solution and a fixing solution. For example, a bleach-fixing solution has a seriously low grade characteristics in preservability. Because a bleach-fixing treatment is carried out immediately after treating with a high pH color developing solution. The alkaline color fixing solution is commonly carried in by a sheet of paper subject to treatment. It is, therefore, usual that an acidity is made higher and a pH is made substantially lower for neutralizing the color fixing solution. When making use of a low-pH bleach-fixing solution comprising a thiosulfate and an oxidizer, the preservability thereof is seriously deteriorated, and it is said that any small amount of replenishment cannot be made even if a replenishing solution is prepared. The same may be said of a fixing solution and a stabilizing solution.

Besides the above-mentioned problems, a replenishing solution has been getting more concentrated while low and rapid replenishing techniques have been progressed and, therefore, the recent replenishing solutions have been usually concentrated up to the limit of a solubility.

From the practical viewpoints, the above-mentioned facts also induce many problems that the preservability of a replenishing solution is deteriorated and, moreover, crystals are deposited.

On the other hand, separate from the method in which a replenishing solution is prepared by making use of such a concentrated kit or powdered chemical as mentioned above, there is also a known method for directly replenishing a concentrated kit.

The above-mentioned method is to replenish a concentrated kit directly to a processing tank by making use of a supplying means such as a bellows pump so that the ineffectiveness of a dissolving operation can be improved and, at the same time, the method is to replenish a specific amount of water independently. In this method, it is no doubt that a work for preparing a solution can be eliminated, as compared to the method for preparing a replenishing solution of the above-mentioned concentrated kit or powder,-or that a preservation problems can be eliminated because any replenishing solution is not prepared.

However, the above-mentioned method has also many problems. For example, a problem is that a tank for a concentrated kit and a pump for serving as a supplying means are additionally required to supply the concentrated kit, so that an automatic processor has to be made larger in size. Taking a CPK-2-20 that is a color paper processing solution into consideration, for example, the concentrated kit for a replenishing solution for color development is comprised of 3 parts, the concentrated kit for a replenishing solution for bleach-fixation is comprised of 3 parts and the concentrated kit for replenishing solution for stabilization is comprised of 2 parts. When supplying the parts of every kit, 8 tanks for the concentrated kits and 8 pumps for supplying them are necessarily required. In the case of a conventional replenishment system, it could be enough to provide the tanks and pumps for every replenishing solution and, therefore, a replenishment can be performed by providing only 3 each of tanks and pumps. As mentioned above, even when taking the case of supplying the concentrated kits only into consideration, not only many tanks and pumps but also a pump for controlling an amount of water to be supplied are respectively required for this method as compared to the conventional methods. Further there is such a disadvantage that plural solutions can hardly be spilled precisely at the same time from a bellows pump, so that an unbalance may be produced between the amounts of each component, because the accuracy of the bellows pump is not so high.

Further, crystals are liable to deposit around the orifice of a replenishing nozzle because the concentrated kits are in the form of a concentrated solution. Therefore, the maintenance of a replenishing nozzle is troublesome. Still further, when replenishing a concentrated solution, the replenishment accuracy is liable to become seriously erratic because the bellows pump is not very high in supplying accuracy. Resultingly, there raises such a problem that the photographic characteristics are seriously fluctuated. Besides the above, there is another problem that the amounts of waste plastic containers are as same as in the case of the conventional system, even if the system for supplying a concentrated kit is used.

Separate from the above-described methods, there are some proposals for improving the chemical stability of a replenishing solution.

For example, Japanese Patent Publication Open to Public Inspection (hereinafter referred to as JP OPI Publication) No. 58-11032/1983 discloses a technique for filling a development component into a microcapsule. JP OPI Publication No. 51-61837/1976 discloses a photographic tablet containing a decaying agent. And, JP OPI Publication Nos. 2-109042/1990, 2-109043/1990, 3-39735/1991 and 3-39739/1991 discloses each a method for making use of a granulated photographic processing chemical having a certain average particle size.

The photographic tablet containing a decaying agent described in JP OPI Publication No. 51-61837/1976 is simply proposed to be a tablet readily dissolvable with water. This proposal can suggest nothing of such an idea of this invention that a solid processing chemical is directly dissolved in a processing tank.

JP OPI Publication No. 2-109042/1991 describes of a granulated photographic processing chemical having a certain average particle size.

However, the above-mentioned patent publications do not propose any compact-sized automatic processor from which a replenishing solution dissolving work can be eliminated to satisfactorily simplify a workability so that a stable photographic characteristics can be obtained and a replenishing tank can also be eliminated.

On the other hand, for the methods from which a preliminary dissolving work is eliminated, JP OPI Publication No. 3-11344/1991 discloses a technique in which a paste-formed part chemical is extruded in an amount corresponding to a mixed ratios of the part chemicals from each of unit containers and the extruded part chemical is controlled and supplied precisely by diluting it to have a specific concentration. According to this method, it is no doubt that the dissolving works can be reduced or eliminated, however, the paste-formed part chemical may lack in stability because it contains a solvent and a series of the extrusion in a constant amount can hardly be performed for a long time and, further, a nozzle is liable to be clogged if not frequently used, so that the photographic characteristics can hardly be maintained constantly. In addition, it is required to use a container for putting the paste therein and, in this case, a flexible and hardly damageable material is required to be used, that is, however, a compounded material generally incapable of being recycled, so that this kind of material is not preferable from the viewpoint of environmental protection. In particular, a paste-formed chemical is often made into a paste form by making use of an organic solvent and it has, therefore, been known that the preservability thereof is not much acceptable.

Japanese Utility Model Publication Open to Public Inspection No. 1-85732/1989 discloses an automatic processor having a means for adding a tablet type microbiocide to a stabilizing solution. The control of adding the microbiocide is not necessary, because the microbiocide itself does not raise any problem even if many of them are added. Therefore, this disclosure does neither suggest any idea of a means for controlling the replenishment of a processing solution, nor suggest any of the means to be inevitable, because the microbiocide has the purpose of keeping the solution itself antiseptic.

WO 91-07698 and WO 91-07699 disclose each a method for adding CD-3 or CD-4 in the form of a solid and the other components as an activator in the form of a liquid. These patents are each concerned in a regeneration and particularly in an invention of a low replenishment unlimitedly close to a so-called no-overflow replenishment, that is, a method in which bromide ion and chloride ion are made adsorbed to be removed from a developing solution by making use of an ion-exchange resin and then for adding an insufficient component such as an alkalizing activator and a solid-formed or small amount of a concentrated color developing agent, so as to add the components without increasing any volume.

JP OPI Publication No. 4-213454/1992 describes that a powdered processing chemical is directly added to the auxiliary tank of an automatic processor. However, this patent publication does not describe anything of the time for dissolving the powdered processing chemical, nor is the method for adding a processing chemical to a subject light-sensitive material described. In the case of a conventional type liquid-formed replenishing solution system, the liquid-formed replenishing solution is used for keeping a processing solution constant in a processing tank. For example, the liquid-formed replenishing solution has played a role for diluting an accumulated component eluted out of a subject light-sensitive material, or it has mainly played a role for replenishing a components consumed with a subject light-sensitive material. In contrast to the above, in the case of a system for directly adding a solid-formed processing chemical to a processing solution reserved in a processing tank, the liquid-formed replenishing solution is to play a role for replenishing a consumed component, and the role for diluting an accumulated component is to be played by a replenished water.

However, a solid-formed processing chemical is to be dissolved in a processing tank. It is normally considered that the shorter a dissolving time is the better. If a dissolving time is too short when directly adding a solid-formed processing chemical to a processing solution, a component subject to consumption becomes in an excessively added state for a moment and, therefore, the balance between the consumption and supply thereof is lost and, resultingly, a processability is fluctuated, so that a problem is raised to lack a stability. For a measure to counter this problem, it may be considered to reduce an amount of a solid-formed processing chemical to be added and then to increase the frequency of adding it. In this case, there raises such a problem that an increased load is applied to a solid-formed processing chemical supplying unit so as to shorten the lifetime thereof or that a tablet type chemical or a solid-formed processing chemical separately weighed in advance and individually packed as an adding unit are each to have many packing units.

If a dissolving time is-made much longer, the supply of a solid-formed chemical becomes excessive in relation to the time of dissolving it in a processing tank so that the insoluble matter of the solid-formed processing chemical is accumulated in the processing tank. Therefore, a problem of producing a precipitate in the processing tank is raised.

The present inventors have repeated to try many experiments of the methods for directly dissolving a solid-formed processing chemical in a processing tank and finally discovered the above-described points at issue.

SUMMARY OF THE INVENTION

It is an object of the invention to provide a practically applicable solid-formed processing chemical eliminating the use of a liquid chemical that may induce a danger in transportation and handling and also eliminating a complicated operation that may have to be made by a user.

Another object of the invention is to provide a solid processing chemical from which a concentrated kit dissolving operation to be made by hand of a user himself can be eliminated and by which a fully automatic replenishing system can be completed.

A further object of the invention is to provide a solid processing chemical to be directly added to a processing solution, wherein a processing stability cannot be spoiled and the dissolution thereof can be made in a processing tank without producing any precipitates.

A yet another object of the invention is to provide a solid processing chemical completely eliminating the necessity for preserving a liquid replenisher and improving a processing stability.

A still further object of the invention is to achieve a low pollution system from which any plastic bottle for liquid use is eliminated and the use of a plastic-made packing material is reduced.

For solving the above-described problems, the present inventors have discovered that the above-mentioned problems can be solved by the following institution of the invention.

The above-mentioned objects of the invention can be achieved with a solid processing chemical directly put in a processing solution for a silver halide photographic light-sensitive material use, wherein a completely dissolving time S (in min/g) of one weight unit of said solid processing chemical and an amount R (in $m^2/g$) of a silver halide photographic light-sensitive material processed per weight unit of said solid processing chemical are within the range of $$2 \leqq S/R \leqq 70 \text{ (in min/m}^2\text{)}$$

BRIEF DESCRIPTION OF THE DRAWINGS

FIG. 13(A) is a cross-sectional view of a still further example of the supply units FIG. 13B and FIG. 13(C) are perspective views of packages for packing tableted chemicals;

FIG. 20(A), FIG. 20(B), FIG. 20(C), FIG. 20(D), and FIG. 20(E) are plan views of a sealed package;

FIG. 25(A), FIG. 25(B) and FIG. 25(C) are perspective drawings which show an example of collective packages;

FIG. 29(A) is a perspective view of a unit for halfdie-cutting the package shown in FIG. 31 and FIG. 29(B) is a plan view of a portion of the drawing depicted in FIG. 29(A);

DETAILED DESCRIPTION OF THE INVENTION

Figure 1:
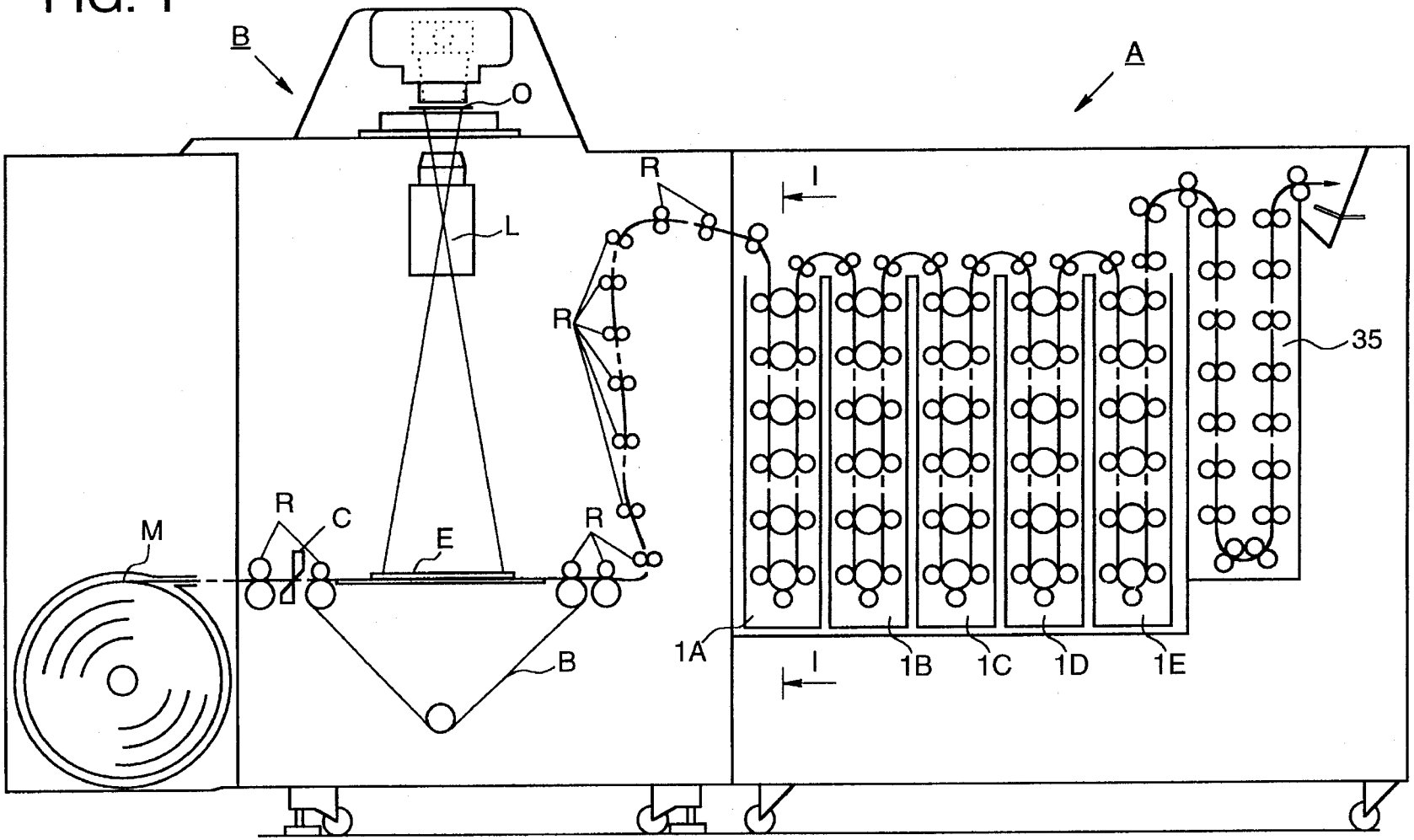
FIG. 1 is a schematic illustration of the structure of a printer.processor comprising an automatic processor and a photographic printer each built thereinto a body.

The solid processing chemical is directly added to a processing solution reserved in a processing tank. The solution in the processing tank is so controlled as to be kept approximately at a given temperature. In other words, a dissolving speed is almost the same all the year round.

It was discovered that the above-mentioned fact can also induce such a great advantage that any insolubilization phenomenon cannot be produced, that is often produced when dissolving a solid processing chemical in cold water. An insolubilization phenomenon named by the present inventors means a solidified phenomenon produced when adding a solid processing chemical at a time into cold water while stirring it little or slowly, or, in other words, the phenomenon means that a vitrified state is as apparently produced. In contrast to the above, when dissolving a solid processing chemical in warm water at a processing temperature for an automatic processor, such an insolubilization phenomenon as mentioned above can remarkably be reduced.

However, after further devoting themselves to study the dissolution of solid processing chemicals, the present inventors have discovered that, when a solid processing chemical is added directly to a processing tank, a total weight of a solid processing chemical per a single addition of the solid processing chemical and a quantity of light-sensitive materials subject to be processed with the solid processing chemical per a single addition of the solid processing chemical, both have an essential relation to the processing and a dissolving stability.

Different from a liquid-formed replenishing solution, when a solid processing chemical is directly added to a processing tank, it is required as the first stage to carry out a step for dissolving the solid processing chemical and as the second stage to carry out a step for making the resulting solution uniform in the processing tank.

If a dissolution is too fast, a dissolved part is locally and excessively concentrated, so that a precipitate thereof is produced before carrying out the step for making the dissolved solution uniform in the processing tank.

Even if the resulting solution is made uniform, the balance between a component consumed by processing a light-sensitive material in the processing tank and a component supplied by the processing chemical is lost. Therefore, it was discovered that the processing stability is deteriorated.

On the contrary, when a dissolution is too slow, the supply of the solid processing chemical becomes excessive in relation to the time for dissolving the solid processing chemical contained in the processing tank and, thereby an insoluble solid processing chemical is accumulated in the processing tank and the aforementioned insolubilization phenomenon is also produced in the temperature-controlled processing tank, so that it was found that such a problem is finally raised that the insoluble material accumulated in the processing tank affects the transportation of the light-sensitive material or that the insoluble material adheres to the light-sensitive material, In other words, there arise the problems each when a dissolving time S of a unit by weight of a solid processing chemical directly added to a processing tank (min) is too short, or when it is too long. It was therefore discovered that the above-mentioned time S is to have a certain suitable value and further that there is an essential rule between a quantity of light-sensitive materials subject to be processed by a unit by weight of the solid processing chemical, $Rm^2$ and the above-mentioned time S.

To be more concrete, it was really amazing to discover that the above-described problems cannot be solved until a solid processing chemical satisfying the following relation is used, $$2 \leqq S/R \leqq 70 \ (\text{min}/\text{m}^2)$$

preferably $$4 \leqq S/R \leqq 40 \ (\text{min}/\text{m}^2)$$

and that the specific merits of the solid processing chemical can be put into practice.

A solid processing chemical herein called in the invention include such a powdered processing chemical as mentioned before and such a solid processing chemical as a tableted chemical, a pill-formed chemical and a granulated chemical and, if required, those may be moistureproof-treated. The paste- and slurry-types processing chemicals are in the semi-liquid state and are lower in the preservation stability, and those in such a form as is subject to a regulation may induce a danger in transportation. Therefore, those are excluded from the solid processing chemicals of the invention.

The term, "a powder", stated herein means an aggregate of fine crystals. The term, "a granule", stated herein means a granule prepared by processing a powder in a granulating step and the resulting granule has an average size within the range of 50 to 5000 μm. And, the term, "a tableted chemical", stated herein means a solid chemical that is prepared by compression-molding a powdered or granulated chemical into a certain form.

Among the above-mentioned solid processing chemicals, a tableted chemical is rather preferably used, because it is higher in replenishing accuracy and simpler in handling.

A photographic processing chemical is solidified by any means such as a means carried out by kneading a concentrated liquid photographic processing chemical or a finely powdered or granulated photographic processing chemical with a water-soluble binder and then by molding the resulting kneaded material into a solid and another means carried out by spraying a water-soluble binder over the surface of a preliminarily molded photographic processing chemical and then by forming a coated layer. (Refer to JP OPI Publication Nos. 4-29136/1992, 4-85535/1992, 4-85536/1992, 4-85533/1992, 4-85534/1992 and 4-172341/1992.)

As for the preferable processes for preparing a tableted chemical, there is a process in which a powder-formed solid processing chemical is granulated and a tableted chemical is then formed by carrying out tableting. This process has such an advantage that the solubility and preservability thereof can be improved more than in a solid processing chemical formed simply by mixing the components of the solid processing chemical and then by forming the solid processing chemical in a tableting step and, resulting, that the photographic characteristics can also be stable.

The granulation processes for forming a tableted chemical applicable thereto include, for example, any known processes such as a rolling granulation process, an extruding granulation process, a compression granulation process, a cracking granulation process, a stirring granulation process, a fluid-bed layer granulation process and a spray-drying granulation process. For forming a tableted chemical, a resulting granule can be used to have an average granule size within the range of 100 to 800 μm and, more preferably 200 to 750 μm, because of the viewpoint that the time for dissolving a solid processing chemical can be stable when the components thereof can hardly be uniformed, that is, when the so-called segregation can hardly be produced in mixing and pressure-compressing the granule. Further, the granularity distribution is preferable when not less than 60% of the granular particles have a deviation within the range of ±100 to 150 μm. When pressure-compressing the resulting granules, it is allowed to use any known compressors such as a hydraulic press, a single-shot tableting machine, a rotary tableting machine and a briquetting machine. A solid processing chemical prepared by applying a pressure-compression thereto may be shaped into any forms. However, the solid processing chemical is preferable to be shaped into a cylindrical form that is so-called a tableted form, because its dissolving time can be stable, from the viewpoints of producibility and handling convenience or taking the problem of powder dust produced when a user handles a processing chemical into consideration.

In granulating a solid processing chemical, it is further preferable to separately granulate each of the components thereof such as an alkalizer, a reducer, a bleacher and a preserver, because the above-mentioned advantages can more remarkably be displayed.

A tableted processing chemical can be prepared in such a common process as described in JP OPI Publication Nos. 51-61837/1976, 54-155038/1979 and 52-88025/1977 and British Patent No. 1213808. A granulated processing chemical can be prepared in such a common process as described in JP OPI Publication Nos. 2-109042/1990, 2-109043/1990, 3-39735/1991 and 3-19739/1991. A powdered processing chemical can be prepared in such a common process as described in JP OPI Publication No. 54-133332/1979, British Patent Nos. 725892 and 729862 and German Patent No. 3733861.

A volumetric bulk density of the above-mentioned solid processing chemical is preferably within the range of 1.0 g/cm$^3$ to 2.5 g/m$^3$ from the viewpoints of the solubility thereof and the effects of the objects of the invention. When it is more than 1.0 g/cm$^3$, it is more preferable from the viewpoint of the strength of the resulting solid. When it is less than 2.5 g/cm$^3$, it is more preferable from the viewpoint of the solubility of the resulting solid. When a solid processing chemical is in the granular or powdered form, the volumetric bulk density thereof is preferably within the range of 0.40 to 0.95 g/cm$^3$.

The term, "a unit by weight of a solid processing chemical", stated herein means a total weight of the solid processing composition replenished per single addition to a corresponding processing tank in accordance with processing information.

For example, when adding the plural kinds of solid processing composition each as a component part to any processing tank respectively, the total weight of every part of the compositions means a unit by weight.

The term, "a time S for completely dissolving a unit by weight of a solid processing chemical", stated herein means a time from the point of time when adding a unit by weight of a solid processing composition directly to a processing solution reserved in a processing tank of an automatic processor to the point of time when the processing chemical is completely dissolved therein. The term, "a complete dissolution", means a state in the course until the solid of a solid processing chemical cannot be confirmed visually, but emphatically not a state in the course until the dissolved matter is uniformed in a processing tank.

A processing tank may be thermostatically controlled inside thereof at any temperature and the tank may also have a simple stirring function such as a liquid circulating function.

The term, "a quantity R of light-sensitive materials subject to be processed with a solid processing chemical per single unit by weight", stated herein means a total area of the light-sensitive materials subject to be processed within an interval for adding a unit by weight of a solid processing chemical to a processing tank.

A processing composition of the invention is separately weighed in advance before the processing chemical is put into an automatic processor or the processing chemical is separately weight before a package containing the processing chemical is set to a fixing means. For example, it means that the processing composition is embodied into a certain sized tablet or pill or that the granulated or powdered processing chemical is subdivided into an individual small package containing a certain amount thereof, provided that these embodiments exclude such an embodiment that the granulated or powdered processing chemical is put in a storing means and is then weighed and taken an amount thereof for a single addition every time when supplying it. In the conventional replenisher supplying system, the replenishment is carried out by making use of a bellows pump. However, this system is not intrinsically suitable for a precise replenishment control, because the accuracy of the bellows pump is not stable. On the other hand, a solid processing chemical applicable to the invention is manufactured, for example, by weighing and separating it into a certain amount thereof at a processing chemical production factory and the replenishment control thereof is performed by an ON/OFF control for adding or not adding the solid processing chemical. Therefore, any scattering problem cannot be raised by a replenishment or a dissolving time and, accordingly, the accuracy of supplying a processing chemical can be higher by leaps and bounds and thereby a stable processing performance can be enjoyed.

In a solid processing chemical applicable to the invention and when it is in the powdered form, a completely dissolving time S per unit by weight is governed by a raw material having a rate-determination of a solubility, among the raw materials mixed up in the chemical. Therefore, the completely dissolving time S is to be controlled by properly selecting a suitable raw material having a rate-determination of a solubility.

When it is in the granulated form, the completely dissolving time S is to be controlled by properly selecting a raw material suitable for a granulation process and an average particle size of the granules, besides the raw materials mixed up in the chemical.

Generally, a dissolving time can be shortened by making the surface area of a granule larger. Therefore, a dissolving time can be shortened by making use of a granule having a small average particle size.

When a solid processing chemical is in the tableted form, a completely dissolving time is to be controlled by adjusting a tableting pressure and a surface area of a subject tablet, as well as by selecting the materials mixed up in the chemical and a granulation process. Generally, a tableting pressure and a dissolving time are in a linear relation and, therefore, a dissolving time can be made longer by making a tableting pressure higher.

The solid processing chemicals applicable to the invention can be used for such a photographic processing chemical as a color developer, a black-and-white developer, a bleach, a fixer, a bleach-fixer and a stabilizer. Among them, a color developer is particularly remarkable to display an effect of stabilizing the photographic characteristics.

A color developer, a black-and-white developer, a bleach, a bleach-fixer and a stabilizer are ruled out of the regulation on dangerous materials.

From the viewpoint of the embodiments of the invention, it is most preferable that all processing chemicals are solidified and is preferable that at least a color developer is solidified. To be more concrete, the components of a color developer contain many subcomponents which are chemically reactive with each other and also contain a harmful subcomponents and, therefore, the effects of the invention can remarkably be displayed. It is more-preferable that a bleach-fixer or a bleach and a fixer are each solidified, as well as a color developer. The above-given chemicals each have been separately packed in an individual liquid-formed kit, so that the problem on the danger of transportation thereof has so far been simmering.

A processing chemical having at least a part solidified and a solid processing chemical each applicable to the invention are included in the scope of the invention. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

It is preferable that all the processing chemicals are solidified and are then replenished to the corresponding processing tanks so as to meet the information on a processing amount. When an amount of replenishing water is required, it is replenished in accordance with an information on a processing amount or another information on the replenishing water control. In this case, the liquids to be replenished to a processing tank can only be replenishing water. In other words, when a plurality of processing tanks are required to be replenished, the tanks for reserving some replenishing liquids can be saved to be only a single tank by making use of replenishing water in common, so that an automatic processor can be made compact in size. In particular for making the automatic processor compact in size, it is preferable to put a water replenishing tank to the outside of the automatic processor.

A preferable embodiment of a solid processing chemical applicable to the invention is that all of an alkalizer, a color developing agent and a reducer are solidified when solidifying a color developer, and that, when a color developer is tableted, the numbers of the tablets may be not more than 4 tablets and, preferably, a single tablet. When the solid processing chemicals are solidified separately into not less than 2 tablets, it is preferable to pack these plural tablets or granules in the same package.

A moisture-proofed package for tablets or pills may be embodied of such a raw material as given below.

As for a synthetic resin material, any one of the following materials may be used; namely, polyethylene (including any one prepared in either a high-pressure method or a low-pressure method), polypropylene (either non-stretched or stretched), polyvinyl chloride, polyvinyl acetate, Nylon (either stretched or non-stretched), polyvinylidene chloride, polystyrene, polycarbonate, Vinylon, Evarl, polyethylene terephthalate (PET), other polyesters, rubber hydrochloride, an acrylonitrile-butadiene copolymer and an epoxy-phosphoric acid type resin (a polymer described in JP OPI Publication Nos. 63-63037/1988 and 57-32952/1982), or pulp.

The films of the above-given materials are usually made adhered to each other so as to be laminated. However, these materials may also be formed into a coated layer.

It is further preferable to provide a gas-barrier layer thereto. For example, an aluminium foil or an aluminium vacuum-evaporated synthetic resin is sandwiched between the above-mentioned synthetic resin films.

A total oxygen permeability of the above-mentioned laminated layers is, preferably, not higher than 50 ml/m$^2$ 24 hr/atm (at 20° C. and 65%RH) and, more preferably, not higher than 30 ml/m$^2$ 24 hr/atm.

A total thickness of the above-mentioned laminated layers is within the range of, preferably 1 to 2000 μm, more preferably 10 to 1000 μm and, further preferably 50 to 1000 μm.

The above-mentioned synthetic resin films may be comprised of a single (macromolecular) resin layer or not less than 2 laminated (macromolecular) resin layers.

As for a single macromolecular resin layer capable of satisfying the requirements of the invention, for example, the following materials may be used thereto.

(1) polyethylene terephthalate (PET) having a thickness of not thinner than 0.1 mm, (2) an acrylonitrile-butadiene copolymer having a thickness of not thinner than 0.3 mm, and (3) rubber hydrochloride having a thickness of not thinner than 0.1 mm.

Among them, polyethylene terephthalate can suitably be used in the invention, because it is also excellent in resistance to alkalinity and acidity.

Next, for a laminated macromolecular resin layer capable of satisfying the requirements of the invention, for example, the following materials may be used thereto.

(4) PET/a polyvinyl alcohol.ethylene copolymer (Evarl)/polyethylene (PE), (5) stretched polypropylene (OPP)/Eval/PE, (6) unstretched polypropylene (CPP)/Eval/PE,
(7) Nylon (N)/aluminium foil (Al)/PE,
(8) PET/Al/PE,
(9) cellophane/PE/Al/PE,
(10) Al/paper/PE,
(11) PET/PE/Al/PE,
(12) N/PE/Al/PE,
(13) paper/PE/Al/PE,
(14) PET/Al/PET/polypropylene (PP),
(15) PET/Al/PET/high-density polyethylene (HDPE),
(16) PET/Al/PE/low-density polyethylene (LDPE),
(17) Evarl/PP,
(18) PET/Al/PP,
(19) paper/Al/PE,
(20) PE/PVDC coated Nylon/PE/Ethyl vinyl acetate.polyethylene condensate (EVA),
(21) PE/PVDC-coated N/PE,
(22) EVA/PE/Al-vacuum-evaporated Nylon/PE/EVA,
(23) Al-vacuum-evaporated Nylon/N/PE/EVA,
(24) OPP/PVDC-coated N/PE,
(25) PE/PVDC-coated N/PE,
(26) OPP/Eval/LDPE,
(27) OPP/Eval/CPP,
(28) PET/Eval/LDPE,
(29) ON (stretched Nylon)/Eval/LDPE, and
(30) CN (unstretched Nylon)/Eval/LDPE.

Among them, the above-given (20) through (30) can preferably be used.

As for the concrete constituents of the packaging materials, the following examples of the constituents may be given in the order from the inside of a package, provided that the packing material side coming into contact with a processing chemical is regarded as the inside;

PE/cardboard as a principal constituent/PE/Al/ an epoxy-phosphoric acid type resin layer/a polyester type resin layer/PE, PE/K-Nylon/PE or an adhesive/Al/PE/cardboard/PE, PE/Vinylon/PE or an adhesive/Al/PE/cardboard/PE, PE/vinylidene chloride/PE or an adhesive/Al/PE/cardboard/PE, PE/polyester/PE or an adhesive/Al/PE/cardboard/PE, and Polypropylene/K-Nylon/polypropylene/Al/polypropylene/cardboard/polypropylene.

The methods of moisture-proof-packaging tablets or pills include, for example, the following methods, namely, Four-side sealing, Three-side sealing, Stick-like sealing (including a pillow-like or cassette-like sealing), PTP sealing, and Cartridge sealing.

The four-side sealing, 3-side sealing and stick-like sealing are classified by the shapes and these sealing methods can be applied to the above-given materials; provided when these sealing methods are utilized to a peal-open system, the sealing material is laminated with a sealant so that a peal-opening aptitude can be provided thereto.

The above-mentioned peal-open system generally includes a cohesive failure system, an interface pealing system and an interlayer pealing system.

The cohesive failure system is a system in which an adhesive called a hot-melt and a heat-seal lacquer are used as a sealer and a seal is peal-opened by cohesive failure in the inside of a sealant layer when the seal is to be opened.

The interface pealing system is a system in which a pealing is made on the interface between two layers of film, and a sealing film (so-called a sealant) and a matter subject to adhesion are not completely fused together, so that the peal-opening can be made by applying an appropriate force. The sealants include a film prepared by mixing a viscous resin therein. The materials of such a film may be selected from polyethylene or the copolymers thereof and polyesters so as to meet the materials of the matter subject to the adhesion.

The interface pealing system is a system in which a sealant is pealed apart between the layers of laminated films by making use of such a multilayer co-extruding film such as a laminated film.

In a peal-open system applied with a film of the invention, an interlayer pealing system or a interface pealing system is preferably used.

Such a sealant as mentioned above is relatively thin. Therefore, it is commonly used by laminating it on other film including, for example, those made of polyethylene, polypropylene, polystyrene, polycarbonate, a polyester (such as polyethylene terephthalate), polyvinyl chloride, Nylon, Evarl, and aluminium. From the viewpoints of moisture resistance, environmental protection and matching for a content of a package, polyethylene, polypropylene, polyester and Evarl may preferably be used. Taking a printability into consideration, it is preferable to use non-stretched polypropylene, polyester, paper sheet or the like as the outermost surface of a package.

The above-mentioned sealants include, for example, CMPS film manufactured by Tocello Co., Diclan PP-100 and PS-300 each manufactured by Dai-Nippon Ink Mfg., Co., LTD film manufactured by Toppan Printing Co., and San-Seal FR and MS each manufactured by San-Ei Chemical Co., and so forth. The polyester-laminated types thereof include, for example, Diclan C-1600 and C-1602T and so forth.

The above-mentioned PTP is a blister packaging form in which a solid processing chemical is put on a molded sheet made of PVC, CPP or the like and it is then heat-sealed with an aluminium material.

From the viewpoint of environmental protection, there is a tendency to avoid PVC from being used as a molding material. Recently, A-PET and a highly moisture-resistive PP (such as TAS-1130, TAS-2230 and TAS-3230 each manufactured by Taisei Chemical Industrial Co., Ltd.) have preferably been used.

When packing, binding or covering a processing chemical by making use of a water-soluble film or a binder, the water-soluble film or a binder each preferably applicable thereto include, for example, those comprising a basic material of a polyvinyl alcohol type, methyl cellulose type, polyethylene oxide type, starch type, polyvinyl pyrrolidone type, hydroxypropyl cellulose type, pullulan type, dextran type, gum arabic type, polyvinyl acetate type, hydroxyethyl cellulose type, carboxyethyl cellulose type, sodium carboxymethyl hydroxyethyl cellulose type, poly(alkyl) oxazoline type and polyethylene glycol type. Among them, those of a polyvinyl alcohol type and a pullulan type can more preferably be used from the viewpoint of the covering or binding effect.

The preferable polyvinyl alcohol is a very effective material for forming a film, because it has an excellent strength and flexibility under almost any conditions. Polyvinyl alcohol compositions available on the market, which are molded into a film, have various degrees of molecular weight and hydrolyses. However, the polyvinyl alcohol compositions are preferable to have a molecular weight within the range of 10000 to 100000, approximately. The term, "a degree of hydrolysis", herein means a ratio of the acetic acid group of polyvinyl alcohol is substituted by a hydroxyl group. When polyvinyl alcohol is applied to a film, the range of the hydrolysis is ordinarily within the range of 70% to 100% approximately. As mentioned above, the scope of the polyvinyl alcohol ordinarily include a polyvinyl acetate compound.

The above-mentioned water-soluble films can be prepared in such an ordinary process as described in JP OPI Publication Nos. 2-124945/1990, 61-97348/1986, 60-158245/1985, 28-6638/1990, 57-117867/1982, 2-75650/1990, 59-226018/1984, 63-218741/1988 and 54-13565/1979.

As for the water-soluble films, those available on the market under the brand names such as Solvlon (manufactured by Ai-Cello Chemical Co.), Hi-Cellon (manufactured by Nichigo Film Co.) or Pulrane (manufactured by Hayashibara Co.) may be used. Besides the above, a 7-000 series of polyvinyl alcohol films available from the MONO-SOL Division of Chris Craft Industries, Inc. can particularly preferable to be used, because these films can be dissolved in water at a temperature of 34° F. to 200° F. approximately and they can show a high chemical resistance without any harmfulness.

From the viewpoints of the preservability of a solid processing chemical, the dissolving time of a water-soluble film and the crystal deposition in an automatic processor, the layer thickness of the water-soluble film is to be within the range of, preferably 10 to 120 μ, particularly 15 to 80 μ and, inter alia 20 to 60 μ.

The water-soluble films are preferable to be thermoplastic, because a heat-sealing or supersonic fusing treatment can readily be performed and a covering effect can more excellently be displayed.

The tensile strength of a water-soluble film is to be within the range of, preferably $0.5\times10^6$ to $50\times10^6$ kg/m$^2$, more preferably $1\times10^6$ to $25\times10^6$ kg/m$^2$ and, particularly $1.5\times10^6$ to $10\times10^6$ kg/m$^2$. The tensile strength is measured in the method specified in JIS Z-1521.

A photographic processing chemical packed, bound or covered by a water-soluble film or a binder is preferable to be packed in a moisture-resistive packaging material so as to be protected from a high moisture, a moisture in the air such as rain and mist, and an accidental damage produced by bringing the package into contacting with water by scattering water or by wet hand in the course of storing, transporting or handling the package. The moisture-resistive packaging materials include preferably a film having a thickness within the range of 10 to 150 μ. The material thereof is preferably at least a material selected from the group consisting of a polyolefin film such as those of polyethylene terephthalate, polyethylene and polypropylene, a sheet of craft paper capable of having a moisture-resistive effect displayable with polyethylene, waxed sheet of paper, moisture-resistive cellophane, glassine, polyester, polystyrene, polyvinyl chloride, polyvinylidene chloride, polyamide, polycarbonate, acrylonitrile and a metal foil such as those of aluminium, and a metallized polymer. They may also be a compounded material of the above-given material.

In an embodiment of the invention, it is also preferable that a moisture-resistive material is made of a decomposable plastic including particularly a biodegradable or photolyzable plastic.

The biodegradable plastics include, for example, (1) those comprising a natural macromolecule, (2) a microbial growing polymer, (3) a synthetic polymer having a good biodegradation property, and (4) a compound of a biodegradable natural macromolecule to a plastic. The photolyzable plastics include, for example, (5) those having a group made present in the principal chain so as to be excited by UV rays and then coupled to a scission. Besides the above-given macromolecules, those having the two functions of a photolyzing and biodegrading properties at the same time may also effectively be used.

The typical and concrete examples thereof may be given as follows.

The examples of the biodegradable plastics may be given as follows;

(1) natural macromolecules, namely,
A polysaccharide, cellulose, polylactic acid, chitin, chitosan, polyamino acid, and the modified thereof;

(2) microbial growing polymers, namely,
"Biopol" comprising PHB-PHV (that is a copolymer of 3-hydroxybutylate and 3-hydroxybarrelate), and microbial growing cellulose;

(3) a synthetic polymer having a good biodegradation property, namely,
polyvinyl alcohol, polycaprolactone and the copolymer or mixture thereof;

(4) a compound of a biodegradable natural macromolecule to a plastic, namely,
a natural macromolecule having a good biodegradation property such as starch and cellulose, which is added to a plastic so that a configuration decaying property can be provided to the plastic.

(5) photolyzable plastics, namely,
those introduced thereinto with a carbonyl group for providing a photodecaying property, and those added thereto with a UV absorbent for accelerating a decaying property.

As for such a decomposable plastics as mentioned above, those publicly described in, for example, "Chemistry and Industry", Vol. 64, No. 10, pp. 478–484, (1990); "The Kino Zairyo", July, 1990 Issue, pp. 23–34; may be used. Besides the above, it is also allowed to use the decomposable plastics available on the market, such as Biopol (manufactured by I.C.I.), Eco (manufactured by Union Carbide Corp.), Ecolite (manufactured by Eco Plastics, Inc.), Ecostar (manufactured by St. Lawrence Starch Co.) and Nackle P (manufactured by Japan-Unicar, Inc.).

The above-mentioned moisture-proofed packaging materials are to have a moisture permeability coefficient of not higher than 10 g.mm/m$^2$.24 hr and, preferably not higher than 5 g.mm/m$^2$.24 hr.

As for the means for supplying a solid processing chemical to a processing tank in the invention, and in the case where the solid processing chemical is of the tablet type, for example, there are such a well-known means as described in Japanese Utility Model OPI Publication Nos. 63-137783/1988, 63-97522/1988 and 1-85732/1989, wherein, in short, any means may be used, provided that at least a function for supplying a tableted chemical to a processing tank can be performed. And, in the case where the solid processing chemical is of the granulated or powdered type, there are such a well-known means such as the gravity dropping systems described in JP OPI Publication Nos. 62-81964/1987, 63-84151/1988 and 1-292375/1989, and the screw system described in JP OPI Publication Nos. 63-105159/1987 and 63-84151/1988. However, the invention shall not be limited to the above-given well-known means.

Among them, however, a preferable means for supplying a solid processing chemical to a processing tank is such a means, for example, that a prescribed amount of a solid processing chemical is weighed out in advance and is then separately packed and the package thereof is opened and the chemical is then taken out of the package so as to meet the quantity of light-sensitive materials to be processed. To be more concrete, every prescribed amount of a solid processing chemical and, preferably, every amount for a single replenishment is sandwiched between at least two packing materials constituting a package. When separating the package into two directions or opening a part of the package, the solid processing chemical can be ready to take out thereof. The solid processing chemical ready to be taken out thereof is readily be supplied to a processing tank having a filtration means by naturally dropping the chemical. The prescribed amounts of the solid processing chemicals are each separately packed respectively in a tightly sealed package so as to shut off the open air and the air permeability to any adjacent solid processing chemicals. Therefore, the moisture resistance can be secured unless the packages are opened.

In an embodiment of the invention, it may be to have a constitution in which a package comprising at least two packing materials sandwiching a solid processing chemical therebetween is brought into close contact with or made adhered to the peripheries of the solid processing chemical on each of the contacting surfaces of the two packing materials so as to be separable from each other, if required. When each of the packing materials sandwiching the solid processing chemical therebetween is pulled each to the different directions, the close contacted or adhered surfaces are separated from each other, so that the solid processing chemical can be ready to take it out.

In another embodiment of the invention, it may be to have the following constitution. In a package comprising at least two packing materials sandwiching a solid processing material therebetween, at least one of the packing materials thereof can be ready to open the seal by applying an external force. The expression, "to open a seal", stated herein means that a packing material is notched or broken off as a part of the packing material remains unnotched or unbroken off. It may be considered to open a seal in such a manner that a solid processing chemical is forcibly extruded by applying a compression force from the side of a packing material subject to be unopened through a solid processing chemical to the direction of a packing material made ready to be opened, or that a solid processing chemical can be ready to take out by notching a packing material subject to be opened by making use of a sharp-edged member.

A supply-starting signal can be obtained by detecting an information on a processing amount. Based on the obtained supply-starting signal, a driving means for separation or opening a seal is operated. A supply-stopping signal can be obtained by detecting an information on the completion of a specific amount of supply. Based on the obtained supply-stopping signal, a driving means for separation or opening a seal is so controlled as to be stopped in operation.

The above-mentioned solid processing chemical supplying means has a means for controlling the addition of a specific amount of the solid processing chemical, that is an essential requirement for the invention. To be more concrete, in an automatic processor of the invention, these means are required to keep every component concentration constant in each processing tank and to stabilize every photographic characteristic. The term, "an information of the processing amount of silver halide photographic light-sensitive materials", means an information on a value obtained in proportion to an amount of silver halide photographic light-sensitive materials to be processed with a processing solution, to an amount of silver halide photographic light-sensitive materials already processed or to an amount of silver halide photographic light-sensitive materials being processed, and the values indicate indirectly or directly an amount of a processing chemical reduced in a processing solution. The values may be detected at any point of time before and after a light-sensitive material is introduced into a processing solution or during the light-sensitive material is dipped in the processing solution. An amount of a light-sensitive material printed by a printer may also be detected for this purpose. A concentration or concentration variation of a processing solution reserved in a processing tank may further be detected. An amount discharged to the outside after a processing solution is dried up may also be detected.

A solid processing chemical of the invention may be added to any position inside a processing tank and, preferably, to a position communicated with a section for processing a light-sensitive material and circulating a processing solution between the processing tank and the processing section. It is also preferable to have such a structure that a certain amount of processing solution can be circulated therebetween so that a dissolved component can be moved to the processing section. It is further preferable that a solid processing chemical is added to a thermostatically controlled processing solution.

As for a the color developing agents applicable to a color developer in the invention, a p-phenylenediamine type compound having a water-soluble group can preferably be used, because it can excellently display the effects of the objects of the invention and can produce few fogs.

As compared to a paraphenylenediamine type compound without having any water-soluble group such as N,N-diethyl-p-phenylenediamine, the above-mentioned p-phenylenediamine type compound having a water-soluble group has such an advantage not only that no light-sensitive material is stained and any human skin can hardly be poisoned even if the compound is applied to the skin, but also that the objects of the invention can more effectively be achieved by making combination use of a color developer of the invention.

The above-mentioned water-soluble groups include, for example, those having at least one attached to an amino group or benzene nucleus of a p-phenylenediamine type compound. The concrete examples of the water-soluble groups include, preferably, $-(CH_2)_n-CH_2OH$, $-(CH_2)_m-NHSO_2-(CH_2)_nCH_3$, $-(CH_2)_m-O-(CH_2)_n-CH_3$, $-(CH_2CH_2O)_nC_mH_{2m+1}$ (in which m and n are each an integer of not less than 0), —COOH group, and $-SO_3H$ group.

The concrete exemplified compounds of the color developing agents preferably applicable to the invention include those denoted by (C-1) through (C-16) given in JP Application No. 2-203169/1990, pp. 26–31.

The above-mentioned color developing agents are commonly used in the forms of such a salt as a hydrochloride, a sulfate and a p-toluenesulfonate.

The color developing agents may be used independently or in combination and, if required, they may also be used by making combination use of a black-and-white developing agent such as phenidone, 4-hydroxymethyl-4-methyl-1-phenyl-3-pyrazolidone and Metol.

In the invention, when a color developing agent relating to the invention contains a compound represented by the following Formulas [A] and [B], the effects of the objects of the invention can more excellently be displayed.

In other words, when a processing chemical is solidified, it can be displayed not only to improve the preservability of a solid processing chemical such as a tableted chemical, but also to keep the strength well as compared to the other compounds. In addition, a solid processing chemical has also such an advantage that it is photographically stable and that fogs can be produced few in an unexposed portion.

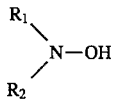

Formula [A]

In Formula [A], $R_1$ and $R_2$ represent each an alkyl group, an aryl group,

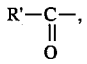

or hydrogen atom; provided that $R_1$ and $R_2$ do not represent each a hydrogen atom at the same time, that the alkyl groups represented by $R_1$ and $R_2$ may be the same with or the different from each other and may preferably have 1 to 3 carbon atoms, and that these alkyl groups may also have a carboxylic acid group, a phosphoric acid group, a sulfonic acid group or a hydroxyl group.

R' represents an alkoxy group, an alkyl group or an aryl group. The alkyl groups and aryl groups each represented by $R_1$, $R_2$ and R' include those having a substituent, and $R_1$ and $R_2$ are also allowed to form a ring by coupling to each other. For example, a heterocyclic ring such as piperidine, pyridine, triazine and morpholine may be formed.

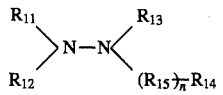

Formula [B]

wherein $R_{11}$, $R_{12}$ and $R_{13}$ represent each a hydrogen atom and a substituted or unsubstituted alkyl, aryl or heterocyclic group; $R_{14}$ represents a hydroxy group, a hydroxyamino group and a substituted or unsubstituted alkyl, aryl, heterocyclic, alkoxy, aryloxy, carbamoyl or amino group, provided that the heterocyclic group is a 5- or 6-membered ring comprised of C, H, O, N, S and a halogen atom and may be saturated or unsaturated; $R_{14}$ represents a divalent group selected from the group consisting of —CO—, —$SO_2$— or

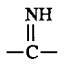

n is an integer of 0 or 1, provided when n is 0, $R_{14}$ represents a group selected from the group consisting of an alkyl group, an aryl group and a heterocyclic group, and that $R_{13}$ and $R_{14}$ may associatively form a heterocyclic group.

The typical examples of the hydroxylamine type compounds represented by Formula [A] are given in U.S. Pat. Nos. 3,287,125, 3,293,034 and 3,287,124. The particularly preferable typical exemplified compounds include those denoted by (A-1) through (A-39) given in JP Application No. 2-203169/1990, pp. 36–38, (1) through (53) given in JP OPI Publication No. 3-33845/1991, pp. 3–6, and (1) through (52) given in JP OPI Publication No. 3-63646/1991, pp. 5–7; respectively.

Next, the typical examples of the compounds represented by the above-given Formula [B] include those denoted by (B-1) through (B-33) given in JP Application No. 2-203169/1990, pp. 40–43 and (1) through (56) given in JP OPI Publication No. 3-33846/1991, pp. 4–6.

The compounds represented by the above-given Formula [A] or [B] may be commonly used in the forms of a free amine, a hydrochloride, a sulfate, a p-toluenesulfonate, an oxalate, a phosphate, an acetate and so forth.

In a color developer and a black-and-white developer applicable to the invention, a very small amount of a sulfite may be used as a preservative. Such a sulfite includes, for example, sodium sulfite, potassium sulfite, sodium bisulfite and a potassium bisulfite.

The color developers and black-and-white developers each applicable to the invention are required to contain a buffer therein. The buffers include, for example, sodium carbonate, potassium carbonate, sodium bicarbonate, potassium bicarbonate, trisodium phosphate, tripotassium phosphate, dipotassium phosphate, sodium borate, potassium borate, sodium tetraborate (or boric acid), potassium tetraborate, sodium o-hydroxybenzoate (or sodium salicylate), potassium o-hydroxybenzoate, sodium 5-sulfo-2-hydroxybenzoate (or sodium 5-sulfosalicylate), and potassium 5-sulfo-2-hydroxybenzoate (or potassium 5-sulfosalicylate).

As for a development accelerator, it is allowed to add, if required, a thioether type compound such as those given in JP Examined Publication Nos. 37-16088/1962, 37-5987/1962, 38-7826/1965, 44-12380/1969 and 45-9019/1970 and U.S. Pat. No. 3,813,247; a p-phenylenediamine type compound such as those given in JP OPI Publication Nos. 52-49829/1977 and 50-15554/1975; a quaternary ammonium salt such as those given in JP OPI Publication No. 50-137726/1975, JP Examined Publication No. 44-30074/1969 and JP OPI Publication Nos. 56-156826/1981 and 52-43429/1977; a p-aminophenol such as those given in U.S. Pat. Nos. 2,610,122 and 4,119,462; an amine type compound such as those given in U.S. Pat. Nos. 2,494,903, 3,128,182, 4,230,796 and 3,253,919, JP Examined Publication No. 41-11431/1966 and U.S. Pat. Nos. 2,482,546, 2,596,926 and 3,582,346; a polyalkylene oxide such as those given in JP Examined Publication Nos. 41-11431/1966 and 42-23883/1967 and U.S. Pat. No. 3,532,501; and, besides, a 1-phenyl-3-pyrazolidone, a hydrazine, a mesoionic type compound, an ionic type compound, and an imidazole.

As for the color developers, it is preferable to use those substantially not containing any benzyl alcohol. The expression, "substantially not containing. . . ", means that something is contained in an amount of not more than 2.0 ml per liter of a color developer used and, preferably, that nothing is contained at all. When benzyl alcohol is not substantially contained, a more better result can rather be obtained, because a photographic characteristic variation can be reduced in carrying out a continuous process and, particularly, a stain production can also be reduced.

For the purpose of preventing a fog production, it is required to use chlorine ion and bromine ion in a color developing solution reserved in a processing tank. From the viewpoints of a development speed, a stain prevention and a minimum density variation in the invention, chlorine ions are to be contained in an amount within the range of, preferably $1.0\times10^{-2}$ to $1.5\times10^{-1}$ molls per liter and, more preferably $4\times10^{-2}$ to $1\times10^{-1}$ molls per liter. Therefore, in the case of a solid processing chemical, a color developing solution is preferable to be controlled so that the concentration of the developing solution can be within the above-given range.

In the invention, from the viewpoints of a development speed, a maximum concentration, a sensitivity and a minimum concentration each of a color developer reserved in a processing tank, bromine ions are to be contained in an amount within the range of, preferably $3.0\times10^{-3}$ to $1.0\times10^{-3}$ molls per liter, more preferably $5.0\times10^{-3}$ to $5\times10^{-4}$ molls per liter and, particularly $1\times10^{-4}$ to $3\times10^{-4}$ molls per liter. As same as in the case of chlorine ions, it is also preferable to control a bromine concentration in a solid processing chemical so to be within the above-given range.

When directly adding a chlorine ion to a color developer, sodium chloride, potassium chloride, ammonium chloride, nickel chloride, magnesium chloride, manganese chloride, calcium chloride and cadmium chloride may be served as a chlorine ion supplying substance. Among them, sodium chloride and potassium chloride are preferably added.

It is also allowed to supply them in the form of a counter ion salt of a fluorescent whitening agent to be added to a color developer or a developer. As for the bromine ion supplying substances, sodium bromide, potassium bromide, ammonium bromide, lithium bromide, calcium bromide, magnesium bromide, manganese bromide, nickel bromide, cadmium bromide, cerium bromide and thallium bromide may be given. Among them, potassium bromide and sodium bromide are preferably used.

To a color developer and a developer each applicable to the invention, any antifoggant, besides chlorine ion and bromine ion, may be added, if required. As for the antifoggants, an alkali-metal halide such as potassium iodide, and an organic antifoggant may be used. The examples of the organic antifoggants include, typically, a nitrogen-containing heterocyclic compound such as benzotriazole, nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine and adenine.

From the viewpoint of displaying the effects of the objects of the invention, it is preferable to contain a triazinyl stilbene type fluorescent whitening agent in a color developer and developer each applicable to the invention. As for such a fluorescent whitening agents as mentioned above, the compounds represented by the following Formula [E] may preferably be used.

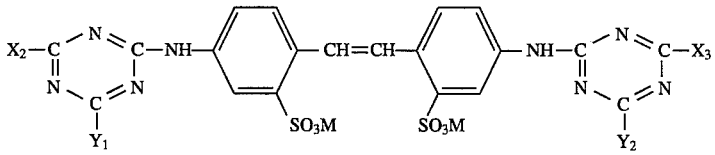

Formula [E]

In the above-given formula, $X_2$, $X_3$, $Y_1$ and $Y_2$ represent each a hydroxyl group, a halogen atom such as that of chlorine or bromine, an alkyl group, an aryl group,

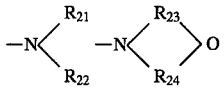

or —$OR_{25}$, wherein $R_{21}$ and $R_{22}$ represent each a hydrogen atom, an alkyl group (including a substituent thereof) or an aryl group (including a substituent thereof); $R_{23}$ and $R_{24}$ represent each an alkylene group (including a substituent thereof); $R_{25}$ represents a hydrogen atom, an alkyl group (including a substituent thereof) or an aryl group (including a substituent thereof); and M represents a cation.

The details of each of the groups and the substituents thereof are synonymous with those described in JP Application No. 2-240400/1990, the 8th line from the bottom of p. 63 to the 3rd line from the bottom of p. 64.

The typical examples of the compounds represented by Formula [E] will be given below.

| | M | $X_2$ | $Y_1$ | $X_3$ | $Y_2$ |
|---|---|---|---|---|---|
| E-1 | Na | 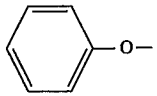 | $-NHC_2H_4OH$ | $-NHC_2H_4OH$ | 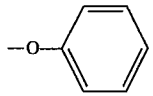 |
| E-2 | Na | $HOC_2H_4NH-$ | $-NHC_2H_4OH$ | $-NHC_2H_4OH$ | $-NHC_2H_4OH$ |
| E-3 | Na | 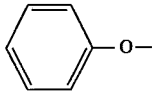 | $-N(C_2H_4OH)_2$ | $-N(C_2H_4OH)_2$ | 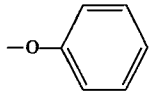 |
| E-4 | Na | $(HOC_2H_4)_2N-$ | $-OCH_3$ | $-OCH_3$ | $-NHC_2H_4SO_3Na$ |
| E-5 | Na | $HOCH_2CH_2NH-$ | $-N(C_2H_4OH)_2$ | $-N(C_2H_4OH)_2$ | $-NHCH_2CHOH$<br>\|<br>$CH_2OH$ |
| E-6 | Na | $(HOC_2H_4)_2N-$ | $-N(C_2H_4OH)_2$ | $-N(C_2H_4OH)_2$ | $-N(C_2H_4OH)_2$ |
| E-7 | Na | 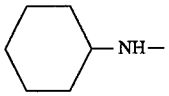 | $-NHC_2H_4OH$ | $-NHC_2H_4OH$ | 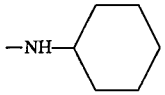 |
| E-8 | Na | 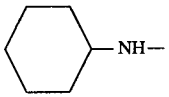 | $-N(C_2H_4OH)_2$ | $-N(C_2H_4OH)_2$ | 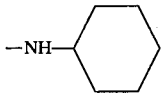 |
| E-9 | Na | $HO-$ | 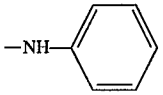 | 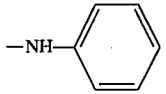 | $-OH$ |
| E-10 | Na | $H_2N-$ | 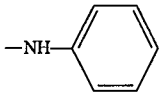 | 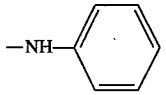 | $-NH_2$ |
| E-11 | Na | $CH_3O-$ | 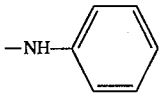 | 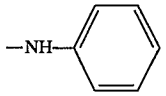 | $-OCH_3$ |

-continued
| | M | $X_2$ | $Y_1$ | $X_3$ | $Y_2$ |
|---|---|---|---|---|---|
| E-12 | Na | $HOC_2H_4NH-$ | 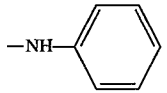 | 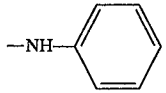 | $-NHC_2H_4OH$ |
| E-13 | Na | $(HOC_2H_4)_2N-$ | 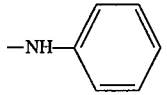 | 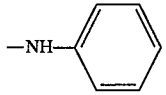 | $-N(C_2H_4OH)_2$ |
| E-14 | Na | $HOC_2H_4NH-$ | 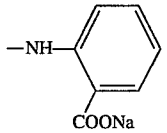 | 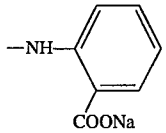 | $-NHC_2H_4OH$ |
| E-15 | Na | 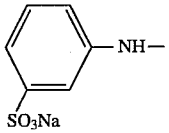 | $-N(C_2H_4OH)_2$ | $-N(C_2H_4OH)_2$ | 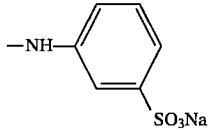 |
| E-16 | Na | 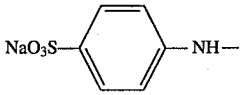 | $-N(C_2H_4OH)_2$ | $-N(C_2H_4OH)_2$ | 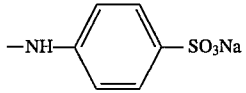 |
| E-17 | Na | 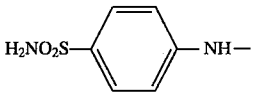 | $-N(C_2H_4OH)_2$ | $-N(C_2H_4OH)_2$ | 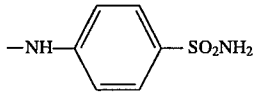 |
| E-18 | Na | 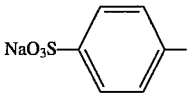 | $-N(C_2H_4OH)_2$ | $-N(C_2H_4OH)_2$ | 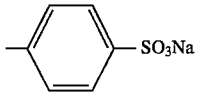 |
| E-19 | Na | $HOCH_2CH(CH_3)CH_2HN-$ | $-OCH_3$ | $-OCH_3$ | $-NHCH_2CH(CH_3)CH_2OH$ |
| E-20 | Na | $(HOC_2H_4)_2N-$ | 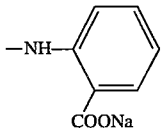 | 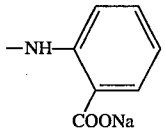 | $-N(C_2H_4OH)_2$ |

-continued
| | M | $X_2$ | $Y_1$ | $X_3$ | $Y_2$ |
|---|---|---|---|---|---|
| E-21 | Na | $HOC_2H_4NH-$ | 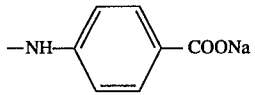 | 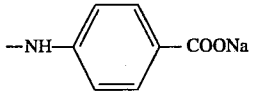 | $-NHC_2H_4OH$ |
| E-22 | Na | 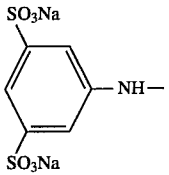 | $-NHC_2H_5$ | $-NHC_2H_5$ | 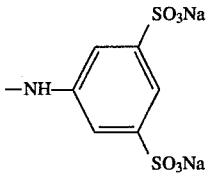 |
| E-23 | Na | 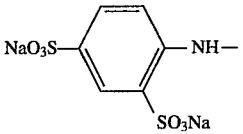 | $-NHCH_3$ | $-NHCH_3$ | 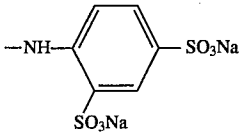 |
| E-24 | Na | 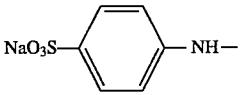 | 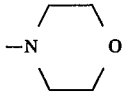 | 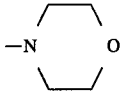 | 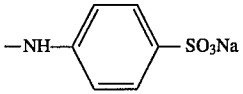 |
| E-25 | Na | $HOC_2H_4NH-$ | 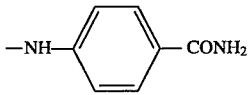 | 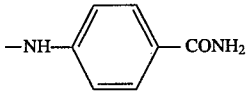 | $-NHC_2H_4OH$ |
| E-26 | Na | $HOC_2H_4NH-$ | 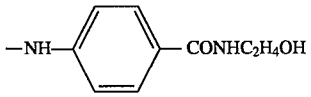 | 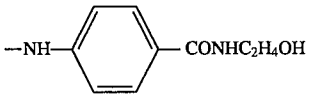 | $-NHC_2H_4OH$ |
| E-27 | Na | $(HOC_2H_4)_2N-$ | 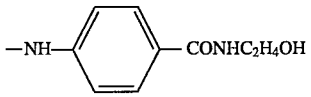 | 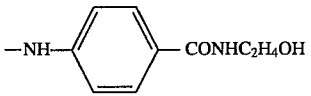 | $-N(C_2H_4OH)_2$ |
| E-28 | Na | $HOC_2H_4NH-$ | 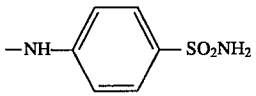 | 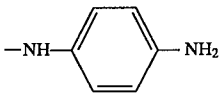 | $-NHC_2H_4OH$ |

-continued

| | M | $X_2$ | $Y_1$ | $X_3$ | $Y_2$ |
|---|---|---|---|---|---|
| E-29 | Na | $HOC_2H_4NH-$ | $-NH-C_6H_4-SO_2NHC_2H_4OH$ | $-NH-C_6H_4-SO_2NHC_2H_4OH$ | $-NHC_2H_4OH$ |
| E-30 | Na | $(HOC_2H_4)_2N-$ | $-NH-C_6H_4-SO_2NHC_2H_4OH$ | $-NH-C_6H_4-SO_2NHC_2H_4OH$ | $-N(C_2H_4OH)_2$ |
| E-31 | Na | $C_6H_4-N(C_2H_4OH)-$ | $-NH-C_6H_4-$ | $-NH-C_6H_4-$ | $-N(C_2H_4OH)-C_6H_4-$ |
| E-33 | Na | $HOCH_2-C_6H_2(SO_3Na)(SO_3Na)-NH-$ | $-C_6H_4-OH$ | $-C_6H_4-OH$ | $-NH-C_6H_2(SO_3Na)(CH_2OH)(SO_3Na)$ |
| E-33 | Na | $HOCH_2-C_6H_2(SO_3Na)(SO_3Na)-NH-$ | $-NHC_2H_5$ | $-NHC_2H_5$ | $-NH-C_6H_2(SO_3Na)(CH_2OH)(SO_3Na)$ |
| E-34 | Na | $CH_3O-$ | $-NHCH_2CH(OH)CH_3$ | $-NHCH_2CH(OH)CH_3$ | $-OCH_3$ |
| E-35 | Na | $C_6H_3(SO_3Na)(SO_3Na)-NH-$ | $-O-C_6H_4-$ | $-O-C_6H_4-$ | $-NH-C_6H_3(SO_3Na)(SO_3Na)$ |
| E-36 | Na | $NaO_3S-C_6H_4-O-$ | $-N(C_2H_4OH)_2$ | $-N(C_2H_4OH)_2$ | $-O-C_6H_4-SO_3Na$ |

-continued
| | M | $X_2$ | $Y_1$ | $X_3$ | $Y_2$ |
|---|---|---|---|---|---|
| E-37 | Na | 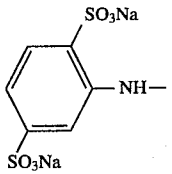 | $-N(C_2H_5)_2$ | $-N(C_2H_5)_2$ | 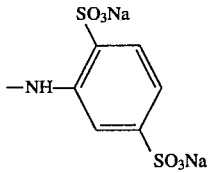 |
| E-38 | Na | 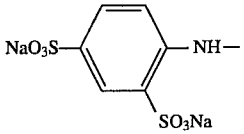 | $-NHCH_3$ | $-NHCH_3$ | 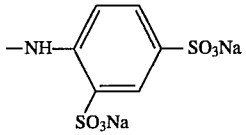 |
| E-39 | Na | $CH_3O-$ | $-NHCH(CH_2OH)CH_3$ | $-NHCH(CH_2OH)CH_3$ | $-OCH_3$ |
| E-40 | Na | $CH_3O-$ | $-N(C_2H_4OH)_2$ | $-N(C_2H_4OH)_2$ | $-OCH_3$ |
| E-41 | Na | $CH_3O-$ | $-NHC_2H_4SO_3Na$ | $-NHC_2H_4SO_3Na$ | $-OCH_3$ |
| E-42 | Na | $CH_3O-$ | $-NHC_2H_4OH$ | $-NHC_2H_4OH$ | $-OCH_3$ |
| E-43 | Na | $CH_3O-$ | 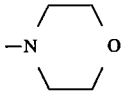 | 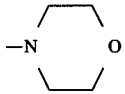 | $-OCH_3$ |
| E-44 | Na | $CH_3O-$ | $-NHC_2H_4SO_3K$ | $-NHC_2H_4SO_3K$ | |
| E-45 | Na | 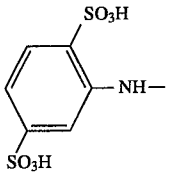 | $-N(C_2H_5)_2$ | $-N(C_2H_5)_2$ | 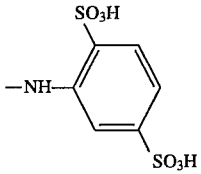 |

The above-given compounds can be synthesized in any known process. Among the above-given exemplified compounds, those preferably used for include, particularly, E-4, E-24, E-34, E-35, E-36, E-37 and E-41. It is preferable that a corresponding solid processing chemical is controlled so that these compounds may be added in an amount within the range of, preferably 0.2 g to 10 g per liter of a color developing solution to be used and, more preferably 0.4 g to 5 g.

Also, to the compositions of a color developer and a black-and-white developer each applicable to the invention, methyl cellosolve, methanol, acetone, dimethyl formamide, -β-cyclodextrin and the other compounds described in JP Examined Publication Nos. 47-33378/1972 and 44-9509/1969 can be applied, if required, as an organic solvent for improving the solubility of a developing agent to be used.

Further, an auxiliary developing agent may also be used together with a developing agent. These auxiliary developers include, for example, such a known developer as Metol, phenidone, N,N-diethyl-p-aminophenol hydrochloride and N,N,N',N'-tetramethyl-p-phenylenediamine hydrochloride.

Still further, a variety of additives such as an antistaining agent, an antisludging agent and an interlayer effect accelerating agent can also be used therein.

Besides the above, from the viewpoint of achieving the effects of the objects of the invention, it is preferable to add the following compound to a color developer and a black-and-white developer, namely, a chelating agent represented by the following Formula [K] described in JP Application No. 2-240400/1990, the 8th line from the bottom of p. 63 to the 3rd line from the bottom of p. 64, and the exemplified compounds thereof, K-1 through K-22.

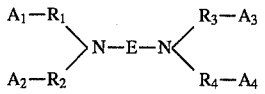

Formula [K]

Among these chelating agents, K-2, K-9, K-12, K-13, K-17 and K-19 may be particularly preferable and, inter alia, K-2 and K-9 can display the effects of the invention excellently.

The chelating agent is added to a solid processing chemical so that an amount added thereto can be within the range of, preferably 0.1 to 20 g per liter of a color developer and a black-and-white developer and, more preferably 0.2 to 8 g.

Further, each of surfactants of the anionic, cationic, amphoteric and nonionic types may also be contained in the above-mentioned color developer and black-and-white developer.

In addition to the above, if required, it is also allowed to add thereto a variety of surfactants such as alkylsulfonic acid, arylsulfonic acid, an aliphatic carboxylic acid and an aromatic carboxylic acid.

The main bleaching agents preferably applicable to a bleacher or a bleach-fixer each relating to the invention include, typically, a ferric complex of an organic acid, that is represented by the following Formula [C].

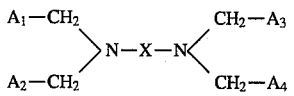

Formula [C]

wherein $A_1$ through $A_4$ represent each —$CH_2OH$, —COOM or —$PO_3M_1M_2$ in which M, $M_1$ and $M_2$ represent each a hydrogen atom, an alkali-metal or ammonium, provided that $A_1$ through $A_4$ may be the same with or the different from each other; and X represents a substituted or unsubstituted alkylene group having 3 to 6 carbon atoms.

Now, the compounds represented by Formula [C] will be detailed.

In the formula, the details of $A_1$ through $A_4$ will be omitted, because they are synonymous with those described in JP Application No. 1-260628/1989, the 15th line from the top of p. 12 to the 3rd line from the top of p. 15.

The ferric complexes of an organic acid, which are represented by Formula [C], are high in bleaching capability. Therefore, such an effect can be displayed that the amount thereof can be saved when solidifying a processing chemical, that a solid processing chemical can be made lighter in weight and smaller in size, and further that the preservability of a solid processing chemical can be improved, so that the ferric complexes thereof can preferably be used in the invention.

The preferable examples of the compounds represented by the above-given Formula [C] will typically be given below.

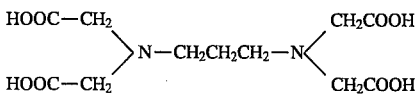

(C-1)

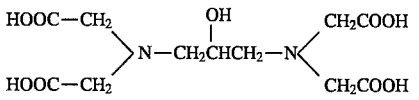

(C-2)

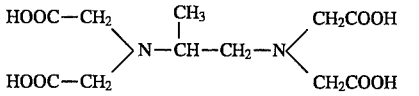

(C-3)

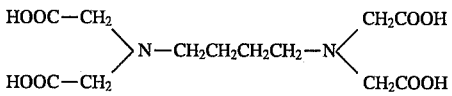

(C-4)

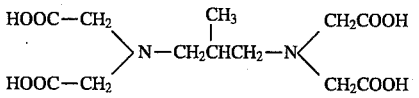

(C-5)

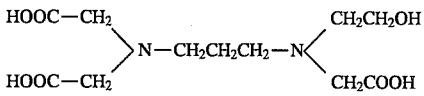

(C-6)

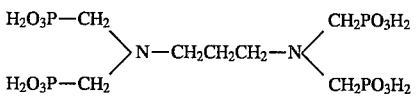

(C-7)

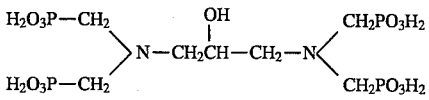

(C-8)

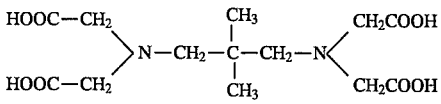

(C-9)

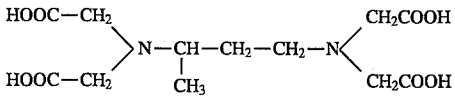

(C-10)

-continued

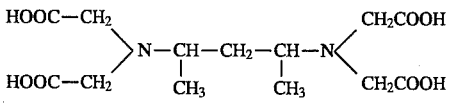

(C-11)

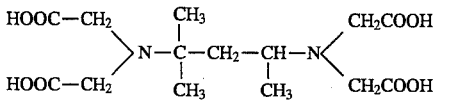

(C-12)

As for these ferric complexes of the compounds (C-1) through (C-12), anyone of those of a sodium salt, a potassium salt or an ammonium salt may be used. From the viewpoints of the effects of the objects of the invention and a solubility, those of an ammonium salt may preferably be used.

Among the above-given examples of the compounds, those preferably used in the invention include, particularly, (C-1), (C-3), (C-4), (C-5) and (C-9) and, inter alia, (C-1).

In the invention and to a bleaching agent or a bleach-fixing agent, the ferric complexes of the following compounds may also be used as a main bleaching agent, besides the iron complexes of the compounds represented by Formula [C].

[A'-1] ethylenediaminetetracetic acid,

[A'-2] trans-1,2-cyclohexanediaminetetracetic acid,

[A'-3] dihydroxyethylglycinic acid,

[A'-4] ethylenediaminetetrakismethylenephosphonic acid,

[A'-5] nitrilotrismethylenephosphonic acid,

[A'-6] diethylenetriaminepentakismethylenephosphonic acid

[A'-7] diethylenetriaminepentacetic acid,

[A'-8] ethylenediaminediorthohydroxyphenylacetic acid,

[A'-9] hydroxyethylethylenediaminetriacetic acid,

[A'-10] ethylenediaminedipropionic acid,

[A'-11] ethylenediaminediacetic acid,

[A'-12] hydroxyethyliminodiacetic acid,

[A'-13] nitrilotriacetic acid,

[A'-14] nitrilotripropoinic acid,

[A'-15] triethylenetetraminehexacetic acid,

[A'-16] ethylenediamine tetrapropionic acid, and

[A'-17] β-alaninediacetic acid.

The above-given ferric complexes of an organic acid may be added in an amount within the range of, preferably 0.01 to 2.0 molls per liter of a bleaching solution or a bleach-fixing solution and, more preferably 0.05 to 1.5 molls. It is accordingly preferable that a solid processing chemical can be controlled so that the concentration of the ferric complexes of an organic acid can be kept within the above-given range when they are contained in a bleaching solution or a bleach-fixing solution reserved in a processing tank.

When a bleacher, a bleach-fixer and a fixer contain imidazole and the derivatives thereof described in JP OPI Publication No. 64-295258/1989 or at least one of the compounds represented by Formulas [I] through [IX] described in the same patent application and the exemplified compounds thereof, the effect of a rapid processing property can be displayed.

Besides the above-mentioned accelerators, it is also allowed to use similarly the exemplified compounds given in JP OPI Publication No. 62-123459/1987, pp. 51–115, the exemplified compounds given in JP OPI Publication No. 63-17445/1988, pp. 22–25 and the compounds given in JP OPI Publication Nos. 53-95630/1978 and 53-28426/1978.

A bleacher or a bleach-fixer may also contain, besides the above, a halide such as ammonium bromide, potassium bromide and sodium bromide, a variety of fluorescent whitening agent, a defoamer or a surfactant.

In the invention, a thiocyanate and a thiosulfate may preferably be used as a main fixing agent applicable to a fixer or a bleach-fixer. A thiocyanate may be contained therein in an amount of at least not less than 0.1 molls per liter of a fixing solution or a bleach-fixing solution used. When processing a color negative film, it may be contained in an amount of more preferably not less than 0.5 molls/liter and particularly not less than 1.0 moll/liter. A thiosulfate may be contained therein in an amount of, preferably at least not less than 0.2 molls/liter. When processing a color negative film, it may be contained in an amount of more preferably not less than 0.5 molls/liter. In the invention, the objects of the invention can more effectively be achieved by making combination use of a thiocyanate and a thiosulfate.

A fixer or a bleach-fixer applicable to the invention may also contain, besides the above-mentioned main fixing agents, a pH buffer comprising a variety of salts, independently or in combination. It is also preferable to contain therein a large amount of an alkali halide or an ammonium halide including, for example, a rehalogenating agent such as potassium bromide, sodium bromide, sodium chloride and ammonium bromide. It is further allowed to suitably add such a compound as is known that it may be ordinarily added to a fixer or a bleach-fixer such as an alkylamine and a polyethylene oxide.

It is preferable to add a compound represented by the following Formula [FA] given in JP OPI Publication No. 64-295258/1989, p. 56 and the exemplified compounds thereof to a fixer or a bleach-fixer. When doing so, not only the effects of the invention can more effectively be displayed, but also another effect can be so displayed as to remarkably reduce a sludge that may be produced in a processing solution having a fixing function in the course of processing a small quantity of light-sensitive materials extending over a long period of time.

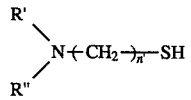

Formula [FA]

The compounds represented by Formula [FA] given in the above-mentioned patent publication can be synthesized in such an ordinary process as described in U.S. Pat. Nos. 3,335,161 and 3,260,718. These compounds represented by Formula [FA] may be used independently or in combination.

These compounds represented by Formula [FA] may be added in an amount within the range of 0.1 g to 200 g per liter of a fixing solution or a bleach-fixing solution used, so that an excellent results can be enjoyed.

In the invention, it is preferable that a stabilizing solution contains a chelating agent having a chelating stability constant of not less than 8 to ferric ion. The term, "a chelating stability constant", herein means a constant having generally been known in L. G. Sillen & A. E. Martell, "Stability Constants of Metal-ion Complexes", The Chemical Society, London, (1964); S. Chaberek & A. E. Martell, "Organic Sequestering Agents", Wiley, (1959); and so forth.

The chelating agents having a chelating stability constant of not less than 8 to ferric ion include, for example, those given in JP Application Nos. 2-234776/1990 and 1-324507/1989.

The above-mentioned chelating agents may be used in an amount within the range of, preferably, 0.01 to 50 g per liter of a stabilizing solution used and, more preferably 0.05 to 20 g per liter thereof, so that an excellent result can be enjoyed.

The compounds to be preferably added to a stabilizing solution include, for example, an ammonium compound. These compounds may be supplied from an ammonium salt of various inorganic compounds. Such an ammonium compounds as mentioned above may be added in an amount within the range of, preferably 0.001 molls to 1.0 moll per liter of a stabilizing solution used and, more preferably 0.002 to 2.0 molls.

It is further preferable to contain a sulfite in a stabilizer.

Further, a stabilizing solution is preferable to contain a metal salt in combination with the above-mentioned chelating agent. Such a metal salt as mentioned above include, for example, those of Ba, Ca, Ce, Co, In, La, Mn, Ni, Bi, Pb, Sn, Zn, Ti, Zr, Mg, Al or Sr and they may be supplied in the form of an inorganic salt such as a halide, a hydroxide, a sulfite, a carbonate, a phosphate and acetate or in the form of a water-soluble chelating agent. They may be used in an amount within the range of, preferably $1\times10^{-4}$ to $1\times10^{-1}$ molls per liter of a stabilizing solution used and, more preferably $4\times10^{-4}$ to $2\times10^{-2}$ molls per liter thereof., An example of the automatic processors applicable to the invention will be detailed with reference to the drawings. FIG. 1 is a schematic illustration of a printer processor constructed with an automatic processor A and a photographic printer B built into one body.

In FIG. 1, a magazine storing therein a rolled printing paper that is an unexposed silver halide photographic light-sensitive material is set to the lower left portion of a photographic printer B. A sheet of printing paper pulled out of the magazine is cut into a specific size through a conveying roller R and a cutting member C, so that it becomes into a sheet-like printing paper. The sheet-like printing paper is transported by a belt-conveying means $B_1$ to an exposing section E, so that an image of an original picture o is exposed to light. The sheet-like printing paper exposed to light is further transported by plural pairs of conveying rollers R and is then introduced into automatic processor A. In the automatic processor A, the sheet-like printing paper is transported by a roller transporting means (without having any reference numeral) to a color developing tank 1A, a bleach-fixing tank 1B, and stabilizing tanks 1C, 1D and 1E (which are constructed substantially of three tank-structure) in this order and the sheet-like printing paper is subjected to a color developing process, a bleach-fixing process and a stabilizing process, respectively. The processed sheet-like printing paper is dried up at a drying section 35 at 35° C. and is then delivered out to the machine.

In the figure, a dash and dotted line indicates a passage of transporting a silver halide photographic light-sensitive material. In the embodiment shown in this figure, a light-sensitive material is introduced into an automatic processor A in the state where it is cut apart. However, it may also be introduced into the automatic processor A in a belt-like state. In this case, when an accumulator for temporarily staying a light-sensitive material between automatic processor A and photographic printer B, a processing efficiency can be improved. It is also the matter of course that an automatic processor may be built with a photographic printer into one body or that only a single automatic processor may be used independently. It is needless to say that a silver halide photographic light-sensitive material to be processed through an automatic processor relating to the invention shall not limited to a printing paper exposed to light, but a negative film exposed to light and so forth may also be processed therethrough. The descriptions of the invention will be made herein about an automatic processor substantially having a three-tank structure comprising a color developing tank, a bleach-fixing tank and a stabilizing tank. However, the invention shall not be limited thereto, but even an automatic processor substantially having a four-tank structure comprising a color developing tank, a bleaching tank, a fixing tank and a stabilizing tank can of course be used in the invention.

Figure 2:
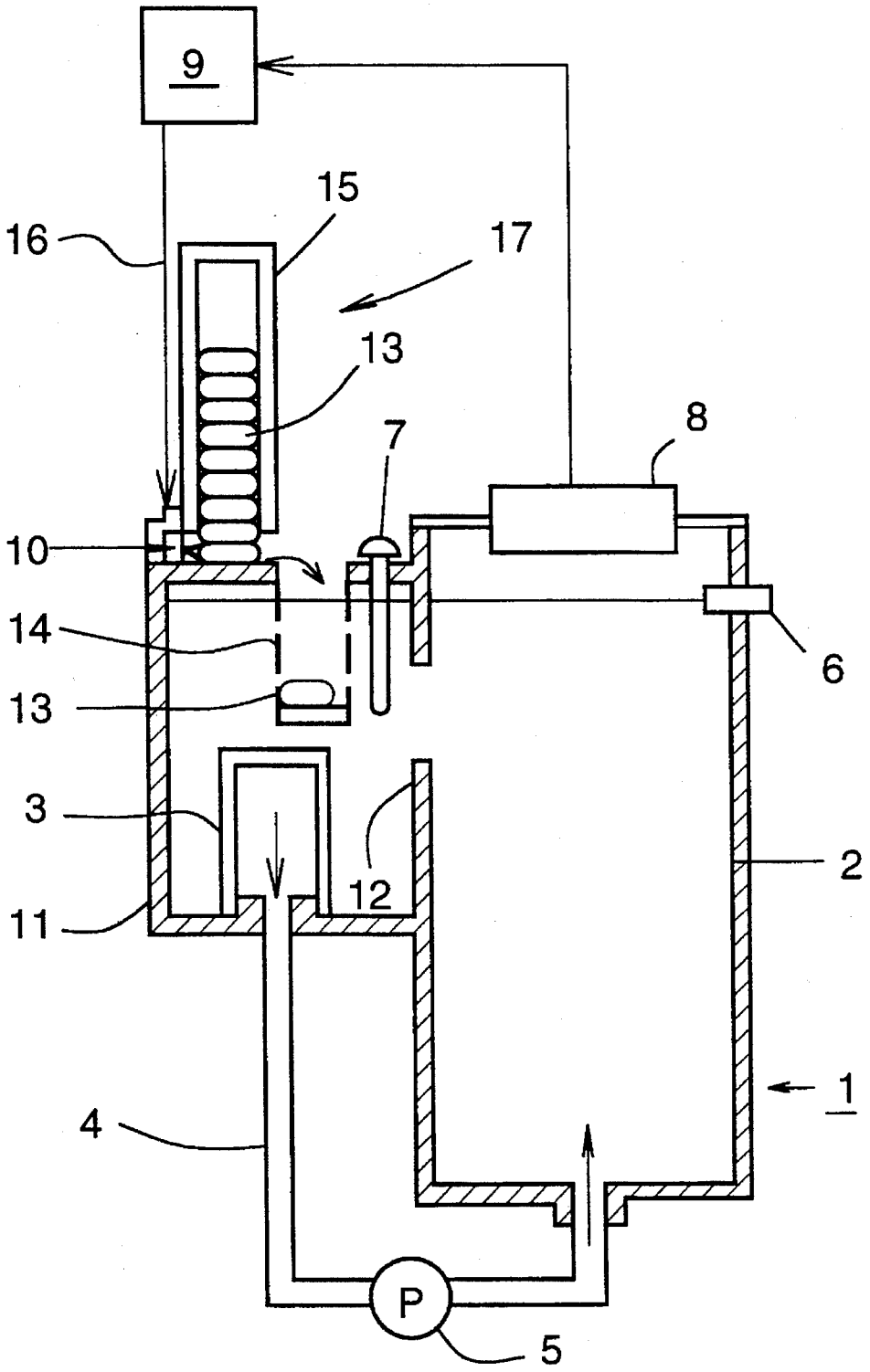
FIG. 2 is a cross-sectional view of the processing chemical putting section and processing chemical supply means each of an automatic processor.

FIG. 2 attached hereto is a schematic illustration of a color developing tank A that is served as one of thee processing tanks shown in the cross-section I—I of the automatic processor A shown in FIG. 1. In bleach-fixing tank 1B and stabilizing tanks 1C, 1D and 1E are each structured as same as in color developing tank 1A. Therefore, whenever making any descriptions of a processing tank 1, the descriptions of anyone of color developing tank 1A, bleach-fixing tank 1B and stabilizing tanks 1C, 1D and 1E are also included therein. For simplifying the descriptions in the figure, a means for transporting a light-sensitive material and so forth are omitted therefrom. And in this example, the descriptions will be made about the case of making use of tablet 13 for a solid processing chemical.

Processing tank 1 is comprised of processing section 2 for processing a light-sensitive material and solid processing chemical putting section 11 for supplying tablet 13, that is built into one body with the outside of the partition wall forming the processing section. These processing section 2 and the solid processing chemical putting section 11 are separated by a partition wall 12 provided with a communicating window thereto so that a processing solution can be circulated therebetween. And, the chemical putting section 11 is provided with a partition 14 for receiving a processing chemical and, therefore, the solid processing chemical cannot be moved to the processing section 2.

A cylindrical-shaped filter 3 is interchangeably provided below the solid processing chemical putting section 11 so as to perform a function of removing an insoluble matter such as a paper dust from a processing solution. Filter 3 communicates inside to the suction side of a circulation pump 5 (or a circulating means) through circulation pipe 4 so provided as to be pass through the lower wall of the solid processing chemical putting section 11.

The circulation system is therefore comprised of a circulation pipe 4, circulation pump 5 and processing tank 1 each forming the circulation passage of a solution. The other end of circulation pipe 4 communicated to the discharging outlet side of the circulation pump 5 is passed through the lower wall of processing section 2 so as to be communicated to the processing section 2. By such a structure as described above, a processing solution is sucked up from solid processing chemical putting section 11 when starting the operation of circulation pump 5. The sucked solution is then discharged to processing section 2 and then mixed up with a processing solution reserved in processing section 2, so that the mixture thereof can be circulated again into solid processing chemical putting section 11 and the circulation thereof can be repeated. The flow rate of the above-mentioned circulation flow is preferably not lower than 0.1 to a tank capacity per minutes (or a rotation=a circulated amount/a tank capacity) and, more preferably, a rotation within the range of 0.5 to 2.0. The circulation direction of a processing solution shall not be limited to the direction shown in FIG. 2, but may also be the opposite direction.

Waste drain pipe 6 is to overflow a processing solution from processing section 2 and it can serve to prevent the staying and increase of a component brought into processing section 2 while they are adhering to a light-sensitive material, and a component leaching out of a light-sensitive material, as well as to keep a liquid level constant.

Bar-shaped heater 7 is so arranged as to pass through the upper wall of solid processing chemical putting section 11 and to be dipped in a processing solution reserved in solid processing chemical putting section 11. This heater 7 is to heat a solution reserved in processing tank 1 and, in other words, it is a thermostat means for keeping a processing solution reserved in processing tank 1 at a temperature within the range of temperatures (such as 20° to 25° C.) suitable for a processing treatment.

Processing quantity information detection means 8 is provided to the entrance of an automatic processor and is used for detecting a processing quantity of light-sensitive materials subject to the processing treatments. This means 8 is comprised of plural detection members each arranged to the right and left directions. It functions to detect the widths of light-sensitive materials and, at the same time, it functions as a factor for counting out a detecting time. The speed of transporting a light-sensitive material is set mechanically in advance. Therefore, the processing areas of light-sensitive materials can be calculated out of both width and time information. The above-mentioned processing quantity information detection means may be any types of them, provided that a width of a light-sensitive material and a time for transporting a light-sensitive material can be detected by making use of, for example, an infrared sensor, a microswitch or a supersonic sensor. Further, the means may be those capable of indirectly detecting the processing areas of a light-sensitive material. For example, in the case of such a printer-processor as shown in FIG. 1, it is also allowed to use those capable of detecting a quantity of printed light-sensitive materials or a processing quantity of light-sensitive materials each having an area specified in advance. In addition, the point of time when making such a detection as mentioned above may be any point of time before carrying out a process, after carrying out a process and while dipping a light-sensitive material in a processing solution, (provided that, in such a case as mentioned above, a detection can be performed by suitably changing the position of processing quantity information detection means 8 to a position where a detection can be performed after completing a processing treatment, or to a position where a detection can be performed in the course of carrying out a processing treatment). In the above-descriptions, the processing areas of light-sensitive materials are detailed as an information to be detected. However, the information to be detected shall not be limited to the above, but the information may be, for example, an information on a value in proportion to the processing quantity of a light-sensitive material that is processed, to be processed or being processed, or may be an information on the concentration or variations of the concentration of a processing solution reserved in a processing tank. In addition, processing quantity information detection means 8 is not needed to be provided to everyone of processing tanks 1A, 1B, 1C, 1D and 1E, but it is preferable to provide the single means thereof to an automatic processor.

Processing chemical supplying means 17 is for adding a solid processing chemical stored in a cartridge 15 that is a storing means to a processing tank. The means 17 is arranged to the upper part of filtrating section 14 (a partition) and is attached thereto with an extruding member 10 having a structure for extruding a cartridge 15 sealing therein a tablet 13 that is a solid processing chemical and one or plural tablets 13. The above-mentioned processing chemical supplying means 17 is controlled by processing chemical supply control means 9 of which will be detailed later and standby tablet 13 is extruded by the extruding member 10 with linking to a supply signal sent from processing chemical supply control means 9, so that the extruded tablet 13 can be supplied to filtrating section 14 (a partition) provided to the inside of a solid processing chemical putting section 11. In this invention applied for a patent, solid processing chemical 13 is supplied to filtrating section 14 (a partition) provided to the inside of solid processing chemical putting (or receiving) section 11. However, the solid processing chemical supplying positions may be anywhere, provided that the position is inside the processing tank 1. In other words, in the invention applied for a patent, the requirements of the invention can be satisfied whenever a solid processing chemical can be dissolved by making use of a processing solution and it is required that a component corresponding to the processing quantity information on a light-sensitive material can be added and that the processing characteristics of a processing solution reserved in a processing tank 1 can be kept constant. It is more preferable to supply a solid processing chemical into a circulation passage of a processing solution. Processing chemical supplying means 17 is also preferable to keep any moisture inside a processing tank of an automatic processor or in the open air and a scattered processing solution untouched to a solid processing chemical not yet supplied to a processing tank.

Filtrating means 14 (a partition) is dipped in a processing solution reserved in a solid processing chemical putting section 11 so as to remove an insoluble component produced by tablet 13 supplied by a processing chemical supplying means 17, such as not only an insoluble component mixed in tablet 13 or a block of tablet 13 produced by decaying tablet 13, but also a matter induced from a solid processing chemical, that may damage a final image when it adhered to a light-sensitive material or a matter adhered to a portion by which a trouble such as an insufficient processing treatment may be caused. The filtrating section 14 (a partition) is processed with a resin. However, it may not essentially be required to provide the filtrating section 14 to the inside of solid processing chemical putting section 11, but it may be provided in such a manner that a tablet 13 supplied by a processing chemical supplying means 17 is put into a transport passage of a light-sensitive material as shown in FIG. 1, or into a processing solution reserved in a processing section 2.

Processing chemical supply control means 9 is to control processing chemical supplying means 17. When reaching a specified value of the processing quantity information (or the processing areas, in this example) on light-sensitive materials detected by processing quantity information detecting means 8, the processing chemical supply control means 9 will send a processing chemical supply signal to processing chemical supplying means 17. The processing chemical supply control means 9 may control processing chemical supplying means 17 in such a manner that a necessary amount of a processing chemical can be supplied to solid processing chemical putting section 11 so as to meet a processing quantity information.

Next, the operations of the invention applied for a patent will now be detailed based on FIG. 2. The processing quantity information on light-sensitive materials exposed to light is detected at the entrance of an automatic processor A by a processing quantity information detecting means 8. Processing chemical supply control means 9 will send a supply signal to processing chemical supplying means 17 so as to meet a processing quantity information detected by processing quantity information detecting means 8, when an accumulated areas of light-sensitive materials subject to the processing treatments reaches a specified area. Processing chemical supplying means 17 received the supply signal will extrude tablet 13 by making use of extruding member 10 and will then supply the extruded tablet 13 to filtrating section 14 (a partition) provided to the inside of solid processing chemical putting section 11. The supplied tablet 13 is then dissolved by a processing solution inside the solid processing chemical putting section 11. In the course of the dissolution thereof, the dissolution is accelerated by the processing solution circulated by a circulation means around in the following order; solid processing chemical putting section 11→ circulation pump 5→processing section→communicated section→solid processing chemical putting section 11, and so forth. On the other hand, a light-sensitive material so detected as above in transported by a roller transport means in the order from color developing tank 1A, bleach-fixing tank 1B and stabilizing tanks 1C, 1D and 1E, (See automatic processor shown in FIG. 1). The processing tanks, namely, color developing tank 1A, bleach-fixing tank 1B and stabilizing tanks 1C, 1D and 1E, have each processing chemical supply means 17 that may supply the processing chemicals at the same time, respectively. It is also allowed to supply every processing chemical at the different points of time by the respective supply means. It is further allowed that the specific areas for a processing chemical supply means to be controlled by processing chemical supply control means 9 may be the same areas for processing tanks 1A, 1B, 1C, 1D and 1E. It is, however, needless to say that the areas may be the same with or the different from each other.

Not only in this example, but also in the following example, bleach-fixing tank 1B and stabilizing tanks 1C, 1D and 1E have each the same structure as in color developing tank 1A. Therefore, whenever describing processing tank 1, the processing tank 1 means color developing tank 1A, bleach-fixing tank 1B and stabilizing tanks 1C, 1D and 1E, respectively. The like parts having the like functions throughout the figures attached hereto are designated by the same reference numerals as in FIG. 2. Therefore, the descriptions thereof will be omitted Hereford. Further for simplifying the structures, a means for transporting a light-sensitive material and so forth will also be omitted herefrom. In this example, a filtrating means is given as a preferable example. However, in the invention, the effects of the invention can still be satisfactorily displayed, even if no filtrating means should be provided thereto.

As described above, according to the invention, a replenishing tank that has so far been required is no longer required and no space for it is not required. Therefore, an automatic processor can be made compact in size and no liquid preparation work is also required, because a solid processing chemical is supplied to a processing tank. Also, no solution can be scattered about or made adhered to and infected human skin and clothes with any scattered solution. Further, any surrounding equipment cannot be stained and a handing can be simplified. In addition, the following excellent effects can be displayed. An accurate replenishment can be made to every processing solution without any deterioration of processing components when replenishing them, and the stable processing characteristics can be displayed.

Figure 3:
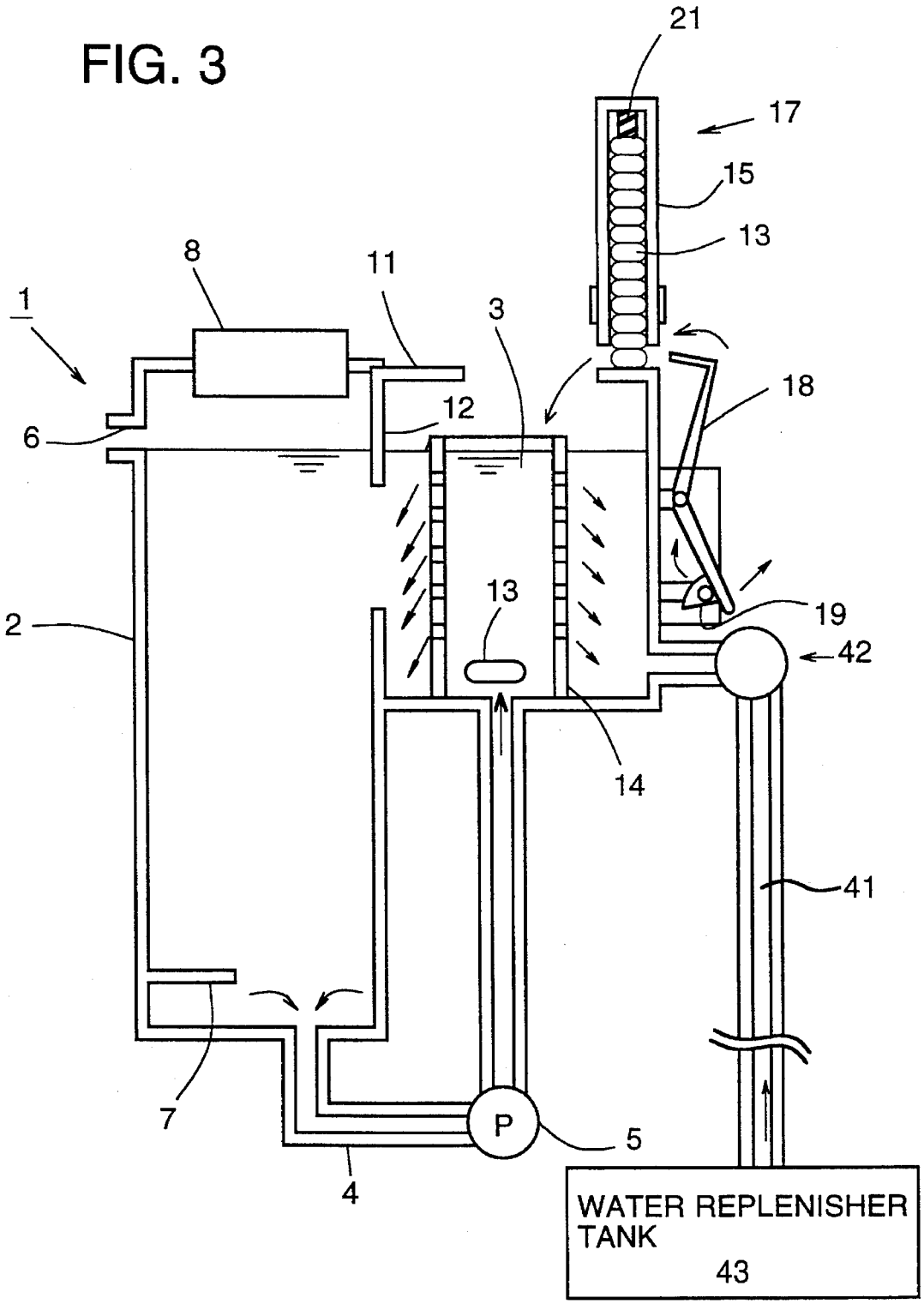
FIG. 3 is a cross-sectional view of the processing chemical putting section to which a replenishing water supply means is additionally attached and a processing chemical supply means, each of an automatic processor.
Figure 4:
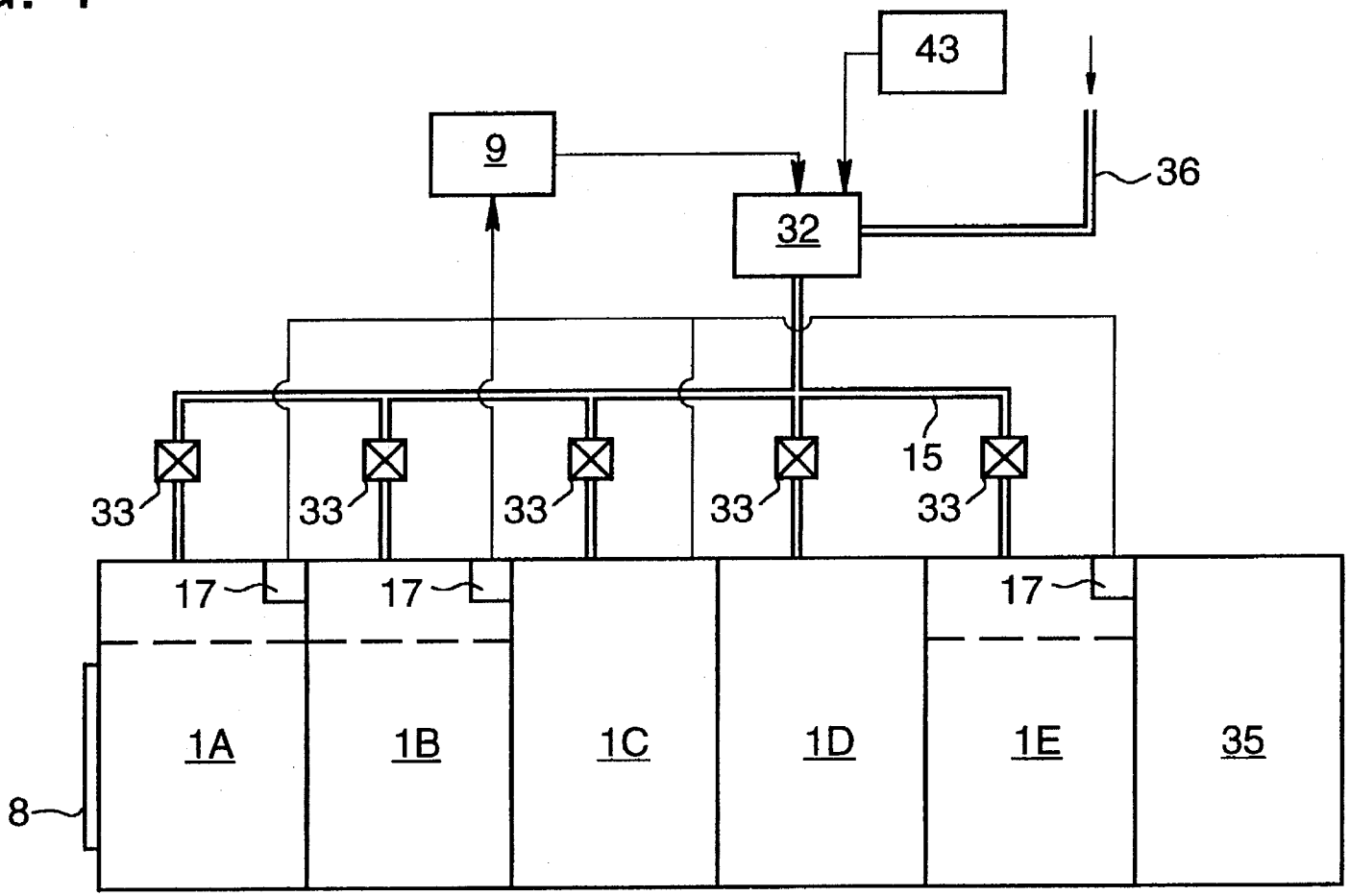
FIG. 4 is a plan view of the automatic processor shown in FIG. 3.
Figure 5:
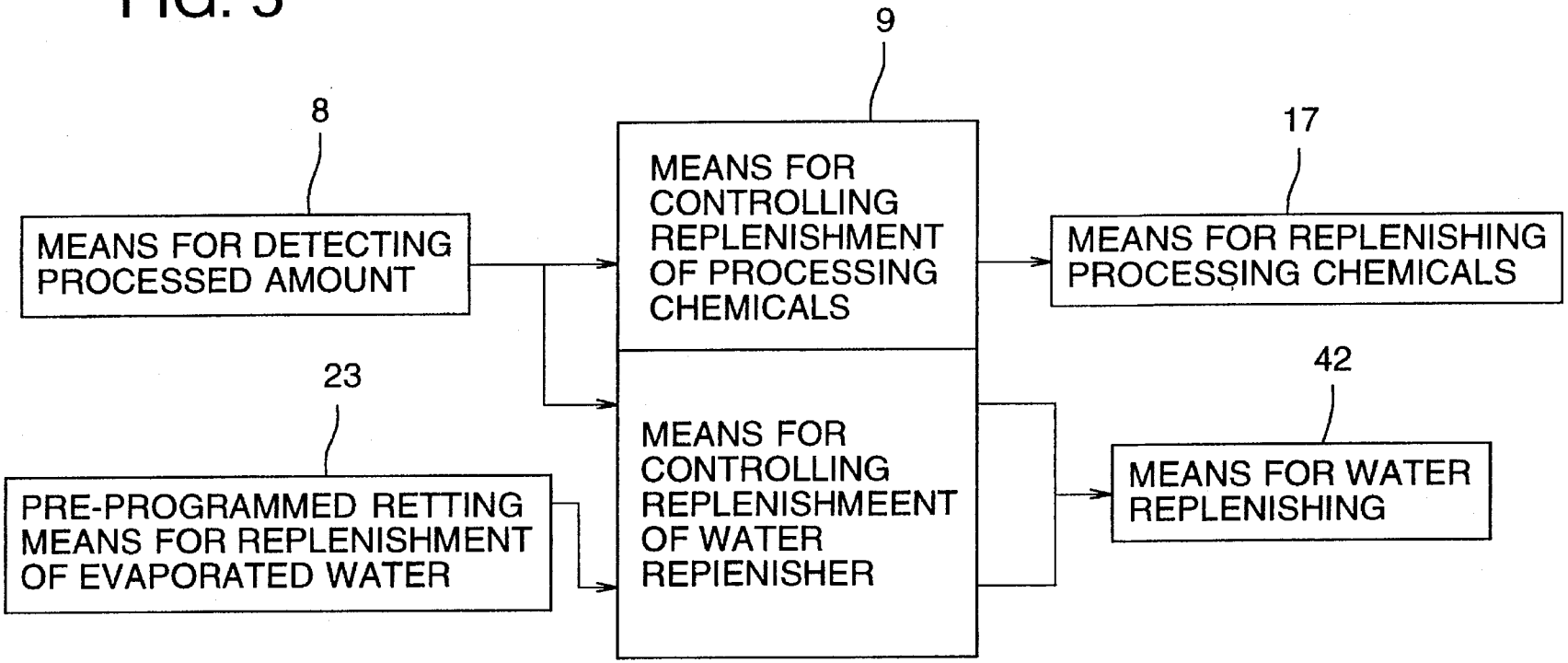
FIG. 5 is a block diagram in which an automatic processor control means is included.
Figure 6:
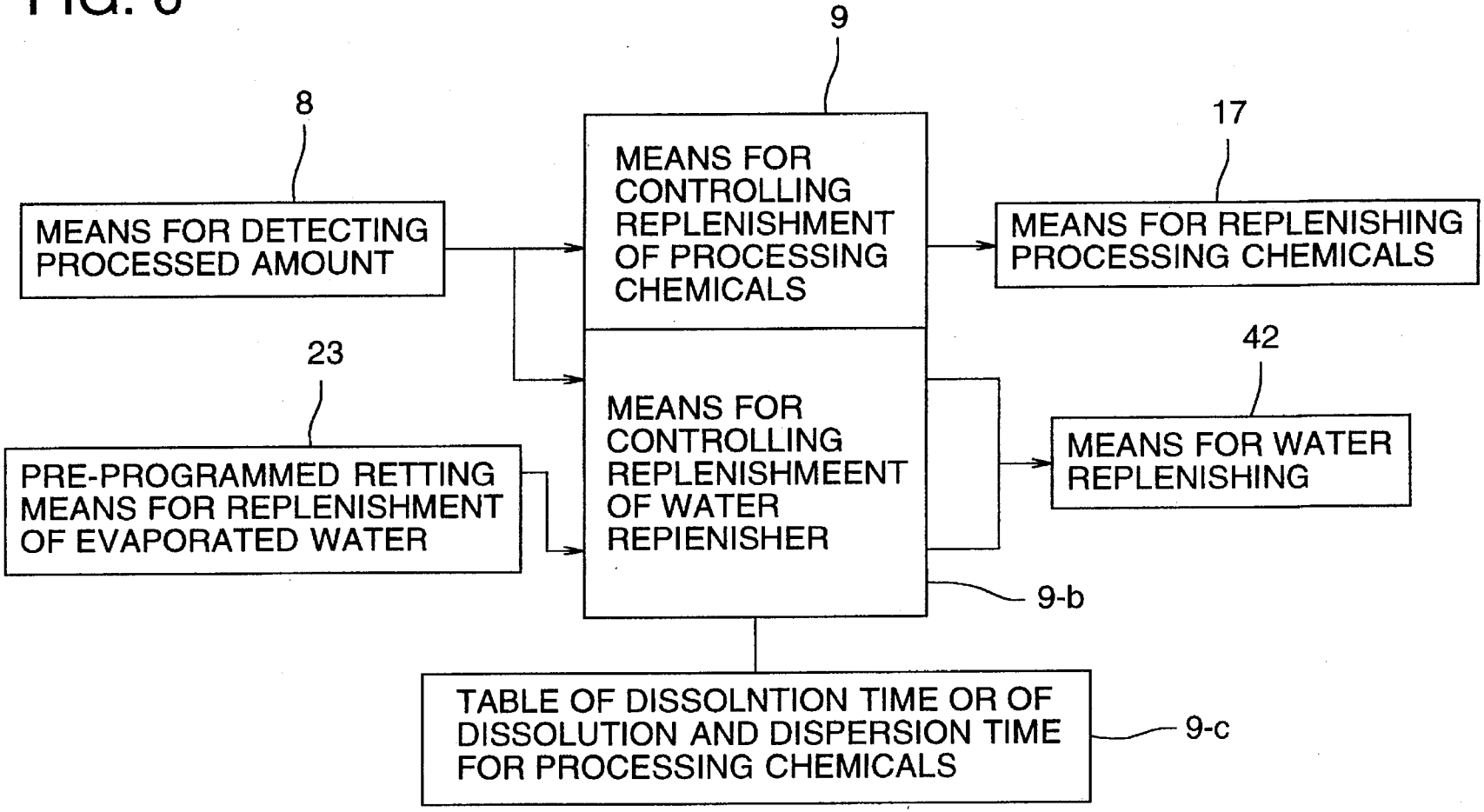
FIG. 6 is a block diagram to which the dissolving table of a control means is added.

Next, the other examples of the invention will be detailed. FIG. 3 is a schematic cross-sectional illustration of color developing tank 1A of automatic processor shown in FIG. 1, taken along the line I—I, wherein a processing chemical putting section to which a replenishing water supply means is additionally attached and a processing chemical supply means are shown. FIG. 4 is a schematic plan view of automatic processor A of FIG. 1 shown from the upper side, (provided that the passage of a water replenishing means is illustrated to suit the descriptive convenience.) FIG. 5 is a block diagram concerning the controls relating to this example. FIG. 6 is a block diagram of a control means to which a means 23 programmed in advance for determining a water evaporated-loss replenishment is additionally attached. In each of FIGS. 3 and 4, water replenishing tank 43 for reserving replenishing water therein is shown. In this example, the case of making use of a tablet serving as solid processing chemical 13 will be detailed.

Regarding FIGS. 3 and 4, the portions different from the portions shown in FIG. 2 will be detailed.

Replenishing water supply means 42 is a means for supplying replenishing water from water replenishing tank 43 for reserving replenishing water to processing chemical putting section 11, wherein warm-water replenishing unit 32 comprising a pump, a thermostat and so forth, electromagnetic valve 33 and water replenishing pipe 36. The above-mentioned replenishing water supply means 42 is for thining an accumulated inhibition component eluted out by making a reaction while replenishing water for both of a water content brought out of a photographic material and a water evaporated from the surface of the tank. The water replenishing tanks and water replenishing pumps may be provided to everyone of processing tanks 1A, 1B, 1C, 1D and 1E. However, when supplying the same replenishing water to every tank so as to make use of a single water replenishing tank, an automatic processor can be made compact in size. It is preferable when one each of water replenishing tank and water replenishing pump are provided to an automatic processor so that a necessary amount of replenishing water can be replenished to each of the processing tanks by arranging an electromagnetic valve to a passage (or a pipe) for replenishing water; or when the aperture size of a water replenishing pipe is so adjusted as to control an amount of water replenished. Thereby only one each of water replenishing tank 43 and water replenishing pump can be provided to an automatic processor, so that the automatic processor can be made more compact in size. Concerning stabilizing tanks 1C and 1D each of which is a processing tank, a water replenishing means may be omitted by supplying the stabilizing solution overflowed from stabilizing tanks 1D and 1E, respectively. It is also preferable to thermostatically control replenishing water reserved in a replenishing water tank.

Water replenishment can be carried out in any known method by any water including not only ordinary water such as well water and city water, but also any water containing, for example, an antimold such as an isothiazoline and a chlorine-releasing compound and some sulfite type chelating agents, provided that the contents of water do not affect any photographic characteristics.

The above-mentioned replenishing water control means is a means for controlling a replenishing water supply means 42 by making use of a means 23 programmed in advance according to a surrounding temperature-humidity (a relative humidity) at the place installed for determining a water evaporated-loss replenishment and/or for controlling a replenishing water supply means 42 so as to correspond to a processing amount information detected by processing amount information detection means 8. The replenishing water supply control means is not limited to correspond to a processing amount information detected by a processing amount information detection means 8, but the replenishing water supply control means may also control the replenishing water supply means 42 in correspondence to an information that a processing chemical is supplied by processing chemical supply means 17.

In FIGS. 3 and 2, the other portions different from the above have the same functions as those portions shown in FIG. 2 and the portions at issue will be detailed below.

Heater 7 is arranged to the bottom of processing section 2 so as to heat a processing solution reserved in processing section 2. In other words, it performs a temperature control function for keeping processing section 2 and a processing solution reserved in solid processing chemical putting section 11 within the suitable temperature range (for example, 20° to 55° C.).

As for a circulation means, circulation pipe 4 and circulation pump 5 are provided as same as in FIG. 2, except that the circulation direction of a processing solution is reversed. To be more concrete, the processing solution is circulated as follows. Processing section 2→circulation pump 5→solid processing chemical putting section 11→a communication window→the processing section 11.

Processing chemical supply means 17 is to supply tablet 13 that is a solid processing chemical sealed in cartridge 15 to filtration section (a partition) inside solid processing chemical putting section 11 by making use of pushing claw 18. The different portion is that cam 19 is operated by a single-rotation shaft-stopping mechanism so as to operate pushing claw 18 and thereby a standing-by tablet 13 is supplied to processing tank 1. Then, the next tablet 13 becomes rapidly in a standing-by state, because it is energized from above to below by a tablet pushing spring 21. In this instance, processing chemical supply means 17 may be of the horizontal system or of the vertical system in which a tablet is pushed from the bottom upward. In short, any means may be used, provided that it can put a solid processing chemical into processing tank 1.

Now, based on FIGS. 1, 3, 4 and 5, the operations of the invention applied for a patent will be detailed.

When a light-sensitive material exposed to light enters into the entrance of automatic processor A, a processing quantity information is detected by processing quantity information detection means 8. When an accumulated area of light-sensitive material to be processed reaches a specified area, processing chemical supply control means 9 sends a supply signal to processing chemical supply means 17 so as to correspond to the processing quantity information detected by processing quantity information detection means 8. Processing chemical supply means 17 received the supply signal pushes tablet 13 by making use of pushing member 10, so that the tablet 13 is supplied to filtration section 14 inside the solid processing chemical putting section 11. The supplied tablet 13 is the dissolved by a processing solution inside solid processing chemical putting section 11. The dissolution thereof can be accelerated by the processing solution circulated by a circulation means in the following order; processing section 2→circulation pump 5→solid processing chemical putting section 11→a communication window→the processing section 11. On the other hand, when an accumulated area of light-sensitive materials to be processed reaches a specific area, replenishing water supply control means sends a water replenishing signal to replenishing water supply means 42 (comprising warm-water replenishing unit 32 and an electromagnetic valve 33) so as to correspond to a processing quantity information detected by processing quantity information detection means 8. Replenishing water supply means 42 having received the water replenishing signal controls warm-water replenishing unit 32 and electromagnetic valve 33 so that a specific amount or necessary amount of replenishing water reserved in water replenishing tank 43 can be replenished to each or required processing tank. The specific area in this instance is the same as in processing chemical supply control means 9. However, the specific area shall not be limited to the above-mentioned area, but may also be different from the above. On the other hand, a light-sensitive material detected thereby is transported by a roller transport means though color developing tank 1A, bleach-fixing tank 1B and stabilizing tanks 1C, 1D and 1E in this order.

Now, a solid processing chemical supply unit of the invention will be detailed.

Figure 7:
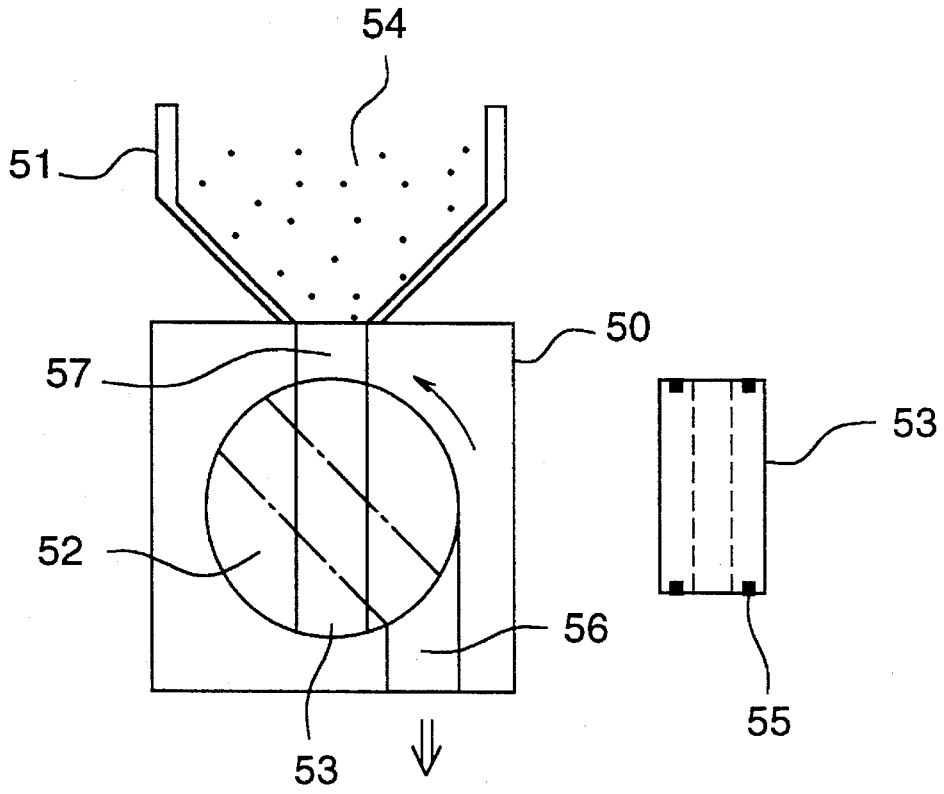
FIG. 7(*a*) is a cross-sectional view of a powder-shaped processing chemical supply unit and FIG. 7(*b*) a perspective view of a package.
Figure 7:
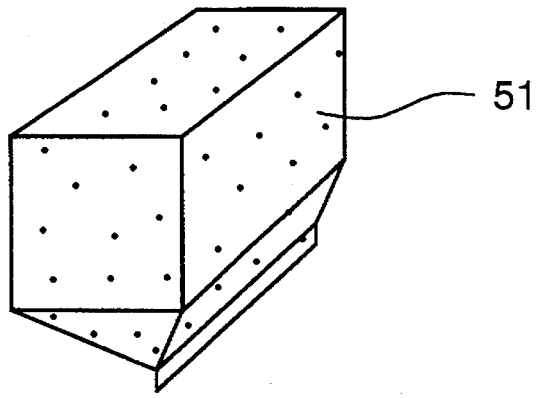

FIG. 7(A) shows a cross-sectional view of a powder-shaped processing chemical supply unit. FIG. 7(B) is a perspective view of a package. Supply unit 50 is comprised of a hopper or package 51 for containing a powder-shaped processing chemical therein, measuring hole 53 for measuring a powder-shaped processing chemical and rotary drum 52 for putting a specific amount of the processing chemical. The rotary drum 52 is provided with a moisture resisting function by shifting the position of measuring hole 53 from that of discharging section 56. A specific amount of powdered chemical loaded on the upper part of seal-opening and supply unit of package 51 is measured in measuring hole 53. When drum 52 is rotated by a demand issued by a processing quantity detection means of a light-sensitive material and then the measuring hole 53 and discharging section 56 are put in a state of communicating each other, drum 52 is stopped in action. Then, the specific amount of powdered chemical is passed through discharging section 56 and is supplied to the thermostat section (or a filtering tank). After completing the supply, drum 52 is rotated and when measuring hole 53 and supply section 57 are communicated to each other, drum 52 is stopped in action, so that a measurement of powdered chemical is started.

Figure 8:
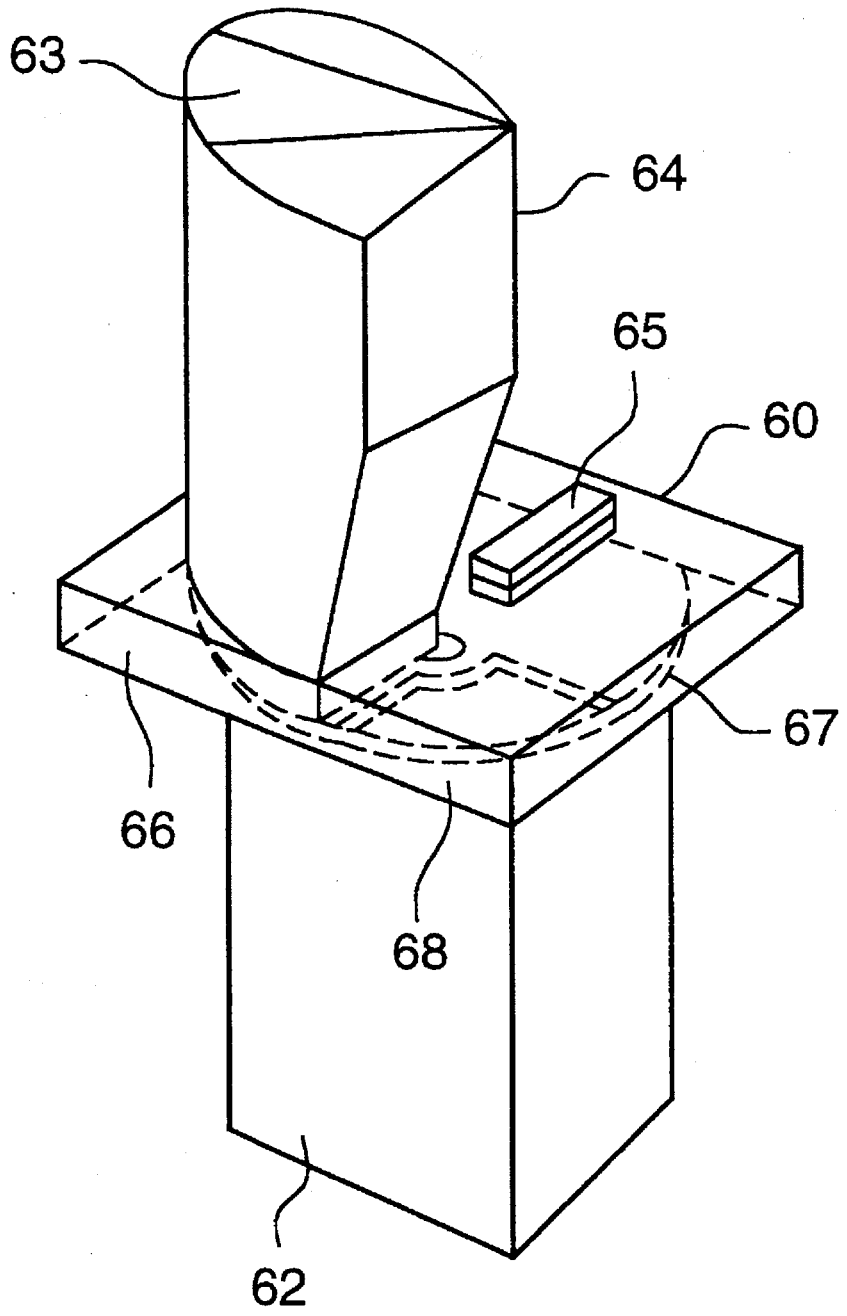
FIG. 8 is a perspective view of a powder-shaped processing chemical supply means.
Figure 9:
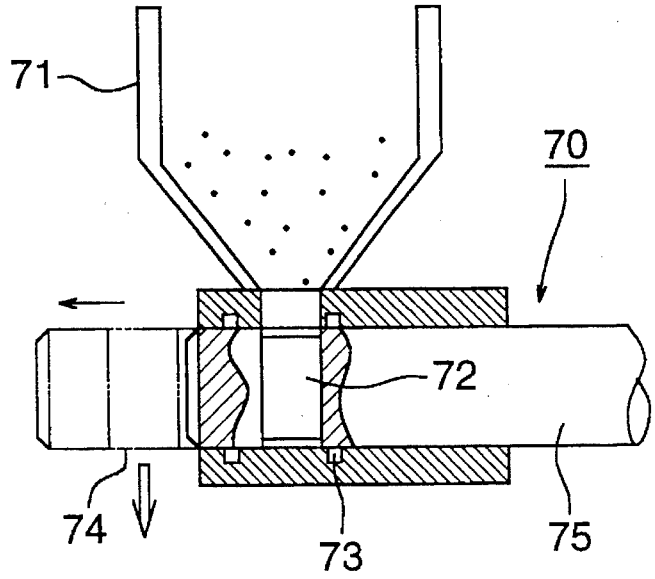
FIG. 9 is a cross-sectional view of another powder-shaped processing chemical supply unit.

FIG. 8 is a perspective view of the other type supply unit for supplying a powder-shaped processing chemical.

In supply unit 60, powder-shaped chemical reserving section 63 is divided into several portions. Similar to the cases of conventional concentrated kits, it is devised to reserve the powder-shaped chemical in every divided portion. Also, moisture resisting unit 65 is provided for improving the preservability of powder-shaped chemical reserved in the reserving section 63.

According to a processing information on a light-sensitive material, rotation member 67 transfers every component of a specific amount of powder-shaped processing chemical received on table 66, to discharging section 68 and the components thereof are then supplied thereto.

In supply unit 70, a powder-shaped processing chemical is put in hopper 71. When piston 75 moves to the horizontal direction (or to the right in the figure) so as to correspond to the processing quantity of light-sensitive materials, a specific amount of powder-shaped chemical is put in measuring hole 72. When piston 75 moves to the opposite direction (or to the left in the figure), the specific amount of powder-shaped chemical is supplied from discharging section 74 to a thermostat tank (or a filtering tank).

Figure 10:
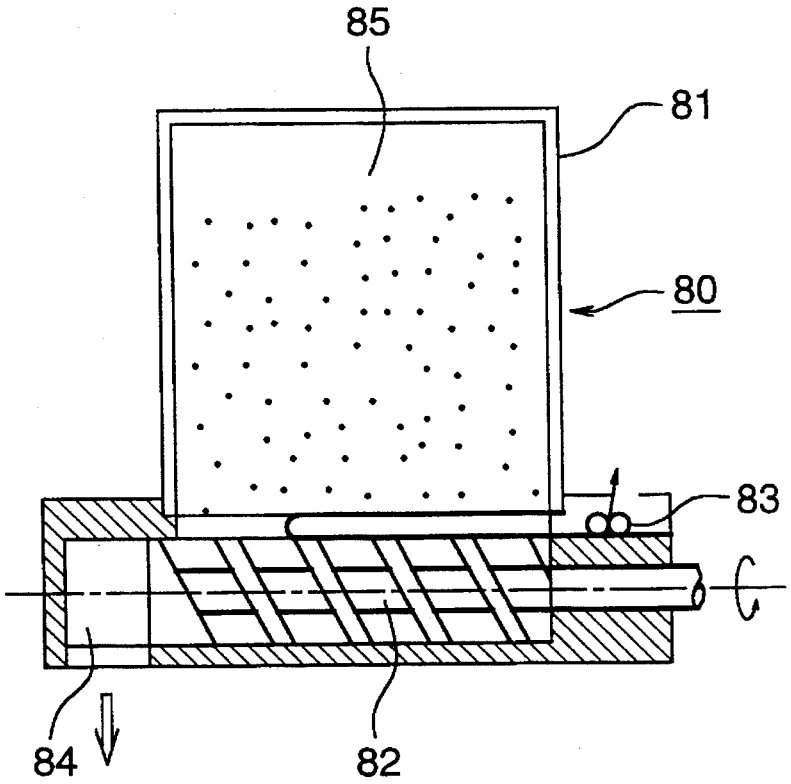
FIG. 10 is a cross-sectional view of another example of the powder-shaped processing chemical supply units.

FIG. 10 is a cross-sectional view of a further unit for supplying powder-shaped processing chemical.

In supply unit 80, package 81 containing powder-shaped processing chemical 85 is attached thereto (or loaded thereon) and a function for automatically opening the package 81 by making use of roller 83, so that the powder-shaped chemical can be supplied from discharging section 84 by controlling the number of rotations of screw 82.

Because of the function for automatically opening a package, the performance can be excellent without scattering or flying any fine powder about, when opening and attaching (or loading) a cartridge to the unit.

Figure 11:
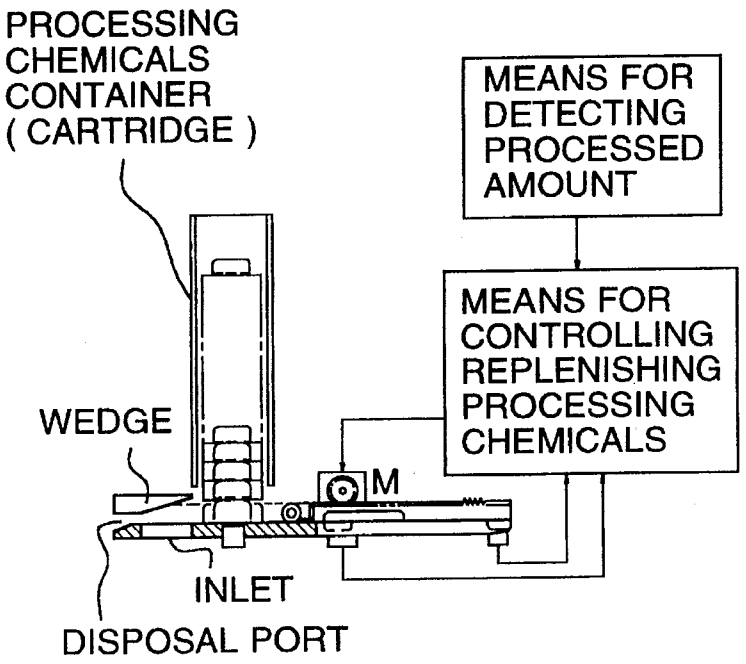
FIG. 11(*a*), FIG. 11(*b*), FIG. 11(*c*) and FIG. 11(*d*) are cross-sectional views and perspective views of a PTP-packed processing chemical supply unit.
Figure 11:
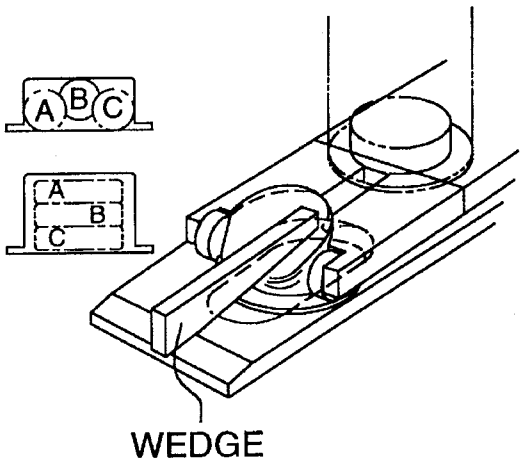
Figure 11:
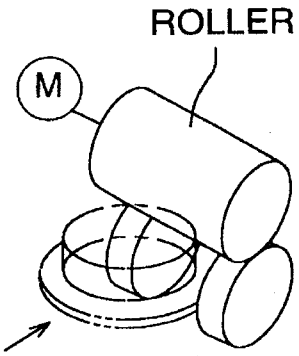
Figure 11:
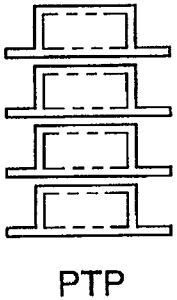

FIGS. 11 are each related to a solid processing chemical putting unit packed in a PTP (standing for Pressure Through Package), wherein FIG. (A) is a cross-sectional view of a processing chemical supply unit, FIG. (B) is a perspective view of a package tearing means, FIG. (C) is a perspective view of a perspective view of a package tearing means and FIG. (D) is a cross-sectional view showing a state of piling PTP-packed solid processing chemicals.

A processing chemical container contains PTP-packed solid processing chemicals, provided that each solid processing chemical may be contained in the individual processing chemical container or that such a container as mentioned above may be a cartridge contained therein solid processing chemicals in advance. Such PTP package may be made of any known materials. However, it is preferable that such solid processing chemicals may be packed in the form of tablets.

A PTP-packed solid processing chemical is supplied from the lower part of a container. When a light-sensitive material is completed to be processed, an information on a processing quantity detection means is sent to a processing chemical supply control means and the solid processing chemical is extruded out and then crushed out of shape beneath a wedge-shaped fixed plate by a motor. Thereby the lower part (made of mainly aluminium) of the PTP package is pealed off and the solid processing chemical is then put in a processing tank from a chemical putting inlet. After the chemical is put in, the empty PTP package is further extruded out and is then delivered out of an exit for a waste so as to be disused. As for the crushing means, a roller may also be used, besides the above-mentioned wedge-shaped crushing means. Any one of the means may be selected.

Figure 12:
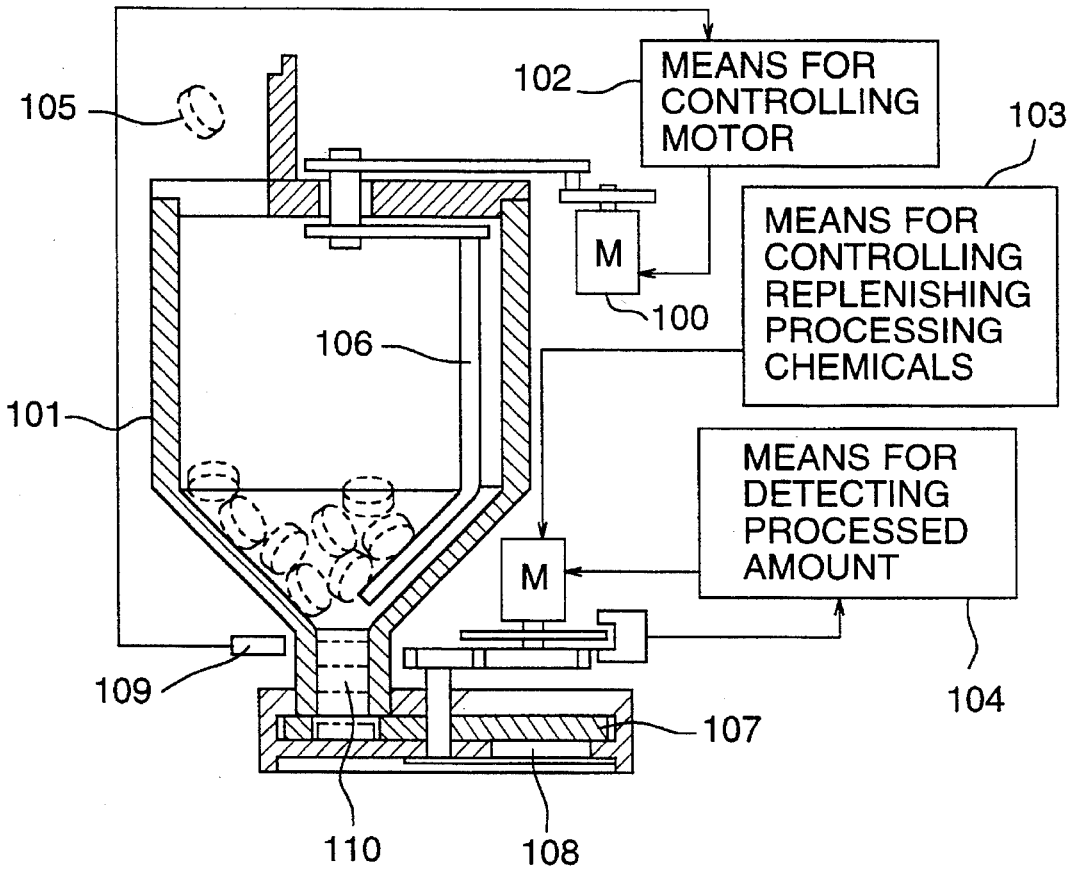
FIG. 12(A) is a cross-sectional view of a further example of the supply units
FIG. 12(B) and FIG. 12(C) are perspective views of packages for packing tableted chemicals.
Figure 12:
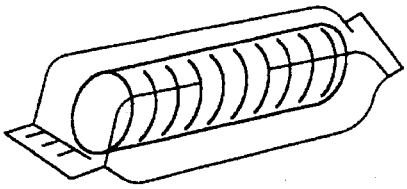
Figure 12:
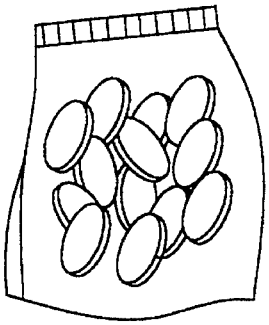

FIG. 12 shows an example of part-feeder system supply units for collectively packed tablets (each of which is individually weighed in advance).

After opening a package as shown in FIG. 12(B) or 12(C) for collectively packing tableted chemicals, the tablets are put in a hopper 101. At this moment, no fine powder or the like nor caking can be produced, and the handling convenience can also be excellent. A stirrer 106 is rotated when it receives a signal sent from a remaining quantity detection means 109 and thereby tablets 105 can be lined up in tablet lining-up section 110. Corresponding to a processing quantity of light-sensitive materials, processing chemical supply control means 103 is operated and rotary table 107 transports the tablets so as to supply the tablets to a tablet putting section from tablet delivery section 108. Rotary table 107 is made one rotation and is then stopped in rotation by a demand sent from a rotary table control means, (provided that several supplies of the tablets may also be made by a single demand.) Then, the tablets are put in the hole of rotary table 107.

The above-described system has such an advantage that the costs of packing materials are inexpensive and the tablets can accurately be put in and, particularly, that no empty or idle supply can be made by the rotary table so that the efficiency can remarkably be improved, because the tablet lining-up section 110 is provided. The system is also preferable for the environmental protection aptitude, because the quantity of plastic containers used therein can be saved. Further, a maintenance-free can be enjoyed, because the inside of a supply unit can be kept clean, because no fine powder can be produced.

FIG. 13 shows an example of part-feeder system supply unit 120 for collectively packaged tablets (each of which is individually weighed in advance).

After opening a package as shown in FIG. 13(B) or 13(C) for collectively packing tableted chemicals, the tablets are put in a hopper 133. At this moment, no fine powder or the like nor caking can be produced, and the handling convenience can also be excellent. A movable member 124 is rotated when it receives a signal sent from a remaining quantity detection means 125 and thereby tableted chemicals can be lined up in tablet lining-up section 129. A specific quantity of the tableted chemicals is lined up, movable member 124 is stopped in action. At this moment, sweeper 123 puts the tableted chemicals into pocket 122 of movable member 124, so that a remarkably effect can be displayed to line up the tableted chemicals in lining-up section 125.

Corresponding a processing quantity of light-sensitive materials, processing chemical supply means 126 is operated to rotate the first shutter 131, so that the tableted chemicals are dropped down. Then, the first shutter 131 is rotated into reverse and the tableted chemicals are passed through the delivery section 128, so as to be supply them to the tablet putting section. Next, shutter 132 is rotated into reverse so that shutter 131 can be closed.

The above-described system has such an advantage that the costs of packing materials are inexpensive and the tablets can accurately be put in and, in particular, that no empty or idle supply can be made, because the tablet lining-up section 110 is provided, that the environmental protection aptitude can be improved by saving a quantity of plastic containers used therein and further that a maintenance-free can be enjoyed, because the inside of a supply unit can be kept clean, because no fine powder can be produced.

Figure 14:
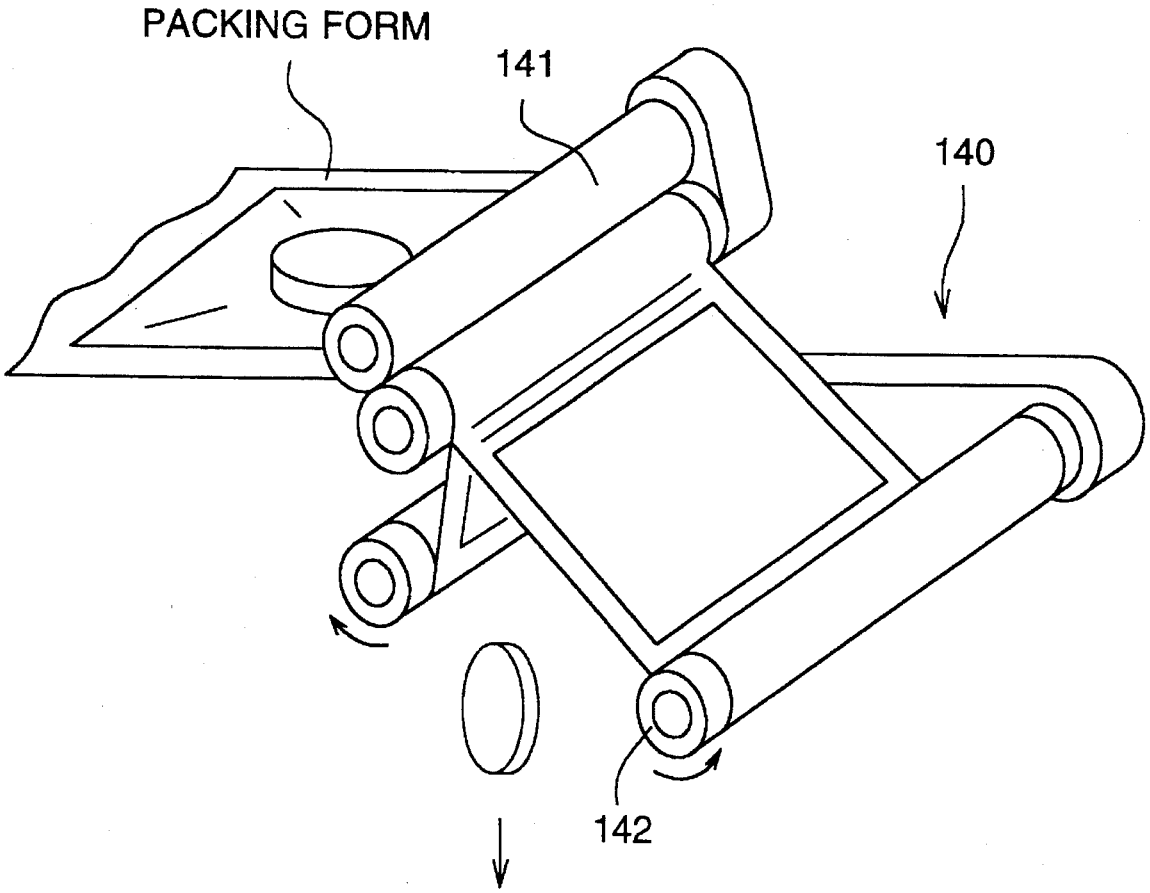
FIG. 14 is a perspective view of a yet another example of the supply units.

FIG. 14 is a perspective view of an example of solid processing chemical supply units 140, wherein a solid processing chemical is put in a processing tank by pealing off the package of a solid processing chemical packed therein.

The leading edge of a four-side sealed package of a solid processing chemical is fit on take-up reels 142 that is a fitting means, through rollers 141. When a light-sensitive material is processed, a processing quantity information detection means detects it and, when reaching a specific quantity thereof, a signal is sent from a processing chemical supply control means to a motor for take-up reels 142 which are also serving as a processing chemical supply means, so that the motor is operated in rotation. Thereby the package containing the solid processing chemical is moved by a specific distance, so that a necessary quantity of solid processing chemicals is put in a processing tank. The methods for moving a package may be anyone of the methods including, for example, a method in which a notch provided in advance to a package is detected and another method in which a printed pattern or the processing chemical contained in a package is detected, provided, in short, the methods thereof can precisely detect a necessary quantity of solid processing chemicals and can also move the chemicals by making use of rollers 141 and take-up reels 142. Rollers 141 are provided with the purposes of fitting and positioning a package and, thereby the package is pealed of by the two take-up reels and then solid processing chemicals are put in processing tanks, respectively.

In such a case as mentioned above, a solid processing chemical may be in any forms of granule, pill and powder. Among the forms thereof, a tablet-formed chemical may rather be preferable, because the tablet-formed chemical has such an advantage that tablets can hardly adhere so much to a seal and, therefore, that the tablets can precisely be put in a tank and any contamination can hardly be produced. After a package is taken up, it is allowed to take out the empty package from the take-up reels directly or to rewind the package and then to disuse it together with a cartridge.

Figure 15:
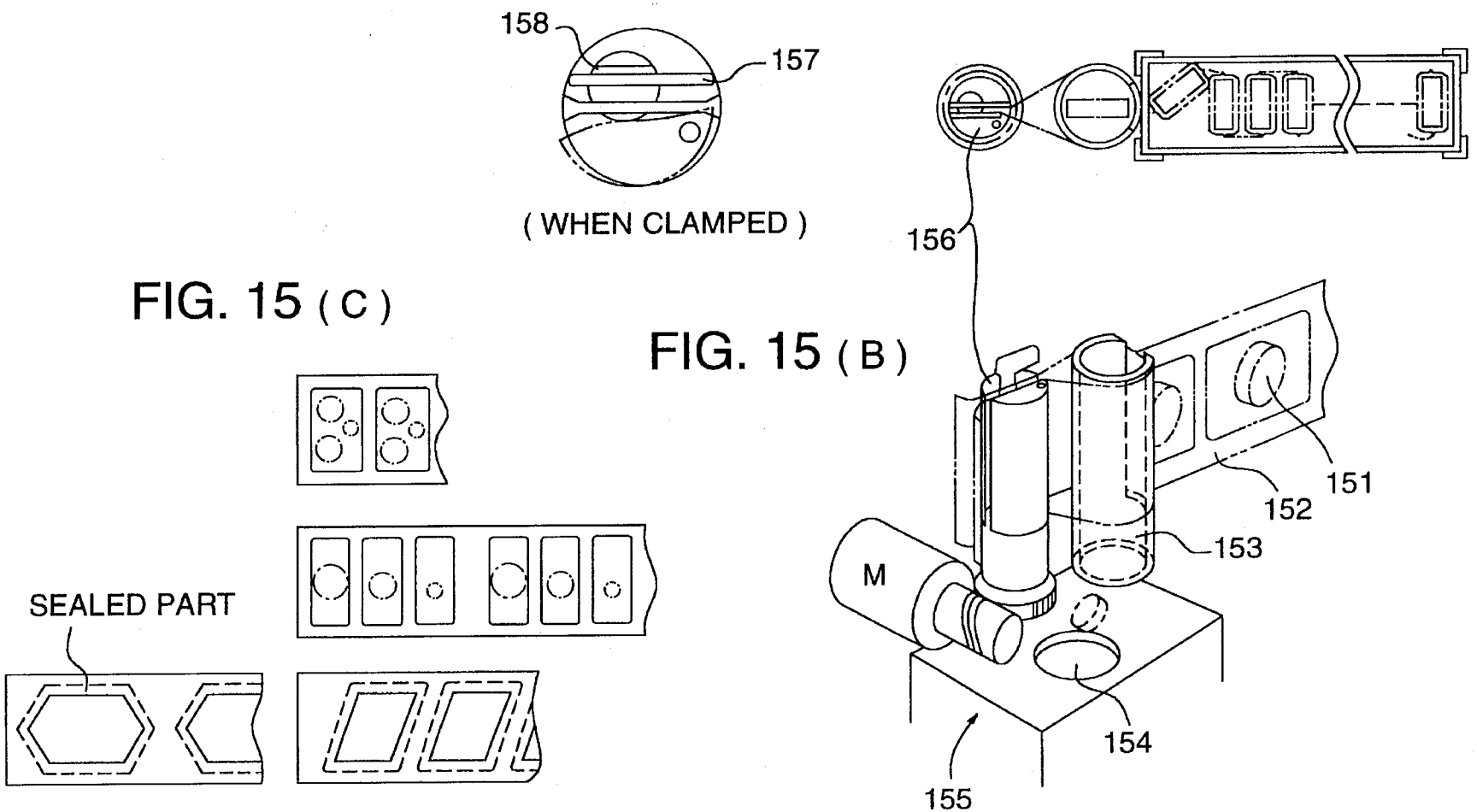
FIG. 15(A) is a plan view and FIG. 15(B) is a perspective view of a supply unit and FIG. 15(C) is a plan view of a package.

FIG. 15 shows an example of the supply units which are the preferable embodiments of the invention, wherein FIG. 15(A) is a plan view thereof, FIG. 15(B) is a perspective view thereof, and FIG. 15(C) shows each of the plan views of various types of packages.

Processing chemical 151 is packed in a four-side sealed package in anyone of the manners such as shown in FIG. 15(C).

The package forms shown in FIG. 15(C) are some examples of the invention, wherein the raw materials to be used for the packages may be any commonly useful materials such as those made of a macromolecular resin, aluminium or a compounded material, provided, in short, that the raw materials are to be excellent in moisture resistance and low in oxygen permeability.

Four-side sealed processing chemical 151 is pealed off through a cylinder 153 and is then put in chemical putting section 155 through chemical putting inlet 154. In this embodiment, cylinder 153 and take-up reel 156 are served together as a processing chemical supply means. Package 152 is so constructed as to be taken up by take-up reel 156 and the taking-up operation is controlled by a processing chemical supply means received a signal from a light-sensitive material processing quantity detection means. A take-up operation is operated in the following manner; knob 157 is turned to the opened position and the leading edge of package 151 is set on take-up reel 156 that is serving as a means for fixing a processing chemical containing packing material through the cylinder 153. When turning the knob 157, the package is fixed by cramp 158 and is then taken up.

Figure 16:
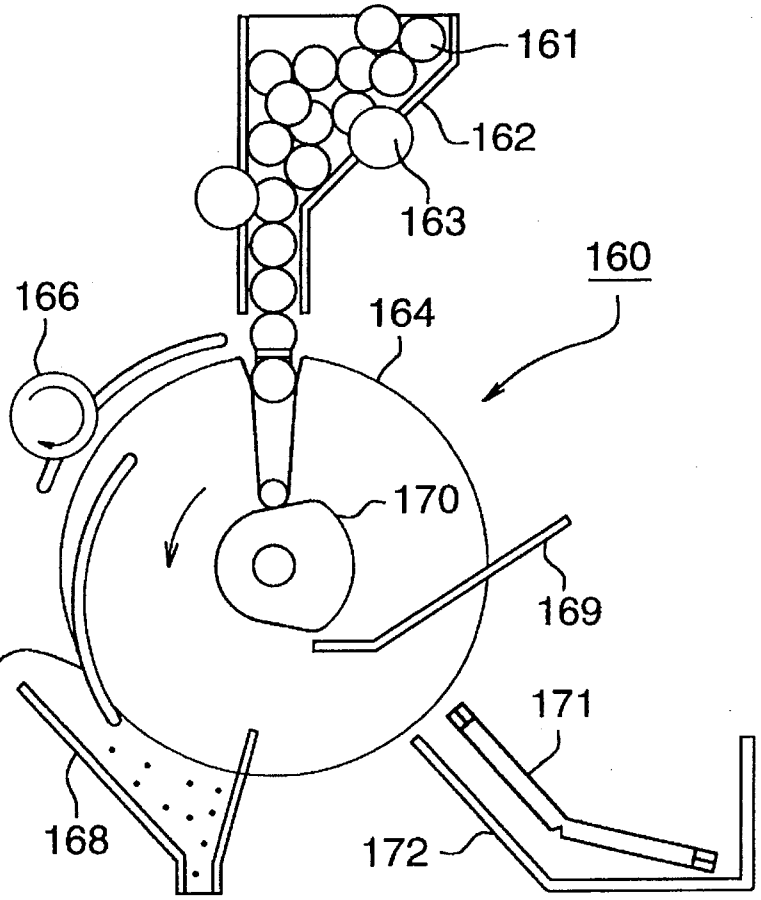
FIG. 16A is the side cross-sectional view and FIG. 16(B) is a front cross-sectional view of a supply unit.
Figure 16:
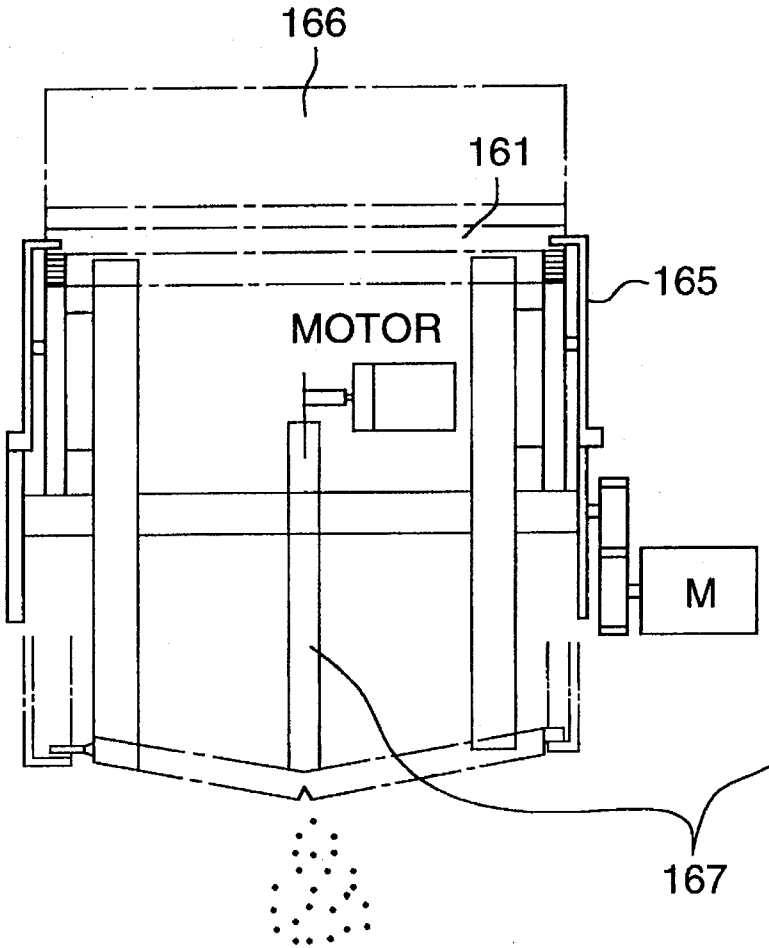

FIG. 16 shows an example of supply units 160 to be used when solid processing chemical 161 is stick-like packed, wherein FIG. 16(A) is a side sectional view thereof and FIG. 16(B) is a front sectional view thereof.

Stick-like packed solid processing chemical 161 is put in chemical container 162 that is serving as a containing means.

Stick-like packed solid processing chemical 161 contained in container 162 is transferred by bridging prevention roller 163 and a roller for double-serving as a supplier for supplying the solid processing chemicals to turret 164. Both ends of stick-like packed solid processing chemical 161 transferred to turret 164 is fixed by cramper 165 and is then transferred to cutting section by a rotary motion. The center portion of the stick-like package is notched (or cut apart) by cutter 166 and is further transferred to twice-folded plate 167 by a rotary motion so that stick-like packed solid processing chemical 161 can be folded. Solid processing chemical 161 filled in the stick-like package is put in chute 168 in order from the notched portion thereof. After completing the putting the chemical, the chemical is further transferred to scrap-dropping bar 169 by a rotary motion and cramper 165 is released free by cramp opening/shutting cam 170. Then, scrap packaged scrap 171 is thrown away in scrap collection chute 172.

Figure 17:
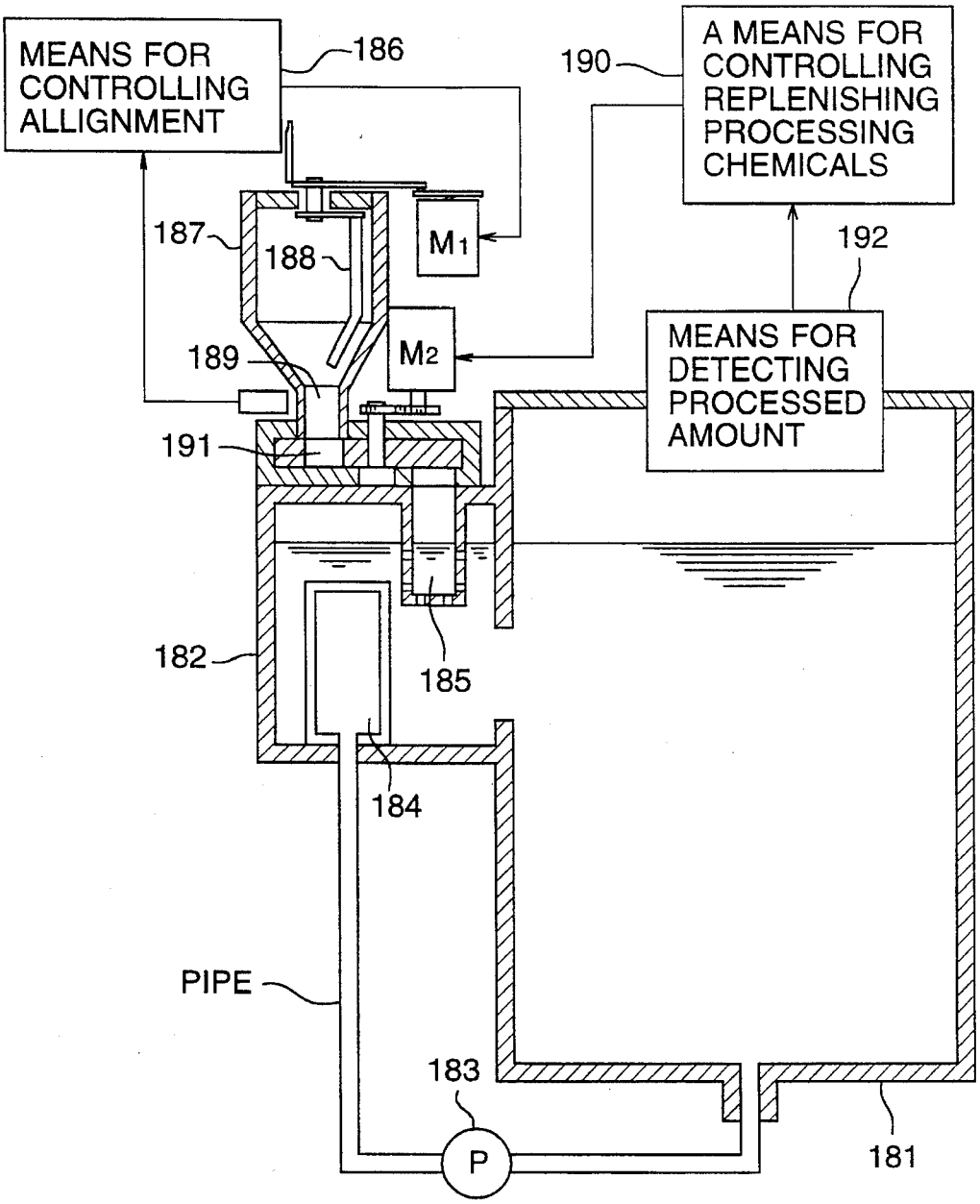
FIG. 17(A) is the cross-sectional view of a supply unit and FIG. 17(B) and FIG. 17(C) are perspective views of a package.
Figure 17:
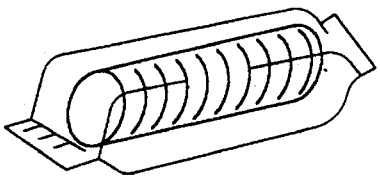
Figure 17:
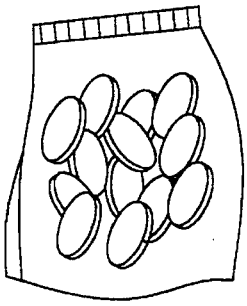

FIG. 17 shows both of the cross-sectional view and prospective view of an embodiment of the invention.

Processing tank 181 is communicated through chemical putting section 185 inside thermostat tank 182 constituting a part of the processing tank. A solution is forcibly circulated from the lower portion of the processing tank by a circulation pump 183 so that the solution can be exhausted to filter section 182 and then the solution can enter into processing section 181 through tablet putting section 185.

When a light-sensitive material is processed, the quantity of the light-sensitive material processed is detected by processing quantity detection means 192. When reaching a specific processing quantity, motor M2 is driven through a processing quantity control means and tableted chemicals each weighed in advance are supplied to tablet putting section 185 inside thermostat tank 182.

Tablets are directly put in container 187. After putting the tablets therein, motor M1 drives tablet lining-up means 188 upon receipt of a signal sent from tablet lining-up quantity control means 186 so as to line up the tablets and the lined-up tablets are supplied to lining-up section 189. When motor M2 is driven in rotation upon receipt of a signal sent from processing quantity supply control means 190, the tablets supplied to tablet lining-up section 189 are transported to the upper portion of the tablet putting section and are then put therein. At this moment, it is a preferable embodiment from the view point of the moisture resistance of the tablets when processing chemical supply means 191 is substantially disconnected from thermostat tank 182.

When a tablet is put in container 187, such a tabelets-containing package as shown in FIG. 17(B) or 17(C) is cut open and the tablets are put in the container 187. The packages shown in FIGS. 17(A) and 17(B) applicable thereto may be made of such a known raw material as a sheet of paper, a macromolecular resin and aluminium. However, it is preferable to use a raw material having an excellent moisture resistance and a low oxygen permeability.

Figure 18:
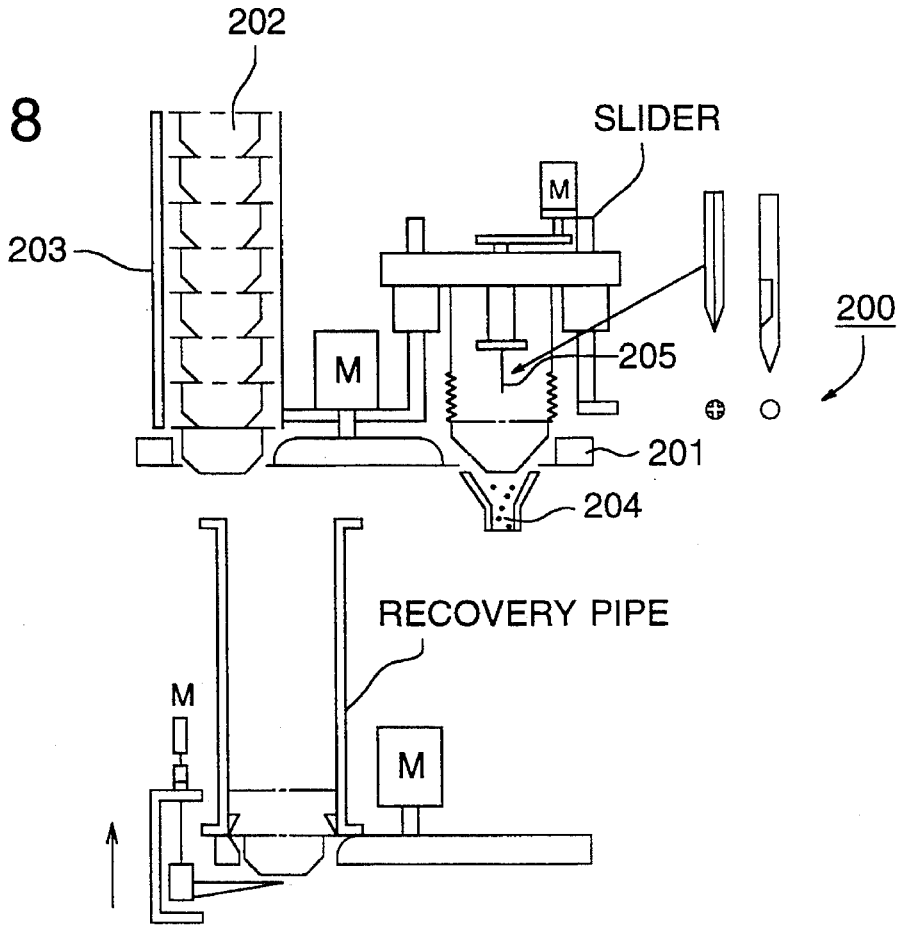
FIG. 18 is the cross-sectional view of a supply unit for supplying individually blister-packed solid processing chemical.

FIG. 18 is a cross-sectional view of an example of individually blister-packed solid processing chemical supply unit 200.

Individual package 202 containing a solid processing chemical is loaded on package container 203.

Corresponding a processing quantity of light-sensitive materials, disc 201 rotates for 180°. Thereafter, needle 205 penetrates individual package 202 and then passes through delivery section 204 inside individual package 202, so that the solid processing chemical is supplied to a solid processing chemical putting section. Empty individual package 202 is thrown away from a waste disposal outlet.

The solid processing chemicals may be of the powdered or granulated form. However, the granulated form is rather better than the powdered form, because powder is liable to adhere to a container.

The granulated form has such an advantage that the handling thereof is easy without contaminating supply unit 200 with fine-powder and that a maintenance-free can be enjoyed.

Figure 19:
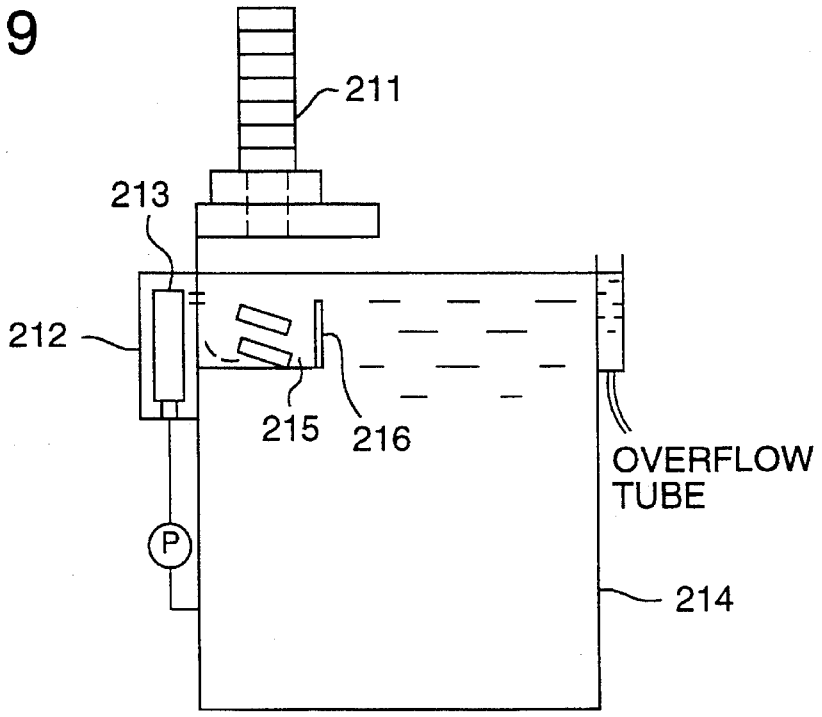
FIG. 19 is the cross-sectional view showing an example of the case where a solid processing chemical is added directly to a processing tank.

FIG. 19 is a cross-sectional view of an example of the embodiments of the invention.

Corresponding to a processing quantity of light-sensitive materials, tableted chemicals are supplied directly from tableted chemical reservoir section 211 to tablet putting section 215 inside a processing tank. Tablet putting section 215 is provided with solid processing chemical filter 216 so that undissolved processing chemical may not adhere directly to any light-sensitive material. The materials for the filter 216 shall not be specially limited. The mesh sizes for the filter shall not also be limited, but the sizes thereof are preferably within the range of 10 to 100 μm from the viewpoints of the filtration of a solution and a filtration effect.

In this example, the effects thereof are almost the same as in the case where a solid processing chemical is supplied to thermostat tank 212 constituting a component of a processing tank. However, this example is inferior in compactness, because tablet putting section 215 is separately provided to the inside of a processing tank.

Figure 21:
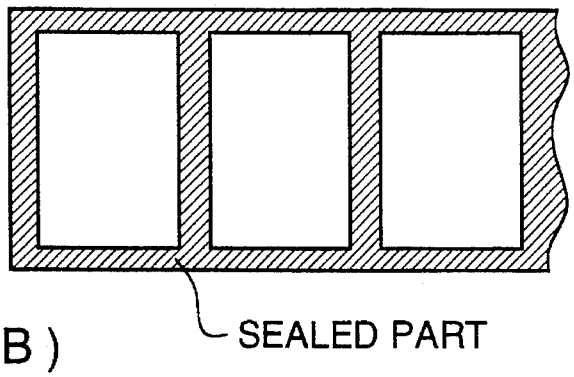
FIG. 21(A), FIG. 21(B), FIG. 21(C) and FIG. 21(D) show the plan views of some examples of 3-side and 4-side sealed packages.
Figure 21:
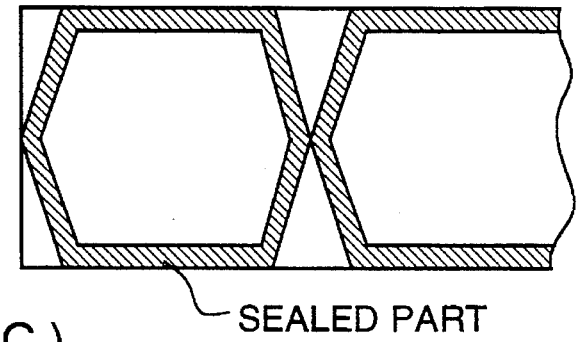
Figure 21:
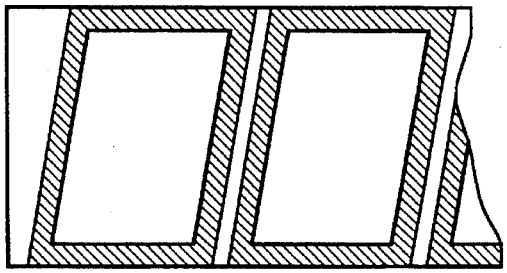
Figure 21:
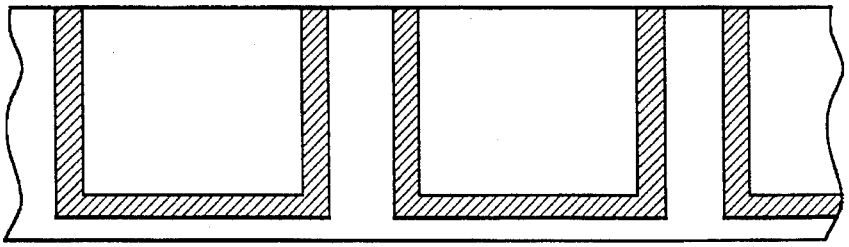

Now, the concrete examples of 4-side sealed and 3-side sealed packages will be given in FIGS. 20 and 21. In the sealed package shown in FIG. 20(A), several kinds of tableted chemicals are contained in a single package unit. In FIG. 20(B), different kinds and sized tablets are individually packed. In FIG. 20(C), granules or powder are packed. In FIG. 20(D), the same sized tablets are each independently packed. And, in FIG. 20(E), the same sized and the same kind of several pieces of chemicals are each packed in the small tableted form.

Figure 22:
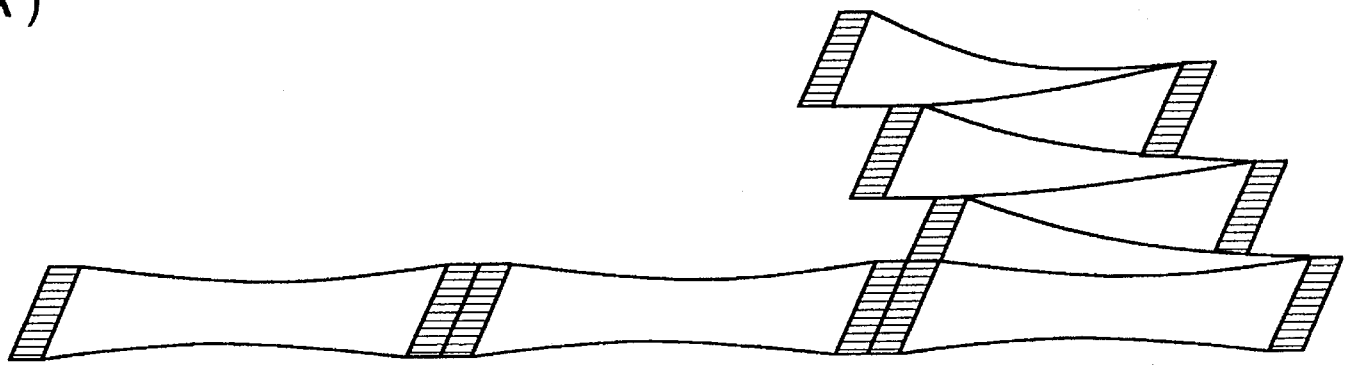
FIG. 22(A) and FIG. 22(B) are plan views showing a concrete example of a stick-like packages.
Figure 22:
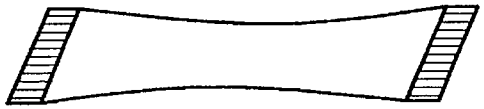

FIGS. 21(A), 21(B) and 21(C) are each a plan view showing the examples of four-side sealed chemical packages. FIG. 21(D) shows an example of three-side sealed chemical packages. FIGS. 22(A) and 22(B) are each the examples of stick-like packages. However, the four-side and three-side sealed packages and the stick-like packages each of the invention shall not be limited thereto.

Figure 23:
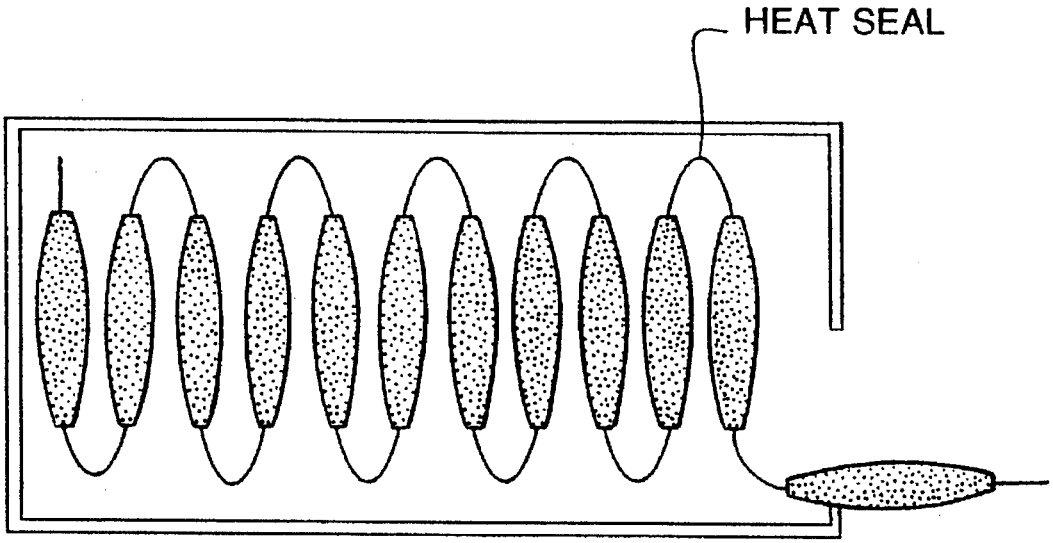
FIG. 23 is the cross-sectional view showing a concrete example of another stick-like package.

FIG. 23 is a cross-sectional view showing a state where granules or powder are seal-packed by heat and the heat-sealed packages thereof are continuously folded zig-zagwise so as to reserve them in a package container.

Figure 24:
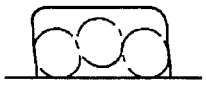
FIG. 24(A), FIG. 24(B), FIG. 24(C), FIG. 24(D) and FIG. 24(E) are drawings which show an example of PTP-packages.
Figure 24:
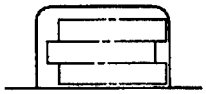
Figure 24:
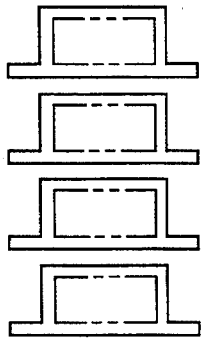
Figure 24:
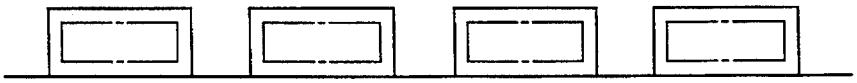
Figure 24:
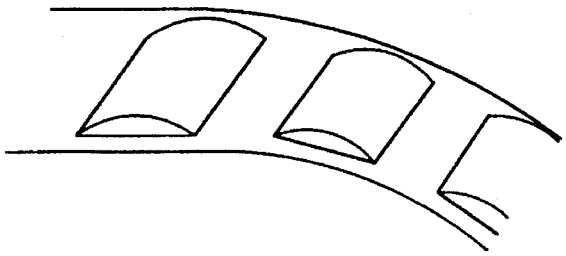

FIG. 24 shows some of the concrete examples of PTP packages, provided that the invention shall not be limited thereto. FIG. 24(A) shows a pill-shaped solid processing chemical packed in a PTP package. FIG. 24(B) shows a state where plural processing chemical tablets are packed in a package. FIG. 24(C) shows a state where each package containing a tableted, granulated or powdered processing chemical is vertically arranged. And, FIG. 24(D) shows several packages as mentioned above are horizontally lined up. The PTP packages may also include those of the blister type as shown in FIG. 24(E).

FIG. 25 shows each of the concrete examples of solid processing chemical collective packages, provided that the invention shall not be limited thereto. FIG. 25(A) shows a cylindrical tablet container collectively containing solid processing chemicals. FIG. 25(B) shows a soft two- or three-side sealed bag containing solid processing chemicals. And, FIG. 25(C) shows a single-side sealed bag containing solid processing chemicals.

Figure 26:
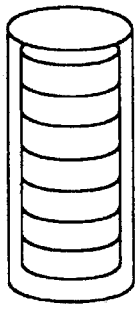
FIG. 26(A), FIG. 26(B), FIG. 26(C) and FIG. 26(D) show an example of cartridges.
Figure 26:
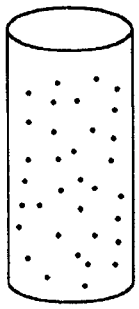
Figure 26:
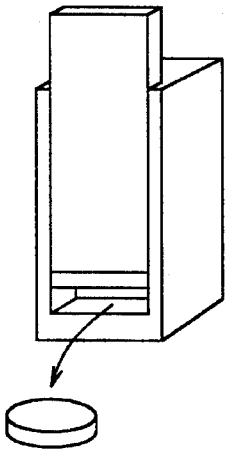
Figure 26:
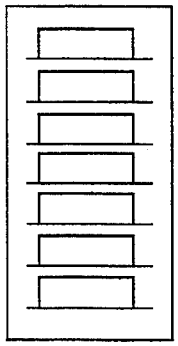
Figure 27:
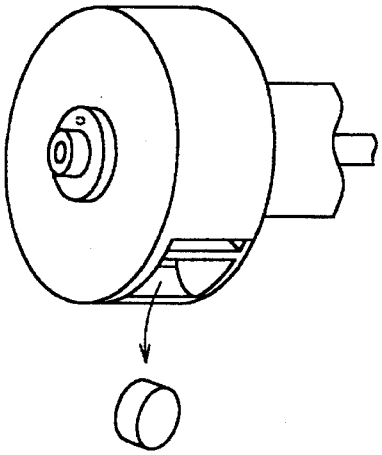
FIG. 27(A) and FIG. 27(B) are perspective views showing another concrete example of the cartridges.
Figure 27:
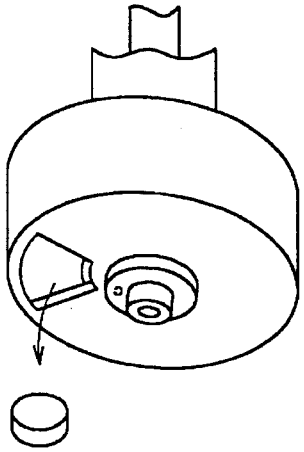

FIGS. 26 and 27 are each a perspective view showing the concrete examples of cartridges.

The above-shown cartridges can be loaded on the supply unit of an automatic processor of the invention as the cartridges are each containing solid processing chemicals. As for the materials of the cartridges, anyone of the afore-given compounds can be used. However, it is preferable that such a cartridge as mentioned above may not be crushed so as to interfere the supply of the solid processing chemicals when decreasing the solid processing chemicals.

FIG. 26(A) shows a cylindrical cartridge containing tablets. And, FIG. 26(B) shows a cartridge containing granules or powder.

FIGS. 26(C) and 26(D) show the perspective view and cross-sectional view of a box type cartridge having a opening/shutting cover and containing solid processing chemicals.

FIG. 27 shows each of solid processing chemical containers having such a structure that tablets, granules or powder are contained in a rotatable container having a partition and, further, the container is put in an outer cylinder (or a main body), so that a specific amount of the chemicals are dropped down from the aperture of the container. FIG. 27(A) shows a structure thereof in which a rotary shaft is horizontally supported. And, FIG. 27(B) shows a structure thereof in which a rotary shaft is vertically supported.

The invention shall not be limited to the above-given concrete examples.

Further, the descriptions will be made on the other examples shown in FIGS. 28(*a*) and 28(*b*), FIGS. 29(*a*) and 29(*b*) and FIGS. 33, 34 and 35, respectively.

Figure 28:
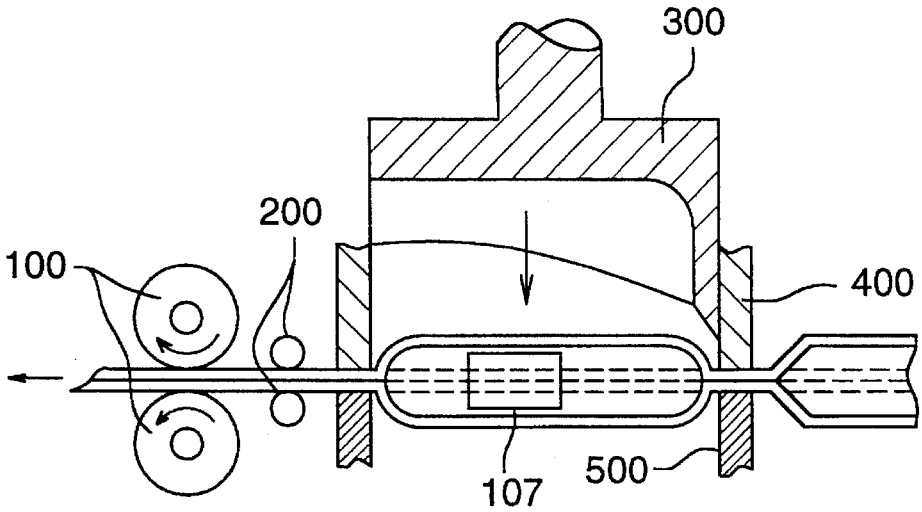
FIG. 28(A) and FIG. 28(B) are perspective views of a unit for halfdie-cutting a package into the laterally U-shaped.
Figure 28:
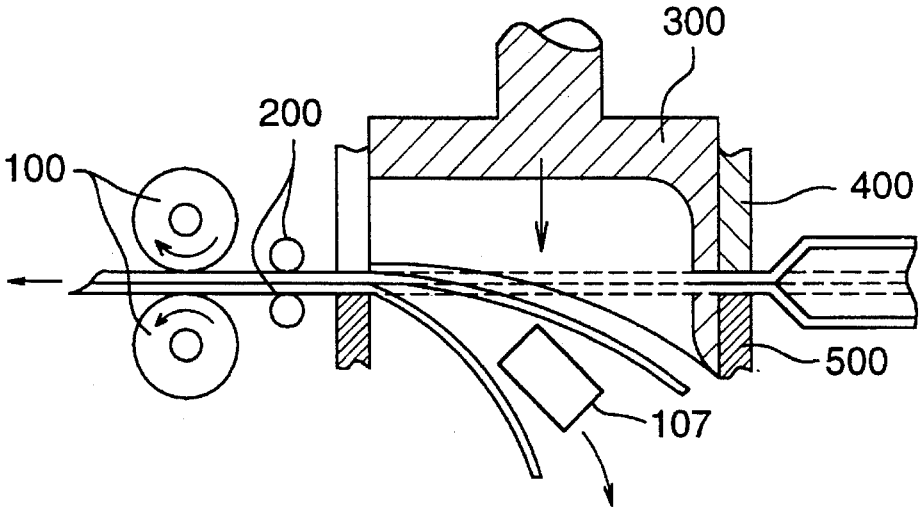

FIGS. 28(*a*) and 28(*b*) show each a laid down U-shaped half die punching system, respectively.

When a light-sensitive material was processed, the quantity of the processed light-sensitive material is detected by a processing quantity information detection means. When reaching a specific quantity, a signal is sent from a processing chemical supply control means, and a pair of transport rollers 100 rotate and transport package 801 containing solid processing chemical 107 shown in FIG. 29(*a*) to such a position as shown in FIG. 28(*a*) and then stop in rotation. Any methods for transporting packages 801 may be used, such as a method for detecting a notch provided in advance to packages 801, another method for detecting a printed pattern or an eye-mark and a further method for detecting solid processing chemical 107 packed in package 801. In short, a necessary quantity of solid processing chemicals 107 can precisely be detected in these methods. Next, as shown in FIG. 28(*b*), male punch 300 moves downward and cuts package 801. Solid processing chemical 107 is thereby put in the processing tank of an automatic processor through putting inlet 901 shown in FIG. 29(*a*). The edge cut by male punch 300 is formed into such a lateral U-shape like punched form 601 as shown in FIG. 29(*b*).

In such a case as described above, any shapes of solid processing chemical 107 may be used, such as a powdered chemical, a granulated chemical and a tableted chemical. Among the forms thereof, it is preferable to use a tablet-formed chemical, because any chemical can hardly adhere to the male punch. A tableted chemical can not so much adhere to a package. Therefore, it can hardly be stained and can also be safe when a user handles it. Used packages 801 may be collected in scrap box 102. It is preferable to reuse a used package container 701 as the above-mentioned scrap box 102.

Figure 30:
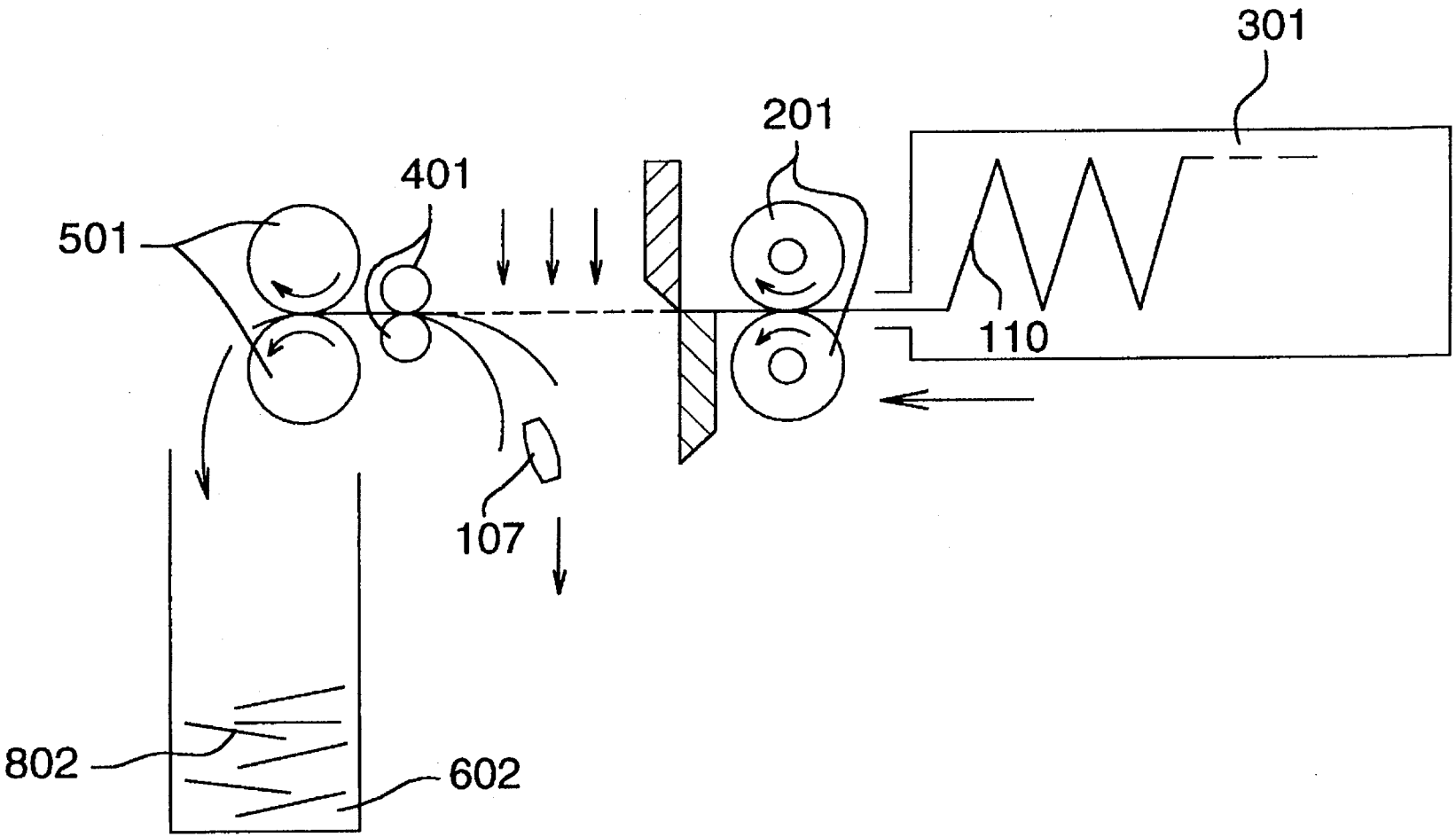
FIG. 30 shows a unit having a system for cutting a package down.
Figure 31:
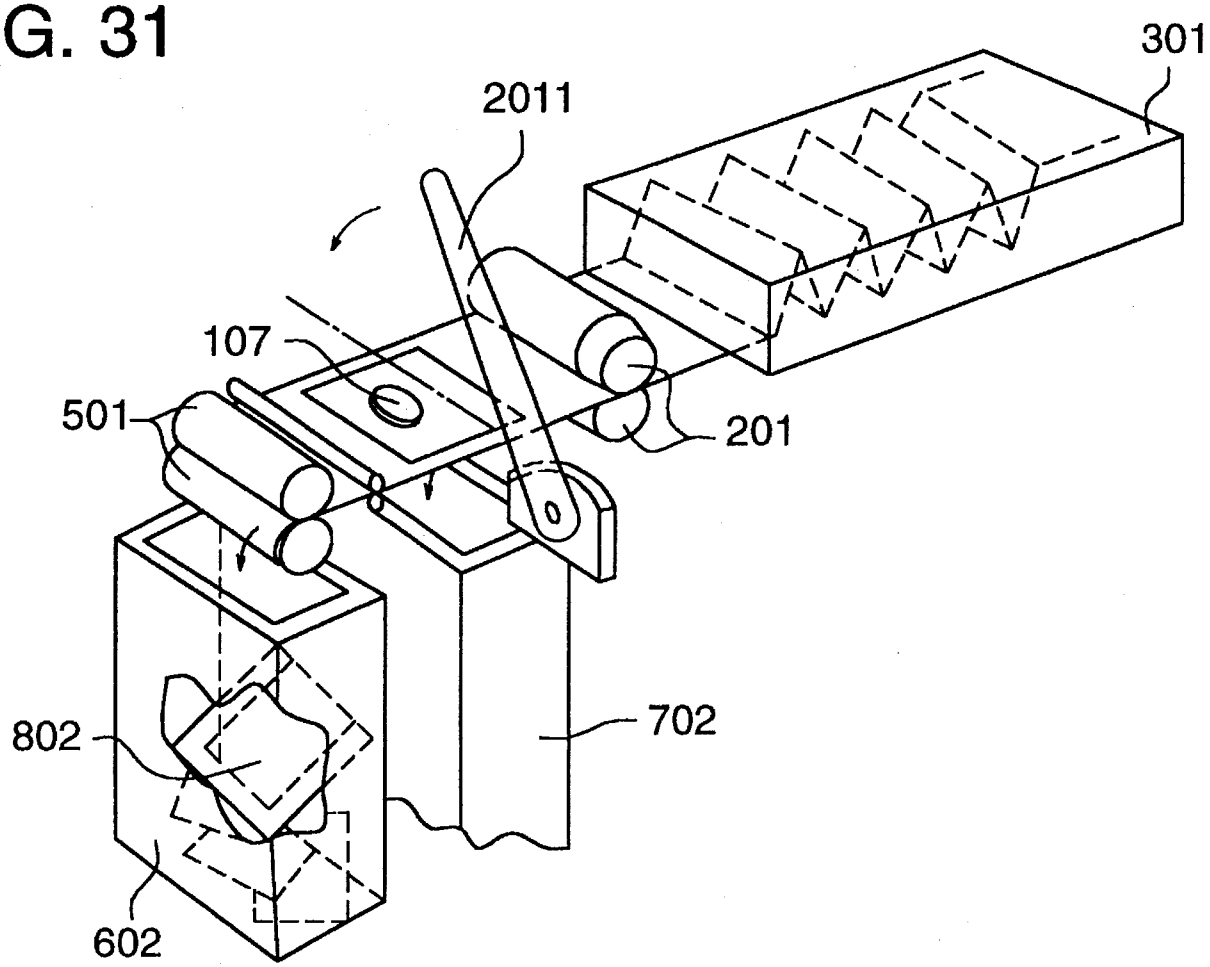
FIG. 31 is a perspective view of the unit having the system for cutting down, that is shown in FIG. 30.

FIGS. 30 and 31 show each a method for cutting package 110 off.

When a light-sensitive material was processed, the quantity of the processed light-sensitive material is detected by a processing quantity information detection means. When reaching a specific quantity, a signal is sent from a processing chemical supply control means, and a pair of transport rollers 201 rotate and transport package 110 containing solid processing chemical 107 to a position where solid processing chemical 107 is transported to the upper portion of filter section 702 of a processing tank, and then stop in rotation. At this time, the leading edge of package 110 is caught in a pair of squeezing rollers 401.

Any methods for transporting packages may be used, such as a method for detecting a notch provided in advance to packages 801, another method for detecting a printed pattern and a further method for detecting a processing the packages. In short, a necessary quantity of solid processing chemicals 107 can precisely be detected in these methods. Then, ceramic-made cutter 201 cuts package 110 off. After completing cutting it off, a pair of squeezing rollers 401 and a pair of transport rollers 501 are each rotated and solid processing chemical 107 is squeezed by the squeezing rollers 401 and is then put in filter section 702 of the processing tank of an automatic processor through a delivery outlet. Used packages 602 cut off thereby are delivered and put in scrap box 602 by the transport rollers 501. It is preferable to reuse a used package container 701 as the above-mentioned scrap box 602.

In such a system as described above, any shapes of solid processing chemical 107 may be used, such as a powdered chemical, a granulated chemical and a tableted chemical. Among the forms thereof, it is preferable to use a tableted chemical , because tableted chemical can hardly adhere to ceramic-made cutter 201. A tableted chemical has such an advantage that it can not so much adhere to a package 110 and, therefore, that it can hardly be stained.

Used packages 110 may be collected in scrap box 602.

FIG. 23(*a*) and 23(*b*) show each a system for cutting and dividing continuous packages 603 into two parts.

When a light-sensitive material was processed, the quantity of the processed light-sensitive material is detected by a processing quantity information detection means. When reaching a specific quantity, a signal is sent from a processing chemical supply control means and, at the same time when a pair of transport rollers 502 is rotated, ceramic or stainless-steel-made disc-shaped knife 301 is rotated. Thereby the lower portions of continuous packages 603 are cut apart into two parts, so that solid processing chemical contained therein can be put in. When dividing the packages into two portions, continuous package 603 is expanded to the both sides of suction guide by a suction so that solid processing chemical 107 contained therein can readily be dropped down. When putting the next solid processing chemical 107, the empty packages 603 without containing any solid processing chemical 107 are moved by transport rollers 401 to package collection box 101 for wasting them.

Besides the above-described system, the other systems may also be used, wherein for example, a continuous package is provided with a notch or the like and it may be torn up while it is being taken up by a roller.

In the case of such a system as mentioned above, any shapes of solid processing chemical 107 may be used, such as a powdered chemical, a granulated chemical and a tableted chemical. Among the forms thereof, it is preferable to use a tableted chemical , because tableted chemical can hardly adhere to a male punch. A tableted chemical has also such an advantage that it can not so much adhere to the seal of a package and, therefore, that it can hardly be stained.

Used continuous packages 603 may be collected in package scrap box 101.

EXAMPLES

Example 1

Figure 32:
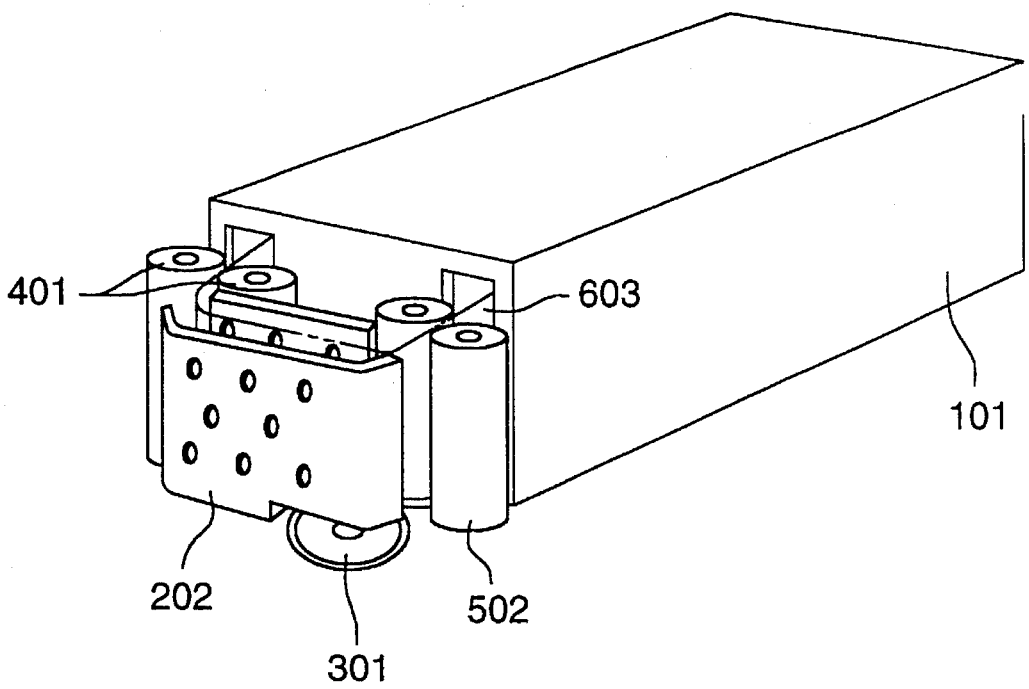
FIG. 32(A), FIG. 32(B) and FIG. 32(C) show a unit for cutting and dividing a continuous package into two parts.
Figure 32:
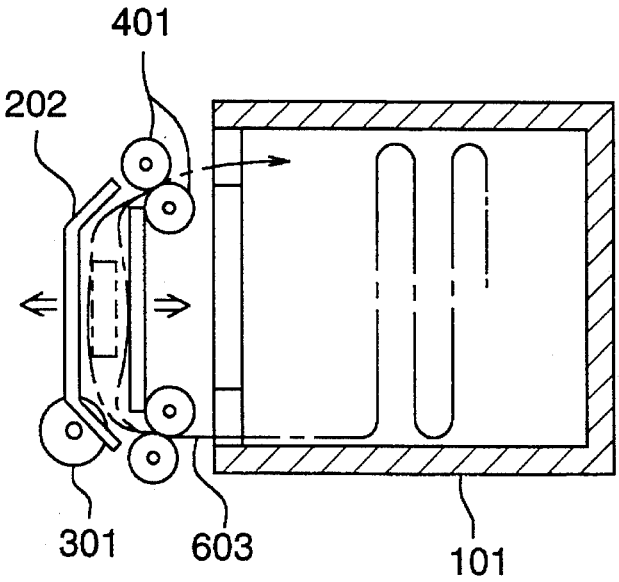
Figure 32:
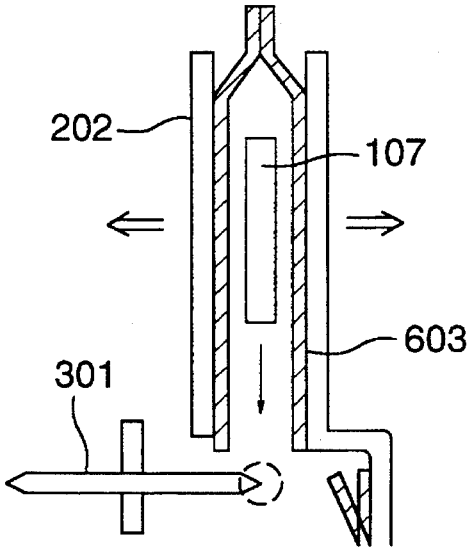

After exposing a series of Konica QA Paper Type A5 to light imagewise, the portion for adding replenishing chemicals of a Konica Big-Mini Lab, BM-101 was remodeled into a solid processing chemical supply unit as shown in FIG. 32 and, further, the processing steps were also changed into the processing steps shown in Table 1. The series of Konica QA Paper exposed to light imagewise were continuously processed.

TABLE 1

| Processing step | Processing time | Processing temperature | Circulating amount through a circulation pump | Replenishing water |
|---|---|---|---|---|
| Color developing | 27 sec. | 37.5° C. | 8 liters/min. | 71 ml/m$^2$ |
| Bleach-fixing | 27 sec. | 37.5° C. | 4 liters/min. | — |
| Stabilizing-1 | 27 sec. | 35° C. | 2 liters/min. | — |
| Stabilizing-2 | 27 sec. | 35° C. | 2 liters/min. | — |
| Stabilizing-3 | 27 sec. | 35° C. | 2 liters/min. | 180 ml/m$^2$ |
| Drying | 50 sec. | | | |

The stabilization system was a counter-current system from 3 to 1, wherein the whole overflow from stabilizing step 1 was flowed into the bleach-fixing tank and a carry-over per sq.meter of a subject light-sensitive material was 50 ml/m$^2$ in every tank.

When the temperatures were thermostatically controlled, the compensations for evaporation produced in the color developing, bleach-fixing and stabilizing steps were carried out, in a one-hour cycle, in 9.0 ml/hour, 7.2 ml/hour and 14.1 ml/hour, respectively; and, when the temperatures were not thermostatically controlled, the compensations for evaporation produced in the above-mentioned processing steps were carried out collectively by adding up the amounts of 3.8 ml/hour, 3.1 ml/hour and 6.1 ml/hour, respectively, when starting a thermostatic control.

The tank solutions to be used for starting the processing steps were prepared by making use of a Konica Color QA Paper Color Developing Starting Chemical Kit 82P-1B (manufactured by Konica Corp.), a Konica Color QA Paper Bleach-Fixing Starting Chemical Kit 82P-2B (manufactured by the same) and a Konica Color QA Paper Stabilizing Chemical Kit 82P-3B (manufactured by the same), respectively.

The color paper processing tableted chemicals were prepared in accordance with the following procedures (A through G).

1) Tableted chemical for replenishing a color paper developing solution

Procedures (A)

A developing agent, that was in an amount of 1200 g of CD-3 standing for 4-amino-3-methyl-N-ethyl-N-[β-(methane sulfonamido)ethyl]aniline sulfate, was pulverized in a Bandam Mill available on the market so as to have an average particle size of 10 μm. The resulting fine powder were granulated by adding 50 ml of water in a stirring-granulator available on the market at room temperature for about 7 minutes. The resulting granules were dried by a fluid-bed type drier at 40° C. for 2 hours so that the moisture of the granules were almost completely removed. The granules prepared in such a manner as mentioned above and 150 g of polyethylene glycol 6000 were uniformly mixed up together for 10 minutes by making use of a mixer in a room thermostatically controlled to be not higher than 25° C. and 40%RH. Then, after 4 g of sodium N-lauroyl alanine was added thereto so as to be mixed up together for 3 minutes, the resulting mixture was compression-tableted by a remodeled Tough Press Collect Model 1527HU tableting machine (manufactured by Kikusui Mfg. Works, Ltd.) so that the filling amount thereof could be 1.0 g per tablet. Resultingly, 400 pieces of tableted chemical A having a tablet size of 15 mm for replenishing a color paper developing solution could be prepared.

Procedures (B)

In the same procedures as in Procedures (A), 120 g of disodium disulfoethyl hydroxylamine was pulverized and then granulated. An amount of water added was 6.0 ml. After completing the granulation, the resulting granules were dried up at 50° C. for 30 minutes, so that the moisture of the granules were almost completely removed. The resulting granules prepared in such a manner as mentioned above and 4 g of sodium N-lauroyl alanine were mixed up together for 3 minutes by making use of a mixer in a room thermostatically controlled to be 25° C. and 40%RH. The resulting mixture was compression-tableted by a remodeled Tough-Pressed-Collect Model 1527HU tableting machine (manufactured by Kikusui Mfg. Works, Ltd.) so that the filling amount thereof could be 1.0 g per tablet. Resultingly, 100 pieces of tableted chemical B having a tablet size of 15 mm for replenishing a color paper developing solution could be prepared.

Procedures (C)

As in Procedures (A), 30.0 g of Cinopar SFP (manufactured by Ciba-Geigy AG.), 3.7 g of sodium sulfite, 0.3 g of potassium bromide, 25 g of diethylenetriamine pentacetate, 280 g of sodium p-toluenesulfonate, 20 g of potassium hydroxide and 10.6 g of mannitol were pulverized and were then uniformly mixed up together. In the same manner as in Procedures (A), water was added in an amount of 20 ml so that the granulation was carried out. After completion of the granulation, the resulting granules were dried up at 60° C. for 30 minutes, so that the moisture of the granules were almost completely removed. The resulting granules prepared in such a manner as described above and 4 g of sodium N-lauroyl alanine were mixed up together for 3 minutes by making use of a mixer in a room thermostatically controlled to be 25° C. and 40%RH. The resulting mixture was compression-tableted by a remodeled Tough-Pressed-Collect Model 1527HU tableting machine (manufactured by Kikusui Mfg. Works, Ltd.) so that the filling amount thereof could be 3.2 g per tablet. Resultingly, 100 pieces of tableted chemical C having a tablet size of 15 mm for replenishing a color paper developing solution could be prepared.

Procedures (D)

As in Procedures (A), 350.0 g of potassium carbonate was pulverized and granulated. Water was added in an amount of 20 ml. After completion of the granulation, the resulting granules were dried up at 700° C. for 30 minutes, so that the moisture of the granules were almost completely removed. The resulting granules prepared in such a manner as described above and 15 g of polyethylene glycol 6000 were uniformly mixed up together for 10 minutes by making use of a mixer in a room thermostatically controlled to be 25° C. and 40%RH. Then after adding 4 g of sodium N-lauroyl alanine thereto and, after mixing up together, the resulting mixture was compression-tableted by a remodeled Tough-Pressed-Collect Model 1527HU tableting machine (manufactured by Kikusui Mfg. Works, Ltd.) so that the filling amount thereof could be 3.0 g per tablet. Resultingly, 110 pieces of tableted chemical D having a tablet size of 20 mm for replenishing a color paper developing solution could be prepared.

2) Replenishing tableted chemical for color paper bleach-fixation

Procedures (E)

As in Procedures (C), 1250 g of Ferric ammonium diethylenetriamine pentacetate, 25 g of ethylenediamine tetraacetic acid, 250 g of maleic acid and 46 g of Pine-flow (manufactured by Matsutani Chemical Co.) were each pulverized, mixed up together and granulated. Water was added in an amount of 20 ml and the resulting granules were dried up at 60° C. for 2 hours, so that the moisture of the granules were almost completely removed. To the resulting granules prepared in such a manner as described above, 15 g of sodium N-lauroyl sarcosine was added up. The resulting mixture was mixed up together for 3 minutes by making use of a mixer in a room thermostatically controlled to be 25° C. and 40%RH. The resulting mixture was compression-tableted by a remodeled Tough-Pressed-Collect Model 1527HU tableting machine (manufactured by Kikusui Mfg. Works, Ltd.) so that the filling amount thereof could be 8.6 g per tablet. Resultingly, 170 pieces of tableted chemical A having a tablet size of 30 mm for replenishing a color paper bleach-fixing solution could be prepared.

Procedures (F)

As in Procedures (C), 1640 g of ammonium thiosulfate, 750 g of sodium sulfite, 40 g of potassium bromide and 50 g of p-toluene sulfinic acid were each pulverized, mixed up together and granulated. Water was sprayed in an amount of 100 ml. After completing the granulation, the resulting granules were dried up at 60° C. for 120 minutes, so that the moisture of the granules were almost completely removed. To the resulting granules prepared in such a manner as described above, 20 g of sodium N-lauroyl sarcosine was added and the mixture thereof was mixed up for 3 minutes by making use of a mixer in a room thermostatically controlled to be not higher than 25° C. and 40%RH. The resulting mixture was compression-tableted by a remodeled Tough-Pressed-Collect Model 1527HU tableting machine (manufactured by Kikusui Mfg. Works, Ltd.) so that the filling amount thereof could be 13.4 g per tablet. Resultingly, 180 pieces of tableted chemical B having a tablet size of 30 mm for replenishing a color paper bleach-fixing solution could be prepared.

3) Tableted chemical for replenishing a color paper stabilizing solution

Procedures (G)

As in Procedures (C), 10 g of sodium carbonate monohydrate, 2000 g of disodium 1-hydroxyethane-1,1-diphosphonate, 150 g of Cinopar SFP, 300 g of sodium sulfite, 20 g of zinc sulfate heptahydrate, 150 g of disodium ethylenediamine tetracetate, 200 g of ammonium sulfate, 10 g of o-phenylphenol and 25 g of Pine-Flow were each pulverized, mixed up together and granulated. Water was added in an amount of 60 ml. After completing the granulation, the resulting granules were dried up at 70° C. for 60 minutes, so that the moisture of the granules were almost completely removed. To the resulting granules prepared in such a manner as described above, 10 g of sodium N-lauroyl sarcosine was added and the mixture thereof was mixed up for 3 minutes by making use of a mixer in a room thermostatically controlled to be not higher than 25° C. and 40%RH. The resulting mixture was compression-tableted by a remodeled Tough-Pressed-Collect Model 1527HU tableting machine (manufactured by Kikusui Mfg. Works, Ltd.) so that the filling amount thereof could be 3.1 g per tablet. Resultingly, 360 pieces of tableted chemical B having a tablet size of 30 mm for replenishing a color paper stabilizing solution could be prepared. In the preparation, the compression-tableting pressures applied to Procedures (A) through (G) were 650 kg/cm$^2$, respectively.

Next, as the tableted chemical for replenishing a color developing solution, one piece each of the above-described tableted chemicals A, B, C and D, i.e., 4 pieces of the tableted chemicals in total, were packed in a subpackage, and a series of 20 subpackages were separately packed in a four-side sealing system. And, as the tableted chemical for replenishing a bleach-fixing solution, one piece of the above-described tableted chemical A and two pieces each of the tableted chemical B, i.e., 3 pieces of the tableted chemicals in total, were packed in a subpackage, and a series of 20 subpackages were separately packed in the same manner as in the above-mentioned tableted chemicals for replenishing a color developing solution.

Further, as the tableted chemicals for replenishing a stabilizing solution, one piece each of the tableted chemicals were packed in a subpackage and the subpackages were separately packed in the same manner as described above.

The four-side sealing materials were prepared in such a manner that a unstretched polypropylene film and a stretched polypropylene film each laminated on the surface of the unstretched polypropylene film.

The resulting unstretched polypropylene/stretched polypropylene film was heat-sealed, so that the above-described tableted chemicals were separately packed.

Color paper of 5 m$^2$ was processed per day until the overflow was doubled as much as the tank capacity (or 2.0 R). When reaching 2.0 R, each of the accumulated quantities of undissolved tableted chemicals remained in every processing tank was measured and, further, the solubility of each tableted chemical was also observed.

For observing the solubility of each tableted chemical, the tableted chemical supply section in a processing tank was remodeled by arranging a transparent acryl-made plate to the processing tank section, and the period was measured visually from the point of time immediately after putting one separate package of tableted chemicals to the point of time when they were completely dissolved.

The results of the evaluations will be given below.

○: No problem,

Δ: A slight precipitate was found in a processing solution and an oil-out was produced, x : A large amount of precipitates were produced in a processing solution, and xx : A large amount of precipitates were produced in a processing solution and they adhered to a light-sensitive material.

A sample was exposed imagewise to light immediately after putting a solid processing chemical once and another sample was exposed imagewise to light immediately before putting the next solid processing chemical, and then each of the samples was developed. The resulting difference between the maximum blue reflection densities of the samples, i.e., Δ Dmax (B), was measured, and the average value thereof was calculated out from the start of a running process to the time when putting solid processing chemicals up to 16 times.

The results thereof will be shown in Table 2 given below.

TABLE 2

| Sample No. | Processing tank | Quantity of light-sensitive material processed per separate package (R) (m$^2$) | Completely dissolved time per separate package (S) (min) | S/R (min./m$^2$) | Accumulated number of insoluble tablets after completing 2.0 R | Dissolving condition | Average of ΔDmax (B) |
|---|---|---|---|---|---|---|---|
| 1-1 (Invention) | Color developing tank | 1.0 m$^2$ | 13 min. | 13.0 | 0 piece | ○ | 0.01 |
| 1-2 (Comparison) | Color developing tank | 0.1 m$^2$ | 13 min. | 130.0 | 11 pieces | XX | 0.10 |
| 1-3 (Comparison) | Color developing tank | 0.15m$^2$ | 13 min. | 86.7 | 7 pieces | XX | 0.07 |
| 1-4 (Invention) | Color developing tank | 0.2 m$^2$ | 13 min. | 65.0 | 3 pieces | Δ | 0.03 |
| 1-5 (Invention) | Color developing tank | 0.35m$^2$ | 13 min. | 37.1 | 1 pieces | ○ | 0.01 |
| 1-6 (Invention) | Color developing tank | 0.6 m$^2$ | 13 min. | 21.7 | 1 piece | ○ | 0.01 |
| 1-7 (Invention) | Color developing tank | 3.0 m$^2$ | 13 min. | 4.3 | 0 piece | ○ | 0.01 |
| 1-8 (Invention) | Color developing tank | 5.0 m$^2$ | 13 min. | 2.6 | 0 piece | Δ | 0.03 |
| 1-9 (Comparison) | Color developing tank | 7.0 m$^2$ | 13 min. | 1.9 | 0 piece | X | 0.11 |
| 1-10 (Comparison) | Color developing tank | 16.0 m$^2$ | 13 min. | 0.8 | 0 piece | XX | 0.18 |
| 1-11 (Invention) | Bleach-fixing tank | 0.55m$^2$ | 21 min. | 39.6 | 3 pieces | ○ | 0.01 |
| 1-12 (Comparison) | Bleach-fixing tank | 0.2 m$^2$ | 21 min. | 105.0 | 16 pieces | XX | 0.01 |

TABLE 2-continued

| Sample No. | Processing tank | Quantity of light-sensitive material processed per separate package (R) ($m^2$) | Completely dissolved time per separate package (S) (min) | S/R (min./$m^2$) | Accumulated number of insoluble tablets after completing 2.0 R | Dissolving condition | Average of ΔDmax (B) |
|---|---|---|---|---|---|---|---|
| 1-13 (Invention) | Bleach-fixing tank | 0.3$m^2$ | 21 min. | 70.0 | 5 pieces | ○ | 0.01 |
| 1-14 (Invention) | Bleach-fixing tank | 0.8$m^2$ | 21 min. | 26.3 | 3 pieces | ○ | 0.01 |
| 1-15 (Invention) | Bleach-fixing tank | 3.0$m^2$ | 21 min. | 7.0 | 2 pieces | ○ | 0.01 |
| 1-16 (Invention) | Bleach-fixing tank | 10.0$m^2$ | 21 min. | 2.1 | 2 pieces | Δ | 0.01 |
| 1-17 (Comparison) | Bleach-fixing tank | 15.0$m^2$ | 21 min. | 1.4 | 2 pieces | XX | 0.01 |
| 1-18 (Invention) | Stabilizing tank | 1.0$m^2$ | 44 min. | 44.0 | 0 piece | ○ | 0.01 |
| 1-19 (Comparison) | Stabilizing tank | 0.3$m^2$ | 44 min. | 146.7 | 14 pieces | XX | 0.01 |
| 1-20 (Invention) | Stabilizing tank | 0.5$m^2$ | 44 min. | 88.0 | 7 pieces | X | 0.01 |
| 1-21 (Invention) | Stabilizing tank | 2.0$m^2$ | 44 min. | 22.3 | 0 piece | ○ | 0.01 |
| 1-22 (Invention) | Stabilizing tank | 8.0$m^2$ | 44 min. | 5.5 | 0 piece | ○ | 0.01 |
| 1-23 (Invention) | Stabilizing tank | 20.0$m^2$ | 44 min. | 2.2 | 0 piece | Δ | 0.01 |
| 1-24 (Comparison) | Stabilizing tank | 25.0$m^2$ | 44 min. | 1.8 | 0 piece | X | 0.01 |

*Among the processing tanks not shown in the table, 1-1 was used for the color developing tank, 1-9 for the bleach-fixing tank and 1-16 for the stabilizing tank, respectively.

It is obvious from Table 2 that the S/R values of the invention has a close relation to the solid processing chemical dissolving conditions and that the more an S/R value is larger, the more the solid processing chemicals are accumulated, so that an insoluble phenomenon is produced.

It was also proved that, when an S/R value is relatively low, a condensed portion is locally produced in a processing solution and a precipitation is produced from the condensed portion and is then grown up. It was further proved that, when an S/R value becomes lower, there raised such a problem that a color development is fluctuated during a process.

It can be proved that excellent results can be shown without raising any problem of the above-mentioned phenomena, provided that an S/R value is within the scope of the relation of $2 \leqq S/R \leqq 70$.

Example 2

The experiments of the color developing solutions were tried in the same manner as in Example 1, except that the tableting pressure applied to the color developing tableted chemicals in Procedures (A) through (D) and the amounts of potassium carbonate used in Procedures (D) each of Example 1 were changed as shown in Table 3.

The results thereof will be shown in Table 3 given below.

TABLE 3

| Sample No. | Quantity of light-sensitive material processed per separate package (R) ($m^2$/g) | Tableting pressure in Procedures (A)–(D) (kg/$m^2$) (A) | (B) | (C) | (D) | Potassium carbonate (g) | Completely dissolved time per separate package (min) | S/R (min/$m^2$) | Accumulated number of insoluble tablets after completing 2.0 R (piece) | Dissolving condition |
|---|---|---|---|---|---|---|---|---|---|---|
| 2-1 (Invention) | 2.0 $m^2$ | 650 | 650 | 650 | 650 | 350 | 13 min. | 6.5 | 0 piece | ○ |
| 2-2 (Comparison) | 2.0 $m^2$ | 100 | 100 | 100 | 100 | 350 | 3 min. | 1.5 | 0 piece | XX |
| 2-3 (Invention) | 2.0 $m^2$ | 300 | 300 | 300 | 300 | 350 | 7 min. | 3.5 | 0 piece | ○ |
| 2-4 (Invention) | 2.0 $m^2$ | 1200 | 1200 | 1200 | 1200 | 350 | 28 min. | 14.0 | 1 piece | ○ |
| 2-5 (Invention) | 2.0 $m^2$ | 1200 | 1200 | 1200 | 1200 | 500 | 49 min. | 24.5 | 1 piece | ○ |
| 2-6 (Invention) | 2.0 $m^2$ | 1200 | 1200 | 1500 | 1500 | 500 | 61 min. | 30.5 | 2 pieces | ○ |
| 2-7 | 2.0 $m^2$ | 1500 | 1200 | 1200 | 1500 | 750 | 83 min. | 41.5 | 2 pieces | ○ |

TABLE 3-continued

| Sample No. | Quantity of light-sensitive material processed per separate package (R) ($m^2$/g) | Tableting pressure in Procedures (A)–(D) ($kg/m^2$) (A) | (B) | (C) | (D) | Potassium carbonate (g) | Completely dissolved time per separate package (min) | S/R (min/$m^2$) | Accumulated number of insoluble tablets after completing 2.0 R (piece) | Dissolving condition |
|---|---|---|---|---|---|---|---|---|---|---|
| (Invention) 2-8 | 1.0 $m^2$ | 650 | 650 | 650 | 650 | 350 | 13 min. | 13.0 | 0 piece | ○ |
| (Invention) 2-9 | 1.0 $m^2$ | 300 | 300 | 300 | 300 | 350 | 7 min. | 7.0 | 0 piece | ○ |
| (Invention) 2-10 | 1.0 $m^2$ | 1200 | 1200 | 1200 | 1200 | 350 | 28 min. | 28.0 | 2 pieces | ○ |
| (Invention) 2-11 | 1.0 $m^2$ | 1200 | 1200 | 1200 | 1200 | 500 | 49 min. | 49.0 | 2 pieces | ○ |
| (Invention) 2-12 | 1.0 $m^2$ | 1200 | 1200 | 1200 | 1500 | 500 | 61 min. | 61.0 | 5 pieces | Δ |
| (Invention) 2-13 | 1.0 $m^2$ | 1500 | 1200 | 1200 | 1500 | 750 | 83 min. | 83.0 | 13 pieces | XX |
| (Comparison) | | | | | | | | | | |

As is obvious from the contents of Table 3, the effects of the invention can also be surely displayed by controlling the raw materials contained in tableted chemicals and the tableting pressure.

Example 3

Each of the granule-shaped processing chemicals was prepared in the same procedures as in Example 1, except that the tableting steps carried out in Procedures (A) through (G) were excluded.

Each of the powder-shaped processing chemicals was prepared by excluding the tableting steps carried out in Procedures (A) through (G) and the granulating steps.

The experiments of the resulting tableted chemicals, granulated chemicals, powdered processing chemicals and the color developing chemicals for these processing chemicals were tried in the same manner as in Example 1.

The results thereof will be shown in Table 4 given below.

TABLE 4

| Sample No. | Shape of solid processing chemical | Quantity of light-sensitive material processed per separate package (R) ($m^2$) | Completely dissolved time per separate package (min) | S/R (min./$m^2$) | Dissolving condition | Average of ΔDmax (B) |
|---|---|---|---|---|---|---|
| 3-1 (Comparison) | Tablet | 0.15$m^2$ | 13 min. | 86.7 | XX | 0.07 |
| 3-2 (Invention) | Tablet | 0.2 $m^2$ | 13 min. | 65.0 | ○ | 0.02 |
| 3-3 (Invention) | Tablet | 0.6 $m^2$ | 13 min. | 21.7 | ○ | 0.02 |
| 3-4 (Invention) | Tablet | 1.0 $m^2$ | 13 min. | 13.0 | ○ | 0.01 |
| 3-5 (Invention) | Tablet | 3.0 $m^2$ | 13 min. | 4.3 | ○ | 0.01 |
| 3-6 (Invention) | Tablet | 5.0 $m^2$ | 13 min. | 2.6 | Δ | 0.03 |
| 3-7 (Comparison) | Tablet | 7.0 $m^2$ | 13 min. | 1.9 | ○ | 0.11 |
| 3-8 (Comparison) | Granule | 0.07$m^2$ | 6 min. | 85.0 | XX | 0.12 |
| 3-9 (Invention) | Granule | 0.09$m^2$ | 6 min. | 65.0 | Δ | 0.04 |
| 3-10 (Invention) | Granule | 0.27$m^2$ | 6 min. | 22.0 | ○ | 0.02 |
| 3-11 (Invention) | Granule | 0.46$m^2$ | 6 min. | 13.0 | ○ | 0.02 |
| 3-12 (Invention) | Granule | 1.5 $m^2$ | 6 min. | 4.0 | ○ | 0.03 |
| 3-13 (Invention) | Granule | 2.4 $m^2$ | 6 min. | 2.5 | Δ | 0.05 |
| 3-14 (Comparison) | Granule | 3.16$m^2$ | 6 min. | 1.9 | X | 0.15 |
| 3-15 (Comparison) | Powder | 0.05$m^2$ | 4 min. | 85.0 | XX | 0.15 |
| 3-16 (Invention) | Powder | 0.06$m^2$ | 4 min. | 65.0 | Δ | 0.06 |
| 3-17 (Invention) | Powder | 0.18$m^2$ | 4 min. | 22.0 | Δ | 0.05 |

TABLE 4-continued

| Sample No. | Shape of solid processing chemical | Quantity of light-sensitive material processed per separate package (R) ($m^2$) | Completely dissolved time per separate package (min) | S/R (min./$m^2$) | Dissolving condition | Average of ΔDmax (B) |
|---|---|---|---|---|---|---|
| 3-18 (Invention) | Powder | 0.31$m^2$ | 4 min. | 13.0 | Δ | 0.03 |
| 3-19 (Invention) | Powder | 1.0 $m^2$ | 4 min. | 4.0 | Δ | 0.04 |
| 3-20 (Invention) | Powder | 1.6 $m^2$ | 4 min. | 2.5 | Δ | 0.07 |
| 3-21 (Comparison) | Powder | 2.1 $m^2$ | 4 min. | 1.9 | X | 0.18 |

As in obvious from the contents of Table 4, it was proved that the improvements of the dissolving conditions of the solid processing chemicals and the scattering of the processing results, which were induced from the invention, were preferable when the solid processing chemicals were of the granule-shaped, and that the effects of the invention can remarkably be displayed more preferably when the solid processing chemicals were of the tablet-shaped.

Example 4

After a Konica Color Super DD-100 negative film was exposed imagewise to light, a color negative film processor, Model CL-KP-50QA was so remodeled as to have a system in which a four-side sealed packaging material can be used. Then, a continuous processing treatment was carried out.

TABLE 5

| Processing step | Processing time | Processing temperature | Replenishing water* |
|---|---|---|---|
| Color developing | 3 min. 15 sec. | 38° C. | 20 |
| Bleaching | 45 sec. | 38° C. | 5 |
| Fixing-1 | 45 sec. | 38° C. | — |
| Fixing-2 | 45 sec. | 38° C. | 30 |
| Stabilizing-1 | 20 sec. | 38° C. | — |
| Stabilizing-2 | 20 sec. | 38° C. | — |
| Stabilizing-3 | 20 sec. | 38° C. | 40 |
| Drying | 80 sec. | 55° C. | — |

*ml/24-exposure roll film

The fixing steps were carried out from step-2 to step-1 and the stabilizing steps were done from step-3 to step-2 and then step-2 to step-1, each in the counter-current systems. In the bleaching tank, an aeration was carried out by an air-pump.

When the temperatures were thermostatically controlled, the compensations for evaporation were carried out in a program in which 10 ml, 6.5 ml, 7 ml, 7 ml, 8.6 ml, 8.6 ml and 9.3 ml of water were replenished per hour to the color developing tank, bleaching tank, fixing-1 tank, fixing-2 tank, stabilizing-1 tank, stabilizing-2 tank and stabilizing-3 tank, respectively. And, when the temperatures were not thermostatically controlled, the compensations for evaporation were carried out by adding up the non-thermostatically controlling time and 7.5 ml, 5 ml, 6 ml, 6 ml, 5 ml, 5 ml and 5 ml of evaporation compensating water were collectively replenished per hour to the color developing tank, bleaching tank, fixing-1 tank, fixing-2 tank, stabilizing-1 tank, stabilizing-2 tank and stabilizing-3 tank, respectively. The tank solution to be used for the start was prepared by making use of the replenishing solution for Konica Color Negative Film Processing Chemical (Process CNK-4-52) and the starter chemical therefor.

A color negative film processing tableted chemical was prepared in the following procedures.

1) Tableted chemical for replenishing a color negative film developing solution

Procedures (1)

A developing agent, that was in an amount of 150 g of CD-4 standing for 4-amino-3-methyl-N-ethyl-N-[β-(hydroxy) ethyl] aniline sulfate, was pulverized in a Bandam Mill available on the market so as to have an average particle size of 10 μm. The resulting fine powder were granulated by adding 10 ml of water in a stirring.granulator available on the market at room temperature for about 7 minutes. The resulting granules were dried by a fluid-bed type drier at 40° C. for 2 hours so that the moisture of the granules were almost completely removed. And, 0.3 g of sodium N-lauroyl alanine and 1.3 g of polyethylene glycol 6000 were added to the granules prepared in such a manner as mentioned above, and the mixture thereof was uniformly mixed up together for 10 minutes by making use of a mixer in a room thermostatically controlled to be not higher than 25° C. and 40%RH. Then, the resulting mixture was compression-tableted by a remodeled Tough-Pressed-Collect Model 1527HU tableting machine (manufactured by Kikusui Mfg. Works, Ltd.) so that the filling amount thereof could be 1.1 g per tablet. Resultingly, 126 pieces of tableted chemical A for replenishing a color negative film developing solution could be prepared.

Procedures (2)

As in Procedures (1), 69.4 g of hydroxylamine sulfate and 4 g of Pine-Flow (manufactured by Matsutani Chemical Co.) were pulverized and, thereafter, mixed up together and granulated. The amount of water added was set to be 20 ml and, after completion of the granulation, the resulting granules were dried up at 60° C. for 30 minutes, so that the moisture of the granules were almost completely removed. The resulting granules prepared in such a manner as described above and 0.3 g of sodium N-lauroyl alanine were mixed up together for 3 minutes by making use of a mixer in a room thermostatically controlled to be 25° C. and 40%RH. The resulting mixture was compression-tableted in the same manner as in Procedures (1) by making use of a tableting machine so that the filling amount thereof could be 0.56 g per tablet. Resultingly, 120 pieces of tableted chemical B for replenishing a color negative film developing solution could be prepared.

Procedures (3)

In the same manner as in Procedures (1), 15 g of disodium 1-hydroxyethane-1,1-diphosphonate, 72.8 g of potassium sulfite, 375 g of potassium carbonate, 3 g of sodium hydrogen carbonate, 3.7 g of sodium bromide and 22 g of mannitol were pulverized and mixed up together. The amount of water to be added was et to be 40 ml and the granulation thereof was carried out. After completing the granulation, the resulting granules were dried at 70° C. for 60 minutes, so that the moisture of the granules were almost completely removed. To the granules thus prepared, 2 g of N-lauroyl alanine was added and the mixture thereof was mixed up by a mixer for 3 minutes in a room thermostatically controlled to be not higher than 25° C. and 40%RH. Further in the same manner as in Procedures (1), the filling amount per tablet was set to be 3.9 g by making use of a tableting machine. Resultingly, 120 pieces of tableted chemical C for replenishing a color negative film developing solution could be prepared.

2) Tablet for replenishing a color negative film bleaching solution

Procedures (4)

In the same manner as in Procedures (1), 175 g of ferric ammonium 1,3-propanediamine tetracetate, 2 g of 1,3-propanediamine tetracetic acid and 17 g of Pine-Flow (manufactured by Matsutani Chemical Co.) were pulverized and then mixed up. The mixture was granulated by setting the amount of water added to be 8 ml. After completing the granulation, the resulting granules were dried at 60° C. for 30 minutes and the moisture of the granules were almost completely removed.

Procedures (5)

In the same manner as in Procedures (1), 133 g of succinic acid, 200 g of ammonium bromide and 10.2 g of Pine-Flow were pulverized, mixed up and then granulated. After completing the granulation upon setting the amount of water added was set to be 17 ml, the resulting granules were dried up at 60° C. for 30 minutes, so that the moisture of the granules were almost completely removed.

Procedures (6)

In the same manner as in Procedures (1), 66.7 g of potassium sulfate, 60 g of potassium hydrogencarbonate and 8 g of mannitol were pulverized, mixed up and then granulated. After the granulation was completed upon setting the amount of water added was set to be 13 ml, the resulting granules was dried up at 60° C. for 60 minutes, so that the moisture of the granules were almost completely removed.

Procedures (7)

The granules prepared in the above-mentioned Procedures (4) through (6) were uniformly mixed up by making use of a mixer for 10 minutes in a room thermostatically controlled to be not higher than 25° C. and 40%RH. To the resulting mixed granules, 6 g of sodium N-lauroyl sarcosine was added and the mixture thereof was mixed up for 3 minutes. Then, the mixture thereof was compression-tableted so as to have the filling amount per tablet of 6.5 g by making use of a remodeled Tough-Pressed Collect Model 1527HU tableting machine manufactured by Kikusui Mfg. Works, Ltd. Resultingly, 80 pieces of tableted chemicals for replenishing a color negative film bleaching solution.

3) Tableted chemical for replenishing a color negative film fixing solution

Procedures (8)

In the same manner as in Procedures (1), 2500 g of ammonium thiosulfate, 150 g of sodium sulfite, 150 g of potassium carbonate, 20 g of disodium ethylenediamine tetracetate and 65 g of Pine-Flow (manufactured by Matsutani Chemical Co.) were pulverized, mixed up and granulated. After the completing the granulation upon setting the amount of water added to be 50 ml, the resulting granules were dried up at 60° C. for 120 minutes, so that the moisture of the granules were almost completely removed.

Procedures (9)

The granules prepared in the above-described Procedures (8) and 13 g of sodium N-lauroyl sarcosine were mixed up by a mixer for 3 minutes in a room thermostatically controlled to be not higher than 25° C. and 40%RH. Then, the resulting mixture was compression-tableted so as to have a filling amount of 9.3 g per tablet by making use of a remodeled Tough-Pressed-Collect Model 1527HU manufactured by Kikusui Mfg. Works, Ltd. Resultingly, 280 pieces of tableted chemicals for replenishing a color negative film fixing solution could be prepared.

4) Tableted chemical for replenishing a color negative film stabilizing solution Procedures (10)

In the same manner as in Procedures (1), 150 g of m-hydroxybenzaldehyde, 20 g of sodium laurylsulfate, 60 g of disodium ethylenediamine tetracetate, 65 g of lithium hydroxide monohydrate and 10 g of Pine-Flow were pulverized, mixed up and then granulated. After the granulation thereof was completed upon setting the amount of water added to be 10 ml, the resulting granules were dried at 50° C. for 2 hours, so that the moisture of the granules were almost completely removed.

Procedures (11)

The granules prepared in the above-described Procedures (10) were compression-tableted by a remodeled Tough-Pressed-Collect 1527HU tableting machine manufactured by Kikusui Mfg. Works, Ltd. so as to have a filling amount of 0.48 g. Resultingly, 280 pieces of tableted chemicals for replenishing a color negative film stabilizing solution could be prepared.

As for the tableted chemicals for replenishing a color developing solution, 2 pieces each of tableted chemical A, one pieces each of tableted chemical B and one piece each of tableted chemical C were packed in a subpackage; for the tableted chemical for replenishing a bleaching solution, 2 pieces thereof are packed in the same subpackage; for the tableted chemical for replenishing a fixing solution, 3 pieces thereof are packed therein; and for the tableted chemical for replenishing s stabilizing solution, one piece each thereof is packed therein; respectively. And, a series of 20 separate packages were packed in a separate package in a four-side sealing system. The packaging materials thereof were the same as those used in Example 1.

The processing treatments were carried out per day until the amount of the overflow from the color developing tank reached 5% of the tank capacity and the amount of the overflow was doubled as much as the capacity of the tank solution (or 2.0 R). Similar to the case of Example 1, when reaching 2.0 R, the experiments were tried on each of the accumulated quantities of undissolved tableted chemicals remaining in every processing tank and on the dissolving conditions of each tableted chemical.

One of Konica Color Super DD-100 films was exposed imagewise to light immediately after putting a solid processing chemical once and the other of the same films was exposed imagewise to light immediately before putting the next solid processing chemical, and then each of them was developed. The resulting difference between the maximum blue reflection densities of the developed films, i.e., Δ Dmax (B), was measured, and the average value thereof was calculated out from the start of a running process to the time when putting solid processing chemicals up to 10 times.

The results thereof will be shown in Tables 6 and 7 given below.

TABLE 6

| Sample No. | Processing tank | Quantity of light-sensitive material processed per separate package (R) ($m^2$) | Completely dissolved time per separate package (min) | S/R (min./$m^2$) | Accumulated number of insoluble tablets after completing 2.0 R | Dissolving condition | Average of ΔDmax (B) |
|---|---|---|---|---|---|---|---|
| 4-1 (Invention) | Color developing tank | Film (24 ex) 8 rolls (2.6 $m^2$) | 14 min. | 5.4 | 1 piece | ○ | 0.01 |
| 4-2 (Comparison) | Color developing tank | Film (24 ex) 0.5 roll (0.16 $m^2$) | 14 min. | 87.5 | 13 pieces | XX | 0.05 |
| 4-3 (Invention) | Color developing tank | Film (24 ex) 1 roll (0.32 $m^2$) | 14 min. | 42.4 | 7 pieces | Δ | 0.03 |
| 4-4 (Invention) | Color developing tank | Film (24 ex) 4 rolls (1.32 $m^2$) | 14 min. | 10.6 | 2 pieces | ○ | 0.02 |
| 4-5 (Invention) | Color developing tank | Film (24 ex) 12 rolls (4.0 $m^2$) | 14 min. | 3.5 | 1 piece | ○ | 0.01 |
| 4-6 (Invention) | Color developing tank | Film (24 ex) 20 rolls (6.5 $m^2$) | 14 min. | 2.1 | 1 piece | Δ | 0.09 |
| 4-7 (Comparison) | Color developing tank | Film (24 ex) 25 rolls (8.2 $m^2$) | 14 min. | 1.7 | 1 piece | XX | 0.27 |
| 4-8 (Invention) | Bleaching tank | Film (24 ex) 8 rolls (2.6 $m^2$) | 8 min. | 3.1 | 2 pieces | ○ | 0.01 |
| 4-9 (Comparison) | Bleaching tank | Film (24 ex) 0.1 roll (0.3 $m^2$) | 8 min. | 80.0 | 17 pieces | X | 0.01 |
| 4-10 (Invention) | Bleaching tank | Film (24 ex) 0.5 roll (0.16 $m^2$) | 8 min. | 50.0 | 7 pieces | Δ | 0.01 |
| 4-11 (Invention) | Bleaching tank | Film (24 ex) 1 roll (0.33 $m^2$) | 8 min. | 24.2 | 3 pieces | ○ | 0.01 |
| 4-12 (Invention) | Bleaching tank | Film (24 ex) 4 rolls (1.32 $m^2$) | 8 min. | 6.1 | 2 pieces | ○ | 0.01 |
| 4-13 (Invention) | Bleaching tank | Film (24 ex) 12 rolls (4.0 $m^2$) | 8 min. | 2.0 | 2 pieces | Δ | 0.01 |
| 4-14 (Comparison) | Bleaching tank | Film (24 ex) 15 rolls (4.9 $m^2$) | 8 min. | 1.6 | 2 pieces | XX | 0.01 |

TABLE 7

| Sample No. | Processing tank | Quantity of light-sensitive material processed per separate package (R) ($m^2$) | Completely dissolved time per separate package (min) | S/R (min./$m^2$) | Accumulated number of insoluble tablets after completing 2.0 R | Dissolving condition | Average of ΔDmax (B) |
|---|---|---|---|---|---|---|---|
| 4-15 (Invention) | Fixing tank | Film (24 ex) 8 rolls (2.6 $m^2$) | 13 min. | 5.0 | 3 pieces | ○ | 0.01 |
| 4-16 (Comparison) | Fixing tank | Film (24 ex) 0.5 roll (0.16 $m^2$) | 13 min. | 81.3 | 19 pieces | XX | 0.01 |
| 4-17 (Invention) | Fixing tank | Film (24 ex) 1 roll (0.33 $m^2$) | 13 min. | 39.4 | 7 pieces | ○ | 0.01 |
| 4-18 (Invention) | Fixing tank | Film (24 ex) 4 rolls (1.32 $m^2$) | 13 min. | 9.8 | 3 pieces | ○ | 0.01 |
| 4-19 (Invention) | Fixing tank | Film (24 ex) 12 rolls (4.0 $m^2$) | 13 min. | 3.3 | 2 pieces | ○ | 0.01 |
| 4-20 (Comparison) | Fixing tank | Film (24 ex) 25 rolls (8.2 $m^2$) | 13 min. | 1.6 | 2 pieces | XX | 0.01 |
| 4-21 (Invention) | Stabilizing tank | Film (24 ex) 8 rolls (2.6 $m^2$) | 43 min. | 16.5 | 4 pieces | ○ | 0.01 |
| 4-22 | Stabilizing tank | Film (24 ex) | 43 min. | 87.8 | 19 pieces | X | 0.01 |

TABLE 7-continued

| Sample No. | Processing tank | Quantity of light-sensitive material processed per separate package (R) ($m^2$) | Completely dissolved time per separate package (min) | S/R (min./$m^2$) | Accumulated number of insoluble tablets after completing 2.0 R | Dissolving condition | Average of ΔDmax (B) |
|---|---|---|---|---|---|---|---|
| (Comparison) | | 1.5 rolls (0.49 $m^2$) | | | | | |
| 4-23 (Invention) | Stabilizing tank | Film (24 ex) 2.0 rolls (0.66 $m^2$) | 43 min. | 65.2 | 8 pieces | Δ | 0.01 |
| 4-24 (Invention) | Stabilizing tank | Film (24 ex) 4.0 rolls (1.64 $m^2$) | 43 min. | 26.3 | 4 pieces | ○ | 0.01 |
| 4-27 (Invention) | Stabilizing tank | Film (24 ex) 20 rolls (6.6 $m^2$) | 43 min. | 6.5 | 3 pieces | ○ | 0.01 |
| 4-28 (Invention) | Stabilizing tank | Film (24 ex) 40 rolls (13.1 $m^2$) | 43 min. | 3.2 | 3 pieces | ○ | 0.01 |
| 4-29 (Invention) | Stabilizing tank | Film (24 ex) 60 rolls (19.6 $m^2$) | 43 min. | 2.2 | 3 pieces | Δ | 0.01 |
| 4-30 (Comparison) | Stabilizing tank | Film (24 ex) 80 rolls (26.2 $m^2$) | 43 min. | 1.6 | 3 pieces | XX | 0.01 |

*Among the processing tanks not shown in the table, 1-1 was used for the color developing tank, 4-8 for the bleaching tank, 4-17 for the fixing tank, and 4-28 for the stabilizing tank, respectively.

As is obvious from the contents of Tables 6 and 7, the effects of the invention can surely be displayed when the relation of $2 \leqq S/R \leqq 70$ can be satisfied.

Example 5

Tableted composition for color developer were prepared in accordance with the following procedure.

Procedure (H)

40 g of disulfoethylhydroxylamine disodium salt, 200 g of sodium p-toluenesulfonate, 30 g of Chinopal SFP (produced by Ciba-Geigy), 30 g of sodium diethylenetriamine pentaacetic acid and 30 g of Pine-Flow (produced by Matsutani Chemical Co., Ltd.) were mixed in a commercially-available mixing granulator to form granules, while adding 29 g of water gradually therein. Thereafter, the resulting granules were subjected to drying at 40° C. for 12 hours in a drier, so that the moisture content was reduced to 1% or less. Finally, the granules were subjected to filtering with mesh No. 16.

Procedure (I)

150 g of a color developing agent CD-3, 100 g of polyethylene glycol #6000 and 20 g of D-mannit were mixed in a mixing granulator to form granules, while 20 ml of water was added gradually. Then, the resulting granules were subjected to drying at 40° C. for 12 hours in a drier, so that the moisture content was reduced to 1% or less. Finally, the granules were subjected to filtering with mesh No. 16.

Procedure (J)

In a mixing granulator, 100 g of sodium p-toluenesulfonate, 4.0 g of sodium sulfite, 30 g of potassium hydroxide, 100 g of polyethyleneglycol (the average molecular weight; 6000), 330 g of potassium carbonate and 60 g of D-mannit were mixed for granulation while adding water (33 ml) gradually. The resulting granules were subjected to drying at 40° C. for 12 hours in a drier, so that the moisture content were reduced to 1% or less. Finally, the granulated mixture was subjected to filtering with mesh No. 16.

Procedure (K)

All granulated mixtures produced by the above-mentioned procedures (H) through (J), and 10 g of sodium N-myristoyl N-methyl-β-alanine were mixed in a mixer for 10 minutes.

Next, 11 g of the mixture was tableted with a tableting machine (Tough Press Collect 1527 HU produced by Kikusui Mfg. Works, Ltd.). The thus-formed tablet was cylindrical form with a diameter of 30 mm. Furthermore, tablets having bulk densitied as shown in Table 8 were prepared by further adding Pine-Flow or potassium sulfate and changing the compressing pressure for granulation. Using these tablets, color developing was run in the same manner as in Example 1. One tablet was charged for one charging operation. The results thereof is shown in Table 8 as below.

TABLE 8

| Sample No. | Bulk density of tablet | Amount of light-sensitive material processed per 1 tablet R ($m^2$) | Time for complete dissolution per 1 tablet S (min) | S/R (min/$m^2$) | Accumulated number of undissolved tablets at the end of 2.0 R | Condition of dissolution |
|---|---|---|---|---|---|---|
| 5-1 | 0.9 | 1.0 | 16 | 16 | 5 | Δ |
| 5-2 | 1.0 | 1.0 | 17 | 17 | 2 | ○ |
| 5-3 | 1.2 | 1.0 | 16 | 16 | 0 | ○ |
| 5-4 | 1.6 | 1.0 | 16 | 16 | 0 | ○ |
| 5-5 | 2.0 | 1.0 | 18 | 18 | 0 | ○ |
| 5-6 | 2.5 | 1.0 | 21 | 21 | 1 | ○ |

TABLE 8-continued

| Sample No. | Bulk density of tablet | Amount of light-sensitive material processed per 1 tablet R ($m^2$) | Time for complete dissolution per 1 tablet S (min) | S/R ($min/m^2$) | Accumulated number of undissolved tablets at the end of 2.0 R | Condition of dissolution |
|---|---|---|---|---|---|---|
| 5-7 | 2.7 | 1.0 | 24 | 24 | 6 | Δ |

As is apparent from Table 8, dissolution of the tablet is excellent when the bulk density of the tablet is in the range of 1.0 to 2.5 $g/cm^3$.

Example 6

Tableted color developer compositions having a filling amount of 11 g, a bulk density of 1.4 $g/cm^3$ and a diameter of 30 mm were prepared in the same manner as in Example 5 except that Chinopal SFP used in the procedure (H) was replaced by triazinyl stilben brighteners as shown in Table 9. Using these tablets, color developing was run in the same manner as in Example 1. The results are shown in Table 9.

As is apparent from Table 9, in the present invention, Both dissolubility and processing stability were further improved by incorporating triazinyl stilbene brightening agent in a color developer.

TABLE 9

| Sample No. | Additive (g) | Amount of light-sensitive material processed per 1 tablet R ($m^2$) | Time for complete dissolution per 1 tablet S (min) | S/R ($min/m^2$) | Accumulated number of undissolved tablets at the end of 2.0 R | Condition of dissolution | Average value of ΔDmax |
|---|---|---|---|---|---|---|---|
| 6-1 | E-4 30 g | 1.0 | 16 | 16 | 1 | ○ | 0.01 |
| 6-2 | E-24 30 g | 1.0 | 18 | 18 | 0 | ○ | 0.02 |
| 6-3 | E-34 30 g | 1.0 | 14 | 14 | 0 | ○ | 0.01 |
| 6-4 | E-35 30 g | 1.0 | 15 | 15 | 1 | ○ | 0.01 |
| 6-5 | E-36 30 g | 1.0 | 17 | 17 | 0 | ○ | 0.02 |
| 6-6 | E-37 30 g | 1.0 | 16 | 16 | 0 | ○ | 0.01 |
| 6-7 | E-41 30 g | 1.0 | 15 | 15 | 0 | ○ | 0.01 |
| 6-8 | E-10 30 g | 1.0 | 18 | 18 | 2 | ○ | 0.03 |
| 6-9 | not added | 1.0 | 19 | 19 | 3 | Δ | 0.06 |

What is claimed is:

1. A method for processing an exposed silver halide photographic light-sensitive material comprising

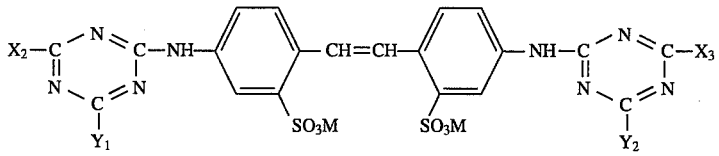

Formula [E]

developing the photographic material with a developer, fixing the photographic material with a fixer, and replenishing the developer during processing by supplying a processing composition, wherein the processing composition is a solid composition and said replenishing is held under the following requirement, $$2 \leqq S/R \leqq 70$$

wherein S is a dissolving time of a unit of a given weight of the solid composition supplied, expressed in minutes; and R is an amount of the photographic material to be processed with the processing composition by the unit of a given weight of the solid composition, in $m^2$.

2. The method of claim 1, wherein the solid composition is in the form of a tablet having a bulk density of 1.0 to 2.5 $g/cm^3$ or in the form of granules having a bulk density of 0.4 to 0.95 $g/cm^3$.

3. The method of claim 2, wherein the solid composition is packed in a package containing a prescribed amount thereof.

4. The method of claim 1, wherein the developer contains a brightening agent represented by the following formula [E]:

wherein $X_2$, $X_3$, $Y_1$ and $Y_2$ each represent a hydroxyl group, a halogen atom, an alkyl group, an aryl group,

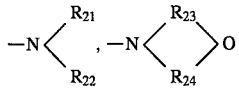

or —$OR_{25}$, in which $R_{21}$ and $R_{22}$ each represent a hydrogen atom, an alkyl group or an aryl group; $R_{23}$ and $R_{24}$ each represent an alkylene group; $R_{25}$ represents a hydrogen atom, an alkyl group or an aryl group; and M represents a cation.

5. A method for processing an exposed silver halide photographic light-sensitive material comprising developing the photographic material with a developer, fixing the photographic material with a fixer, and replenishing the developer during processing by supplying a solid composition, wherein the solid composition is in the form of a tablet and said replenishing is held under the following requirement, $$2 \leqq S/R \leqq 70$$

wherein S is a dissolving time of a unit of a given weight of the solid composition supplied, expressed in minutes; and R is an amount of the photographic material to be processed with the processing solution by the unit of a given weight of the solid composition, expressed in $m^2$.

6. The method of claim 5, wherein the solid composition is in the form of a tablet having a bulk density of 1.0 to 2.5 $g/cm^3$.

7. The method of claim 6, wherein the solid composition is packed in a package containing a prescribed amount thereof.

8. The method of claim 5, wherein the developer contains a brightening agent represented by the following formula [E]:

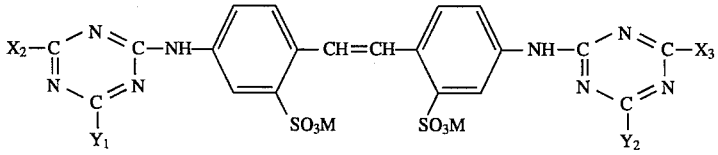

Formula [E]

wherein $X_2$, $X_3$, $Y_1$ and $Y_2$ each represent a hydroxyl group, a halogen atom, an alkyl group, an aryl group,

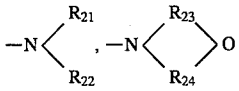

or $—OR_{25}$, in which $R_{21}$ and $R_{22}$ each represent a hydrogen atom, an alkyl group or an aryl group; $R_{23}$ and $R_{24}$ each represent an alkylene group; $R_{25}$ represents a hydrogen atom, an alkyl group or an aryl group; and M represents a cation.

* * * * *